US006814317B2

(12) United States Patent
Watanabe et al.

(10) Patent No.: US 6,814,317 B2
(45) Date of Patent: Nov. 9, 2004

(54) CONSTANT VOLUME DELIVERY DEVICE AND METHOD OF DELIVERING POWDER MATERIAL

(75) Inventors: Yasushi Watanabe, Sunto-gun (JP); Yuji Iwase, Sunto-gun (JP); Kiyoshi Morimoto, Sunto-gun (JP)

(73) Assignee: Kyowa Hakko Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/182,124

(22) PCT Filed: Jan. 17, 2001

(86) PCT No.: PCT/JP01/00245

§ 371 (c)(1),
(2), (4) Date: Dec. 11, 2002

(87) PCT Pub. No.: WO01/55016

PCT Pub. Date: Aug. 2, 2001

(65) Prior Publication Data

US 2003/0150928 A1 Aug. 14, 2003

(30) Foreign Application Priority Data

Jan. 27, 2002 (JP) ..... 2000-018989

(51) Int. Cl.[7] ..... B05B 1/00; B05B 17/04; B05B 1/08; B05B 3/04; B05B 1/30

(52) U.S. Cl. ..... 239/602; 239/4; 239/102.1; 239/533.14; 239/602

(58) Field of Search ..... 239/602, 42, 99, 239/102.2, 1, 101, 654, 532.1, 533.13, 533.14, 102.1

(56) References Cited

U.S. PATENT DOCUMENTS 5,375,694 A * 12/1994 Sanford et al. ..... 198/771
5,753,302 A * 5/1998 Sun et al. ..... 427/180
5,996,902 A * 12/1999 Morimoto et al. ..... 239/4

* cited by examiner

*Primary Examiner*—William C. Doerrler
(74) *Attorney, Agent, or Firm*—Fitzpatrick, Cella, Harper & Scinto

(57) ABSTRACT

A quantitative discharge apparatus for powder material, comprising: a tubular body for storing powder material; and an elastic membrane having plural penetrating apertures, the membrane constituting a bottom of the tubular body. The elastic membrane is vibrated by applying a positive pulsating vibration air, and thereby discharging powder material stored in the tubular body from the penetrating apertures of the elastic membrane. The plural penetrating apertures of the elastic membrane are formed on the circumference of a circle, of which center is a specific point of the elastic membrane.

26 Claims, 43 Drawing Sheets

CONSTANT VOLUME DELIVERY DEVICE AND METHOD OF DELIVERING POWDER MATERIAL

TECHNICAL FIELD

The present invention relates to a quantitative discharge apparatus and a method of discharging powder material wherein the discharge amount of powder material stored in a tubular body can be easily controlled and powder material can be quantitatively and stably discharged.

BACKGROUND ART

The inventors of the present invention have already proposed a device for discharging a minute amount of powder having an elastic membrane with a penetrating port in JP-A-8-161553 as a quantitative discharge apparatus for discharging powder material quantitatively.

FIG. 39 diagrammatically shows a construction of a powder material spray apparatus applying such a device for discharging a minute amount of powder.

The powder material spray apparatus 211 has the device for discharging a minute amount of powder 201 and a pneumatic transport pipe T.

The discharge device 201 has a powder material storage hopper 202 for storing powder material and an elastic membrane Etc provided at a material discharge port 202*a* of the powder material storage hopper 202 so as to form a bottom of the powder material storage hopper 202.

A cover 202*c* is attached detachably and airtightly at the material feed port 202*b* of the powder material storage hopper 202.

The powder material spray apparatus 211 is constructed such that the material discharge port 202*a* of the powder material storage hopper 202 of the discharge device 201 is connected to the midstream of the pneumatic transport pipe T via the elastic membrane Etc.

The elastic membrane Etc has a penetrating aperture hc at the center thereof as shown in FIG. 40.

One end Ta of the pneumatic transport pipe T is connected to a positive pulsating vibration air generation means 221 so that when the generation means 221 is driven, produced positive pulsating vibration air is supplied in the pneumatic transport pipe T from the end Ta.

Next, operations of the device for discharging a minute amount of powder 201 and the powder material spray apparatus 211 will be explained.

For spraying a fixed amount of powder material from the other end Tb of the pneumatic transport pipe T by means of the powder material spray apparatus 211, at first powder material is stored in the powder material storage hopper 202. Then the cover 202*c* is airtightly attached to the material feed port 202*b* of the storage hopper 202.

Driving the positive pulsating vibration air generation means 221, a positive pulsating vibration air is supplied in the pneumatic transport pipe T.

As a positive pulsating vibration air, a pulsating vibration air of which amplitude peak is higher than atmospheric pressure and of which amplitude valley is substantially at atmospheric pressure as shown in FIG. 41*a* or a pulsating vibration air of which amplitude peak and amplitude valley are higher than atmospheric pressure as shown in FIG. 41*b* may be used.

When a positive pulsating vibration air is supplied in the pneumatic transport pipe T of the device for discharging a minute amount of powder 201, the pressure in the pneumatic transport pipe T is increased at the peak amplitude of the pulsating vibration air and the elastic membrane Etc is elastically deformed to be upwardly curved being a specific point as the center of the node of vibration.

At this time the penetrating aperture hc is shaped like a letter V in such a manner that the top is opened in section.

A part of powder material stored in the powder material storage hopper 202 drops in the V-shaped penetrating aperture hc (see FIG. 42*a*).

Next, the positive pulsating vibration air supplied in the pneumatic transport pipe T becomes its valley, the pressure in the pneumatic pipe T is gradually reduced and the elastic membrane Etc returns its original position from the upwardly curved shape. The penetrating aperture hc is returned to its original shape from the V-shape with the top open. In this case the powder material dropped in the penetrating aperture hc when its top has been opened is caught in the aperture hc (see FIG. 42*b*).

When the positive pulsating vibration air becomes its valley and the pressure in the pneumatic transport pipe T is reduced, the elastic membrane Etc is elastically deformed to be curved downwardly being a specific point as the center of vibration node. The penetrating aperture hc is shaped like a reverse V of which bottom is opened. The powder material caught in the aperture hc drops in the pneumatic transport pipe T when the aperture hc is formed like a reverse V (see FIG. 42*c*).

The powder material dropped in the pneumatic transport pipe T is mixed with and dispersed in the positive pulsating vibration air supplied therein.

Then, the powder material dropped in the pneumatic transport pipe T is pneumatically transported to the end Tb of the pipe T to be sprayed therefrom together with the positive pulsating vibration air.

The vibration of the elastic membrane Etc, according to the powder material spray apparatus 211, is only defined by the positive pulsating vibration air supplied in the pneumatic transport pipe T. The amount of powder material supplied in the pipe T via the penetrating aperture hc is defined by the vibration of the elastic membrane Etc. Therefore, as long as the positive pulsating vibration air supplied in the pipe T is constant, a fixed amount of powder material is discharge in the pipe T.

Therefore, almost all of the powder material supplied via the penetrating aperture hc of the elastic membrane Etc into the pneumatic transport pipe T can be sprayed from the other end Tb thereof.

In the powder material spray apparatus 211, spray from the other end Tb of the pneumatic transport pipe T can be executed as long as the positive pulsating vibration air is supplied from the end Ta of the pipe T.

On the other hand, in order to increase the discharge amount of powder material in the pneumatic transport pipe T of the device for discharging a minute amount of powder 201, the size of the penetrating aperture hc of the elastic membrane may be enlarged or the plural numbers of penetrating apertures hc may be provided.

However, if the size of the penetrating aperture hc of the elastic membrane Etc is enlarged more than a fixed size, there is a problem that the aperture hc is opened larger than an expected area because of the resilience of the elastic membrane Etc so that the discharge amount of powder material of the device for discharging a minute amount of powder 201 is difficult to be controlled at a desirable amount.

Further, there arise problems such that the tensile strength of the elastic membrane Etc lacks uniformity because of the large penetrating aperture hc formed on the elastic membrane Etc and when a positive pulsating vibration air is supplied to the membrane Etc, the membrane Etc doesn't vibrate in response to the positive pulsating vibration air or the quantitativeness of the discharge amount of powder material from the device for discharging a minute amount of powder 201 is damaged.

Therefore, the size of the penetrating aperture hc on the elastic membrane Etc can't be completely defined depending on the component of discharged powder material, the tensile strength of the elastic membrane Etc being stretched and the size and the thickness of the elastic membrane Etc. However, the size of the penetrating aperture hc of the membrane Etc has its upper limit.

On the other hand, the inventors of the present invention have found that even if an elastic membrane having plural penetrating apertures hr . . . like the one EtcA as shown in FIG. 43 is attached to the device for discharging a minute amount of powder 201 and the device 201 is driven, the discharge amount of powder material in the pneumatic transport pipe T isn't increased at a rate of the number of the plural apertures hr . . . .

According to the elastic membrane EtcA having plural penetrating apertures hr at random as shown in FIG. 43, some parts of the elastic membrane EtcA have different tensile strengths so that the membrane Etca vibrates unevenly and its reproducibility and response to the positive pulsating vibration air become worse when a positive pulsating vibration air is supplied in the pneumatic transport pipe T. As a result, the inventors of the present invention have found that there has been a problem such that the quantitativeness of the powder material discharged in the pipe T is deteriorated.

Further according to the device for discharging a minute amount of powder material 201, the inventors have found that it is difficult to attach the elastic membrane Etc and EtcA to the discharge device 201 while being evenly stretched. Moreover, if the elastic membranes Etc and EtcA are successfully attached on the discharge device 201 while being uniformly expanded, the membranes Etc and EtcA get slack in time during a discharge operation of powder material in which the positive pulsating vibration air is supplied to vibrate the membranes Etc and EtcA and powder material is discharged from the penetrating aperture hs or the plural apertures hr . . . .

DISCLOSURE OF THE INVENTION

The present invention which has been proposed to solve the above-mentioned problems relates to a quantitative discharge apparatus having an elastic membrane with a penetrating aperture and a discharge method of powder material by means of an elastic membrane with a penetrating aperture. The object of the present invention is to provide a quantitative discharge apparatus and a discharge method of powder material wherein the discharge amount of powder material quantitatively varies while keeping a substantially positive relation depending on the number of penetrating apertures formed on an elastic membrane so that the discharge amount of powder from the quantitative discharge apparatus can be controlled and wherein the quantitativeness of discharge amount of powder material is superior.

Further, the object of the present invention is to provide a quantitative discharge apparatus and a discharge method wherein even if plural penetrating apertures are provided on the elastic membrane, the elastic membrane can be uniformly and evenly expanded at a fixed tensile strength in an easy and simple operation and wherein the elastic membrane doesn't get slack while the quantitative discharge apparatus is operated.

The quantitative discharge apparatus for powder material of the present invention comprises a tubular body for storing powder material and an elastic membrane having plural penetrating apertures, the membrane constituting a bottom of the tubular body. The elastic membrane is vibrated by applying a positive pulsating vibration air thereto in a manner that the vibration node appears at the periphery of the elastic membrane, and thereby powder material stored in the tubular body is discharged from the plural penetrating apertures of the elastic membrane.

In this specification the term "positive pressure" means a pressure which is higher than atmospheric pressure out of the quantitative discharge apparatus.

The term "pulsating vibration air" in this specification means an air flow which presents like a wave repeating a high pressure part and a lower pressure part alternately.

The term "positive pulsating vibration air" in this specification includes a positive pulsating vibration air in which its amplitude peak and valley are both positive and a positive pulsating vibration air in which its amplitude peak is positive pressure and its amplitude valley is atmospheric pressure.

The positive pulsating vibration air is supplied into the elastic membrane to make the membrane vibrate being its periphery as a node of vibration.

In this quantitative discharge apparatus, plural penetrating apertures are formed on the elastic membrane so that the discharge amount of powder material from the quantitative discharge apparatus can be increased at the ratio of the increased number of the apertures comparing with the elastic membrane with one penetrating aperture even if the conditions of the positive pulsating vibration air supplied into the elastic membrane aren't changed.

According to the quantitative discharge apparatus of the present invention, the plural penetrating apertures of the elastic membrane are formed in a point symmetrical manner with respect to a specific point on the elastic membrane.

The phrase "the plural penetrating apertures of the elastic membrane are formed in a point symmetrical manner with respect to a specific point on the elastic membrane" doesn't mean that the number of the penetrating apertures formed on the elastic membrane is limited to two. Namely, the phrase includes the case when more than two penetrating apertures exist.

It means that two penetrating apertures are paired among more than two apertures against a specific point when more than two penetrating apertures are observed against the point and two apertures are formed in a point symmetrical manner with respect to the specific point per each paired two penetrating apertures.

According to this quantitative discharge apparatus, the elastic membrane with plural penetrating apertures formed in a point symmetrical manner with respect to a specific point is used. When a positive pulsating vibration air is supplied into the elastic membrane to be vibrated with its periphery being a node of vibration, the discharge amount of powder material from the quantitative discharge apparatus can be increased comparing with the case when the elastic membrane having plural penetrating apertures with the same number and the same shape at random under the same condition of the positive pulsating vibration air.

According to the quantitative discharge apparatus of the present invention, the plural penetrating apertures of the elastic membrane are formed in an axial symmetrical manner with respect to a line passing on a specific point on the elastic membrane.

The phrase "the plural penetrating apertures of the elastic membrane are formed in an axial symmetrical manner with respect to a line passing on a specific point on the elastic membrane" doesn't mean that the number of the penetrating aperture formed on the elastic membrane is limited to two. Namely, the phrase includes the case when more than two penetrating apertures exist.

It means that when more than two penetrating apertures are observed against the line passing on the specific point, two apertures among them are formed in an axial symmetrical manner with respect to the line passing through the line.

There is one line passing on the specific point in case of two penetrating apertures and there are "n" lines in case of "n" ($n \geqq 3$) numbers of penetrating apertures.

According to this quantitative discharge apparatus, the elastic membrane with plural penetrating apertures formed in an axial symmetrical manner with respect to the line passing on the specific point is used. When a positive pulsating vibration air is supplied to vibrate the elastic membrane with its periphery being a node of vibration, the discharge amount of powder material from the quantitative discharge apparatus can be increased comparing with the case when the elastic membrane having plural penetrating apertures with the same number and the same shape at random under the same condition of the positive pulsating vibration air.

According to the quantitative discharge apparatus of the present invention, the plural penetrating apertures of the elastic membrane are formed on a circumference of a virtual circle, the center of which is the specific point on the elastic membrane.

The term "formed on a circumference of a virtual circle" may be on the same circumference of a virtual circle around a specific point or may be on the circumferences of different cocentric circles around different points.

According to this quantitative discharge apparatus, a virtual circle is drawn around a specific point on the elastic membrane and plural penetrating apertures are formed on its circumference. When each one of the plural penetrating apertures has the same size and shape, it shows the same behavior (the same deformation (expansion and contraction)) in case that a positive pulsating vibration air is supplied into the elastic membrane to be vibrated with its periphery being a vibration node.

As a result, if the positive pulsating vibration air supplied into the elastic membrane is constant and the penetrating apertures with the same size and shape are formed on the elastic membrane, the discharge amount of powder material from the quantitative discharge apparatus can be increased in a positive correlation to the number of the penetrating apertures on the elastic membrane.

According to the quantitative discharge apparatus of the present invention, the plural penetrating apertures of the elastic membrane are formed at even intervals on the circumference of a specific virtual circle.

If a virtual circle is drawn around a specific point on the elastic membrane and penetrating apertures with the same size and shape are partialized on an area, the elastic membrane isn't stretched uniformly and evenly because of the partialized apertures. Further, when the elastic membrane is vibrated by the positive pulsating vibration air, it shows irregular vibration.

Contrarily, in this quantitative discharge apparatus, a virtual circle is drawn around a specific point on the elastic membrane and plural penetrating apertures are formed at even intervals on the circumference of the virtual circle. If each one of plural penetrating apertures has the same size and shape, the elastic membrane can execute vibration with high reproducibility with its center being a vibration antinode and its periphery being a vibration node when the positive pulsating vibration air is supplied on the elastic membrane.

According to this quantitative discharge apparatus, comparing with the quantitative discharge apparatus using the elastic membrane on which plural penetrating apertures are partialized on an area, the discharge amount of powder material is quantitatively changed keeping a positive relation to the number of the penetrating apertures on the elastic membrane.

Namely, according to this quantitative discharge apparatus, the number of penetrating apertures are increased in such a manner that a virtual circle is drawn around a specific point on the elastic membrane and plural numbers of the apertures are formed at even intervals on the circumference of the virtual circle, thereby the discharge amount of powder material is quantitatively changed keeping a positive relation to the number of the penetrating apertures on the elastic membrane.

According to the quantitative discharge apparatus of the present invention, each one of the plural penetrating apertures of the elastic membrane is formed as a cut aperture.

If each penetrating aperture on the elastic membrane is formed as a cut aperture (slit) and the elastic membrane isn't curved up and down, the cut aperture (slit) is closed so that the powder material on the elastic membrane isn't discharged therethrough.

When the elastic membrane is curved upward by a positive pulsating vibration air, the cut aperture (slit) becomes V-shaped with its top open seen from its section except that the cut apertures (slit) are formed radial into periphery from a specific point being the center of the virtual circle when the virtual circle is drawn on the elastic membrane. The powder material on the elastic membrane is dropped in the V-shaped cut aperture (slit) with its top open.

When the elastic membrane returns to its original position (wherein it isn't curved up and down), the cut aperture (slit) also returns to its original closed position. At this time, the powder material dropped in the aperture (slit) when its top is opened like a letter V is kept being caught therein.

Further, when the elastic membrane is curved down by a pulsating vibration air, the cut aperture (slit) becomes a reverse V shape with its bottom open except that the apertures (slit) are formed radial into periphery from a specific point being the center of the virtual circle when the virtual circle is drawn on the elastic membrane. The powder material which has been dropped in the V-shaped aperture (slit) with its top open and been caught therein when the membrane is its original position (wherein it isn't curved up and down) is discharged under the elastic membrane.

The above-mentioned operations of the cut aperture (slit) formed on the elastic membrane are reproduced as long as the elastic membrane repeats the same vibration.

The up-and-down vibration of the elastic membrane only depends on the positive pulsating vibration air supplied into the elastic membrane. Namely, as long as the positive pulsating vibration air supplied onto the elastic membrane is constant, the membrane repeats the same vibration up and down, thereby reproducing the operation of the cut aperture (slit) as mentioned above.

Accordingly, as long as each one of the plural penetrating apertures formed on the elastic membrane of the quantitative discharge apparatus is a cut aperture (slit) and the positive pulsating vibration air supplied to the elastic membrane is constant, the discharge amount of powder material from the apertures (slit) formed on the membrane is designed to be constant, thereby achieving high quantitativeness of the discharge amount of powder material.

When each one of the plural penetrating apertures formed on the elastic membrane is a cut aperture (slit), the cutting direction of the apertures may be a tangential direction on the circumference of a virtual circle, may have an angle against the tangent on virtual circle or may be radial direction from a specific point used as the center of the virtual circle.

If each one of the plural penetrating apertures formed on the elastic membrane is arranged on the same circumference of a virtual circle, is a cut aperture (slit) and has the same cut length, when the positive pulsating vibration air is supplied on the elastic membrane to be vibrated and the powder material stored and accumulated on the elastic membrane is discharged from the cut apertures, the discharge amount of powder material from the cut apertures generally has the following relation: the discharge amount from the cut apertures (slit) which are formed on a tangent of a virtual circle around a specific point on the elastic membrane>the discharge amount from the cut apertures (slit) which are formed on a line with a specific angle against the tangent of a virtual circle around a specific point on the elastic membrane>the discharge amount from the cut apertures (slit) which are formed in a radial direction from a specific point used as a center of a virtual circle.

Therefore, the discharge amount of powder material in the quantitative discharge apparatus can be controlled by means of the cut apertures formed on the elastic membrane such that the number, the length and the arranging direction of the cut apertures (slit) are varied without changing the supply conditions of the positive pulsating vibration air supplied in the quantitative discharge apparatus.

According to the quantitative discharge apparatus of the present invention, a cutting direction of the cut aperture on the elastic membrane is a tangential direction of the circumference of a specific virtual circle.

When a positive pulsating vibration air is supplied onto the elastic membrane to be vibrated being its periphery as a vibration node and being its center as a vibration antinode, if the cutting direction of the cut apertures (slit) is a tangential direction of the circumference on which plural apertures are formed, the elastic membrane is curved upward by the positive pulsating vibration air so that the aperture (slit) is V-shaped with its top open and it is curved downward by the air so that the aperture (slit) becomes reverse V-shape with its bottom open.

According to this quantitative discharge apparatus, the cutting direction of the apertures (slit) is a tangential direction of the circumference on which plural apertures are formed and the elastic membrane repeats the cycle at high reproducibility wherein each plural aperture is opened like a letter V and is closed like a reverse letter V when the elastic membrane is vibrated by the positive pulsating vibration air supplied thereto. Therefore, a large amount of powder material can be quantitatively discharged through the cut apertures (slit) comparing with the quantitative discharge apparatus using the elastic membrane on which the apertures with the same shape, the same size and the same number are formed in radial direction from the virtual circle to its periphery.

According to the quantitative discharge apparatus of the present invention, a penetrating aperture is further provided on a specific point on the elastic membrane.

The penetrating aperture may be an aperture which is always opened or a cut aperture (slit). Considering the quantitativeness of powder material discharged from the quantitative discharge apparatus, it may be a cut aperture (slit).

In such a discharge apparatus, the penetrating aperture is provided at a specific point which is a center of a virtual circle on the elastic membrane, thereby further enabling to increase the discharge amount of powder material while keeping a positive relation.

According to the quantitative discharge apparatus of the present invention, the discharge amount of powder material in the quantitative discharge apparatus is adjustable at a desired value depending on the number of the plural penetrating apertures formed on the elastic membrane. A predetermined number of penetrating apertures are at first formed on a tangent of the circumference of a specific virtual circle on the elastic membrane, the tangent including the contact point with the circumference. Then a predetermined number of penetrating apertures are next formed on a line with a specific angle across the tangent of the circumference of a specific virtual circle on the elastic membrane, the line including the contact point with the circumference.

Here the term "a predetermined number" of "a predetermined number of penetrating apertures" formed on a tangent of the virtual circle means more than one. Further, "a predetermined number" of "a predetermined number of penetrating apertures" provided on a line with a specific angle across the tangent of the virtual circle means more than one. The virtual circle on which a predetermined number of penetrating apertures are formed on a line with a specific angle across the tangent of the circle may be the same as a virtual circle on which a predetermined number of penetrating apertures are formed on its tangent or may be on the circumference of a different cocentric circle.

If each one of the plural penetrating apertures formed on the elastic membrane is arranged on the same circumference of a virtual circle, is a cut aperture (slit) and has the same cut length, when the positive pulsating vibration air is supplied on the elastic membrane to be vibrated and the powder material stored and accumulated on the elastic membrane is discharged from the cut apertures, the discharge amount of powder material from the cut apertures generally has the following relation: the discharge amount from the cut apertures (slit) which are formed on a tangent of a virtual circle around a specific point on the elastic membrane>the discharge amount from the cut apertures (slit) which are formed on a line with a specific angle across the tangent of the virtual circle around a specific point on the elastic membrane.

According to this quantitative discharge apparatus, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit))

being formed on the tangent of a virtual circle drawn around a specific point. Thereafter, penetrating apertures (cut aperture (slit)) are formed on the circumference of the virtual circle drawn around a specific point so as to have an angle against the tangent of the circle so that the discharge amount of powder material is controlled to be an objective amount. As a result, the amount of powder material discharged from the quantitative discharge apparatus can be accurately controlled to be an objective amount.

According to the quantitative discharge apparatus of the present invention, a predetermined number of penetrating apertures on the elastic membrane are formed on the circumference of the virtual circle around the specific point on the elastic membrane in a radial direction from the specific point of the virtual circle.

The term "a predetermined number" of "a predetermined number of penetrating apertures" formed on the circumference of the virtual circle in radial direction from the center of the virtual circle means more than one. The virtual circle on which a predetermined number of penetrating apertures are formed so as to have an angle against the tangent of the circle means that the virtual circle may be the same as the virtual circle on which a predetermined number of penetrating apertures are formed on a tangent of the circle or may be on a different cocentric circle.

If each one of the plural penetrating apertures formed on the elastic membrane is arranged on the same circumference of a virtual circle, is a cut aperture (slit) and has the same cut length, when the positive pulsating vibration air is supplied on the elastic membrane to be vibrated and the powder material stored and accumulated on the elastic membrane is discharged from the cut penetration apertures, the discharge amount of powder material from the cut apertures becomes a minimum when the cutting direction of the cut aperture (slit) is radial from the center of the virtual circle on the elastic membrane.

According to this quantitative discharge apparatus, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) being formed on the tangent of the virtual circle drawn around a specific point. Thereafter, penetrating apertures (cut aperture (slit)) are formed on the circumference of the virtual circle drawn around a specific point so as to have an angle against the tangent of the circle so that the discharge amount of powder material is controlled to be an objective amount. Further, cut apertures (slit) are formed on the circumference of the virtual circle in radial from the center of the virtual circle on the elastic membrane, thereby the discharge amount of powder material is further minutely controlled to the objective amount. As a result, the amount of powder material discharged from the quantitative discharge apparatus can be more accurately controlled to be an objective amount.

According to the quantitative discharge apparatus of the present invention, the specific point on the elastic membrane accords with the center of the outline shape of the elastic membrane.

When the periphery of the elastic membrane is fixed and a positive pulsating vibration air is supplied to such an elastic membrane, the elastic membrane vibrates by the positive pulsating vibration air generally in such a manner that the periphery of the membrane becomes a node of vibration and the center thereof becomes an antinode of vibration.

In this case, when a virtual circle is drawn around the center of the outline shape of the elastic membrane, the elastic membrane executes substantially similar deformation (expansion and contraction) on the virtual circle according to the positive pulsating vibration air.

Therefore, if a virtual circle is drawn around the center of the outline shape of the elastic membrane and plural penetrating apertures with the same size and shape are formed on the virtual circle, each one of plural penetrating apertures provided on the elastic membrane executes the same deformation (expansion and contraction) by the vibration of the elastic membrane, namely by the positive pulsating vibration air, thereby the same amount of powder material can be discharged from each one of the penetrating apertures.

Namely, according to this quantitative discharge apparatus, the center of the dimensional virtual circle drawn on the elastic membrane agrees with the center of the elastic membrane which is the center of the antinode of vibration when the membrane is vibrated by the positive pulsating vibration air and plural penetrating apertures are formed on thus drawn virtual circle, thereby the apertures represent substantially the same behavior.

As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, the specific point on the elastic membrane accords with a center of gravity of the elastic membrane.

When a positive pulsating vibration air is supplied to vibrate the elastic membrane with the periphery fixed, the elastic membrane vibrates in such a manner that the center of gravity of the membrane becomes an antinode and the periphery thereof becomes a node of vibration.

In this case, the center of gravity may accords with the center of the outline shape of the elastic membrane or they may be different.

When the elastic membrane with the periphery fixed is vibrated by the positive pulsating vibration air such that the center of gravity of the membrane becomes an antinode and the periphery thereof becomes a node of vibration, if a virtual circle is drawn around the center of gravity of the elastic membrane, the elastic membrane performs substantially the same deformation (expansion and contraction) on the virtual circumference according to the positive pulsating vibration air.

Therefore, if a virtual circle is drawn around the center of gravity of the elastic membrane and plural penetrating apertures with the same size and shape are formed on the virtual circle, each one of plural penetrating apertures provided on the elastic membrane executes the same deformation (expansion and contraction) by the vibration of the elastic membrane, namely by the positive pulsating vibration air, thereby the same amount of powder material can be discharged from each one of the penetrating aperture.

Namely, according to this quantitative discharge apparatus, the center of the virtual circle drawn on the elastic membrane agrees with the center of gravity thereof which is the center of the antinode of vibration when the membrane is vibrated by the positive pulsating vibration air and plural penetrating apertures are formed on thus drawn virtual circle, thereby the apertures represent substantially the same behavior.

As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, the specific point on the elastic membrane accords with a center of the node of vibration which appears on the elastic membrane when the positive pulsating vibration air is supplied into the elastic membrane.

In case that the elastic membrane has uneven thickness, its attaching condition and stretching condition aren't uniform, or there are other causes, the membrane sometimes vibrates in such a manner that the area other than the center of the outline shape of the membrane or the center of gravity of the membrane becomes an antinode of vibration when a positive pulsating vibration air is supplied to the elastic membrane with its periphery fixed.

In this case, after attaching the elastic membrane with one penetrating apertures on the dimensional center or the gravity center of the membrane, how the membrane vibrates is examined by supplying a positive pulsating vibration air on the membrane. Then, a virtual circle is drawn around the antinode of vibration when the elastic membrane is vibrated and plural penetrating apertures are formed on the virtual circle.

When a positive pulsating vibration air is supplied to vibrate the elastic membrane with the periphery fixed, if a virtual circle is drawn around the center of the vibration on the membrane, the elastic membrane executes substantially the same deformation (expansion and contraction) by the positive pulsating vibration air on the virtual circle.

Namely, according to this quantitative discharge apparatus, the virtual circle is drawn around the center of antinode of vibration on the elastic membrane, the antinode being made by the positive pulsating vibration air supplied on the elastic membrane, and plural penetrating apertures are formed on thus drawn virtual circle, thereby the apertures represent substantially the same behavior.

As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, the positive pulsating vibration air is supplied from below the elastic membrane.

For supplying the positive pulsating vibration air under the elastic membrane, the lower part of the quantitative discharge apparatus under the elastic membrane is connected to a midstream of a pneumatic transport pipe and the positive pulsating vibration air for pneumatic transportation is supplied from one end of the pipe, therefore, the elastic membrane of the quantitative discharge apparatus connected in a midstream of the pipe is vibrated. Constructing such that, the elastic membrane can be vibrated in synch with the positive pulsating vibration air for pneumatic transportation which runs through the pneumatic transport pipe.

The powder material discharged from the plural penetrating apertures formed on the elastic membrane is pneumatically transported by the positive pulsating vibration air in the pneumatic transport pipe and is sprayed from the other end of the pipe together with the positive pulsating vibration air.

On the other hand, powder material is pneumatically transported by a steady flow air in the pneumatic transport pipe, accumulation or pinhole phenomena of powder material are caused in the pipe and there arises a problem such that the material stays in the pipe. However, in case of supplying a positive pulsating vibration air, the accumulation or pinhole phenomena isn't caused in the pipe.

Therefore, when a positive pulsating vibration air is supplied in the pneumatic transport pipe, almost all of the powder material discharged from the penetrating apertures on the elastic membrane can be sprayed from the other end of the pipe.

Namely, this quantitative discharge apparatus is constructed in a manner that a positive pulsating vibration air is supplied under the elastic membrane so that a powder material spray apparatus with high quantitativeness which accurately sprays powder material with a desirable concentration at a desired place can be easily composed by utilizing a positive pulsating vibration air supplied for vibrating the elastic membrane as a pneumatic transport means of the powder material discharged from the plural penetrating apertures of the elastic membrane.

According to the quantitative discharge apparatus of the present invention, the positive pulsating vibration air is supplied from above the powder material stored in the tubular body.

When the positive pulsating vibration air is supplied into the powder materials stored in the tubular body from the top thereof, the elastic membrane is formed like a cone area of the tubular body because of the weight of the powder material stored in the tubular body and the positive pressure of the pulsating vibration air, thereby the same construction as hopper can be obtained by the tubular body and the elastic membrane.

Herewith, almost all of the powder material stored in the tubular body can be discharged from the plural penetrating apertures of the elastic membrane.

There has been a problem that the discharge amount of powder material from the material discharge port is varied because of the caked material which has been caused on the cone part of a conventional hopper. However, in this quantitative discharge apparatus, the cone part of the elastic membrane formed by the powder material stored in the tubular body and by the positive pulsating vibration air supplied therein is vibrated by the positive pulsating vibration air, therefore caking of powder material isn't generated on the elastic membrane.

Namely, the quantitative discharge apparatus is constructed such that the positive pulsating vibration air is supplied from above the powder material stored in the tubular body so that caking of powder material doesn't occur on the cone like a conventional hopper. Therefore such a quantitative discharge apparatus is superior in quantitativeness of the discharge material from the plural penetrating apertures.

According to the quantitative discharge apparatus of the present invention, the elastic membrane is attached to the lower portion of the tubular body with by means of an elastic membrane installation means. The elastic membrane installation means comprises a pedestal with an opening at its center, a push-up member with an opening at its center, which is disposed in the standing status on the pedestal and a presser member with an opening at its center, the opening being a little larger than the periphery size of the push up member. The pedestal has on its surface an annular V-groove so formed as to surround the opening of the pedestal outside of the periphery of the push-up member and outside of the opening of the pedestal, whereas the presser member has on its surface facing the pedestal an annular V-shape projection portion so formed as to engage into the annular V-groove on the surface of the pedestal. The push-up member is disposed on the surface of the pedestal, on which the elastic membrane is disposed, and further the presser member is so tightly secured as to cover the push-up member together with the elastic membrane to the pedestal, whereby the elastic membrane is expanded from its inner side to its outer side by being pushed up toward the presser member by means of the push-up member, while the periphery part of the elastic membrane is held between the periphery part of the push-up member and the surface forming an opening of the presser member and further expanded to be held between the annular V-groove formed on the surface of the pedestal and the annular V-shape projection portion formed on the surface facing the pedestal, and wherein the presser member is secured to the lower portion of the tubular body.

According to this quantitative discharge apparatus, the elastic membrane with plural penetrating apertures is attached to the lower part of the tubular body by means of the elastic membrane installation means. The elastic membrane is placed on the push-up member placed on the pedestal and the presser member is tightened to the pedestal, thereby the membrane is pushed into the presser member by the push-up member. As a result, the elastic membrane is expanded from its inner side to its outer side when being pushed into the direction of the presser member.

At first, the elastic membrane expanded by the push-up member is gradually inserted between the V-groove formed on the pedestal and the V-shaped projection formed on the surface of the presser member facing the pedestal via the space between the periphery of the push-up member and the surface (inner surface) forming the opening of the presser member.

Furthermore, as the presser member is fastened to the pedestal, the elastic membrane comes to be held between the periphery of the push-up member and the inner surface of opening of the presser member while being pushed up into the presser member by the push-up member. When the elastic membrane is further pushed up into the presser member by the push-up member, the expanded part of the elastic membrane from inside to outside is held between the V-groove of the pedestal and the V-shaped projection on the surface of the presser member 64 facing the pedestal.

As mentioned above, according to this quantitative discharge apparatus, the elastic membrane can be uniformly stretched by a simple operation such that the elastic membrane is placed on the push-up member on the pedestal and the presser member is tightened to the pedestal.

According to the quantitative discharge apparatus of the present invention, an inclined plane is formed on the periphery of the push-up member, the inclined plane having a bottom part broader than its top part when seen in section.

The inclined plane which is enlarged from top to bottom is provided for the periphery of the push-up member of the elastic membrane installation means of the quantitative discharge apparatus. Therefore, the expanded part of the elastic membrane from inside to outside by being pushed up into the presser member is easily moved between the V-groove annularly formed on the pedestal and the V-shaped projection annularly formed on the surface of the presser member facing the pedestal.

When the presser member is fastened to the pedestal, the distance between the inclined plane of the periphery of the push-up member and the inner circumference of opening of the presser member becomes small, and the elastic membrane is tightly held between the inclined plane of the push-up member and the inner circumference of opening of the presser member, preventing the elastic membrane from being slack.

Thus, the elastic membrane doesn't get slack during usage so that the quantitative discharge apparatus can keep its accurate operation for a long time.

The quantitative discharge apparatus is constructed such that the inclined plane is formed on the periphery of the push-up member when seen sectionally. For attaching the elastic membrane on the elastic membrane installation means, the elastic membrane can be kept evenly and uniformly expanded by a simple operation such that the elastic membrane is placed on the push-up member on the pedestal and the presser member is tightened to the pedestal. Further, the elastic membrane of the quantitative discharge apparatus doesn't get slack during operation, thereby the quantitative discharge apparatus capable of keeping accurate operation for a long time can be achieved.

Discharge methods for powder material are defined for each above-mentioned quantitative discharge apparatus are defined.

The method of discharging powder material comprising the steps of storing powder material in a tubular body to which an elastic membrane with plural penetrating apertures is attached so that it constitutes a bottom of the tubular body, vibrating the elastic membrane by applying positive pulsating vibration air thereto so as to make the elastic membrane vibrate in a manner that the vibration node appears at its periphery, and thereby discharging the powder material stored in the tubular body from the plural apertures.

According to this discharge method for powder material, the elastic membrane is vibrated by applying the positive pulsating vibration air being its periphery as a node of vibration. Because the vibration of the elastic membrane depends on the positive pulsating vibration air, the elastic membrane repeats a constant vibration depending on the positive pulsating vibration air if a constant positive pulsating vibration air is supplied.

The discharge amount of powder material per time from the plural penetrating apertures on the elastic membrane also depends on vibration of the elastic membrane. If the vibration pattern of the elastic membrane is the same, constant amount of material can be always discharged.

Therefore, applying this discharge method of powder material, when a constant positive pulsating vibration air is used, the discharge amount of powder material per time from the plural penetrating apertures of the elastic membrane can be always constant. Thereby, quantitative discharge of a minute amount of powder material which has been considered to be difficult in a prior art can be accomplished.

In this discharge method of powder material, because plural penetrating apertures are formed on the elastic membrane, the discharge amount of powder material from the quantitative discharge apparatus can be increased in a ratio of the increased number of the penetrating apertures comparing with the elastic membrane having one penetrating aperture unless the conditions of the positive pulsating vibration air are changed.

According to the method of discharging powder material of the present invention, the plural penetrating apertures of the elastic membrane are formed in a point symmetrical manner with respect to a specific point on the elastic membrane.

According to this method of discharging powder material, the elastic membrane with plural penetrating apertures formed in a point symmetrical manner with respect to a specific point is used. When a positive pulsating vibration air is supplied into the elastic membrane to be vibrated with its periphery being a node of vibration, the discharge amount of powder material from the quantitative discharge apparatus can be increased comparing with the case when the elastic membrane having plural penetrating apertures with the same number and the same shape formed at random is used under the same condition of the positive pulsating vibration air.

According to the method of discharging powder material of the present invention, the plural penetrating apertures of the elastic membrane are formed in an axial symmetrical manner with respect to a line passing on a specific point on the elastic membrane.

According to this method of discharging powder material, the elastic membrane with plural penetrating apertures formed in an axial symmetrical manner with respect to the line passing on the specific point is used. When a positive pulsating vibration air is supplied into the elastic membrane to be vibrated with its periphery being a node of vibration, the discharge amount of powder material from the quantitative discharge apparatus can be increased comparing with the case when the elastic membrane having plural penetrating apertures with the same number and the same shape formed at random is used under the same condition of the positive pulsating vibration air.

According to the method of discharging powder material of the present invention, the plural penetrating apertures of the elastic membrane are formed on a circumference of a specific virtual circle, the center of which is the specific point on the elastic membrane.

According to this method of discharging powder material, a virtual circle is drawn around the specific point on the elastic membrane and plural penetrating apertures are formed on its circumference. When each one of the plural penetrating apertures has the same size and shape, it shows the same behavior (the same deformation (expansion and contraction)) in case that a pulsating vibration air is supplied to vibrate the elastic membrane with its periphery being a vibration node.

As a result, if the positive pulsating vibration air supplied into the elastic membrane is constant and the penetrating apertures with the same size and shape are formed on the elastic membrane, the discharge amount of powder material from the quantitative discharge apparatus can be increased in a positive correlation to the number of the penetrating apertures on the elastic membrane.

According to the method of discharging powder material of the present invention, the plural penetrating apertures of the elastic membrane are formed at even intervals on the circumference of a specific virtual circle.

In this quantitative discharge apparatus, a virtual circle is drawn around a specific point on the elastic membrane and plural penetrating apertures are formed on the virtual circle at even intervals. If each one of plural penetrating apertures has the same size and shape, the elastic membrane can execute vibration with high reproducibility with its center being a vibration antinode and its periphery being a vibration node when the positive pulsating vibration air is supplied on the elastic membrane.

According to this discharge method for powder material, comparing with the discharge method using the elastic membrane on which plural penetrating apertures are partialized on an area, the discharge amount of powder material is quantitatively changed keeping a positive relation to the number of the penetrating apertures on the elastic membrane.

Namely, according to this discharge method for powder material, the number of penetrating apertures are increased in such a manner that a virtual circle is drawn around a specific point on the elastic membrane and plural numbers of the apertures are formed at even intervals on the virtual circle, thereby the discharge amount of powder material is quantitatively changed keeping a positive relation to the number of the penetrating apertures on the elastic membrane.

According to the method of discharging powder material of the present invention, each one of the plural penetrating apertures of the elastic membrane is formed as a cut aperture.

In the method of discharging powder material, because the plural penetrating apertures on the elastic membrane are formed cut aperture (slit), as long as the positive pulsating vibration air supplied into the elastic membrane is constant, the discharge amount of powder material from the apertures (slit) formed on the membrane is designed to be constant, thereby quantitative discharge of powder material can be achieved.

According to the method of discharging powder material of the present invention, a cutting direction of the cut aperture on the elastic membrane is a tangential direction of the circumference of a specific virtual circle.

In this quantitative discharge apparatus, the cutting direction of the cut apertures (slit) is a tangential direction of the circumference of the circle on which plural apertures are formed and the elastic membrane repeats the cycle at high reproducibility wherein each plural aperture is opened like a letter V, then is closed, and again is opened like a reverse V-shape while being vibrated by the positive pulsating vibration air supplied thereto.

As a result, applying this discharge method for powder material, a large amount of powder material on the elastic membrane can be quantitatively discharged through the cut apertures (slit) comparing with the discharge method wherein the elastic membrane is formed with plural cut apertures (slit) which are the same shape, size and number and of which cutting direction is in radial from a virtual circle to its periphery and wherein the positive pulsating vibration air having the same conditions as the present invention is used.

According to the method of discharging powder material of the present invention, a penetrating aperture is further provided on a specific point on the elastic membrane.

In this method, the discharge amount of powder material is increased keeping a positive relation at a ratio of providing a further penetrating aperture at the center of the virtual circle on the elastic membrane.

According to the method of discharging powder material of the present invention, the discharge amount of powder material is adjustable at a desired value depending on the number of the plural penetrating apertures formed on the elastic membrane. A predetermined number of penetrating apertures are at first formed on a tangent of the circumference of a specific virtual circle on the elastic membrane, the tangent including the contact point with the circumference. A predetermined number of penetrating apertures are next formed on a line with a specific angle across the tangent of the circumference of a specific virtual circle on the elastic membrane, the line including the contact point with the circumference.

In this discharge method, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) by providing the apertures on the tangent of a virtual circle drawn around a specific point. Thereafter, penetrating apertures (cut aperture (slit)) are further formed on the virtual circle drawn around a specific point so as to have an angle against the tangent of the circle so that the discharge amount of powder material is controlled to be an objective amount. As a result, the amount of powder material discharged from the quantitative discharge apparatus can be accurately controlled to be an objective amount.

According to the method of discharging powder material of the present invention, a predetermined number of penetrating apertures on the elastic membrane are formed on the circumference of the virtual circle around the specific point on the elastic membrane in a radial direction from the specific point of the virtual circle.

In this discharge method, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) by providing the apertures on the tangent of the virtual circle drawn around a specific point. Thereafter, penetrating apertures (cut aperture (slit)) are further formed on the circumference of the virtual circle drawn around a specific point so as to have an angle against the tangent of the circle so that the discharge amount of powder material is controlled to be an objective amount. Further, cut apertures (slit) are formed on the circumference of the virtual circle in radial from the specific point of the virtual circle on the elastic membrane, thereby the discharge amount of powder material is minutely controlled to the objective amount. As a result, the amount of powder material discharged from the quantitative discharge apparatus can be more accurately controlled to be an objective amount.

According to the method of discharging powder material of the present invention, the specific point on the elastic membrane accords with the center of the outline shape of the elastic membrane.

In this discharge method, the center of the virtual circle drawn on the elastic membrane agrees with the center of the of the elastic membrane which is the center of the antinode of vibration when the membrane is vibrated by the positive pulsating vibration air and plural penetrating apertures are formed on thus drawn virtual circle, thereby the apertures represent substantially the same behavior.

As the result, applying this discharge method for powder material, when the positive pulsating vibration air supplied to the elastic membrane is constant, the discharge amount of powder material can be quantitatively varied while the discharge amount keeps an almost positive relation to the number of the penetrating apertures formed on the membrane.

According to the method of discharging powder material in the present invention, the specific point on the elastic membrane accords with the center of gravity of the elastic membrane.

In this discharge method, the center of the virtual circle drawn on the elastic membrane agrees with the center of gravity of the elastic membrane which is the center of the antinode of vibration when the membrane is vibrated by the positive pulsating vibration air and plural penetrating apertures are formed on thus drawn virtual circle, thereby the apertures represent substantially the same behavior.

As the result, according to this method of discharging powder material, when the positive pulsating vibration air supplied to the elastic membrane is constant, the discharge amount of powder material can be quantitatively varied while the discharge amount keeps an almost positive relation to the number of the penetrating apertures formed on the membrane.

According to the method of discharging powder material of the present invention, the specific point on the elastic membrane accords with the center of the node of vibration which appears on the elastic membrane when the positive pulsating vibration air is supplied into the elastic membrane.

In this discharge method, the virtual circle is drawn around the center of antinode of vibration on the elastic membrane, the antinode being made by the positive pulsating vibration air supplied on the elastic membrane, and plural penetrating apertures are formed on thus drawn virtual circle, thereby the apertures represent substantially the same behavior.

As the result, applying this discharge method, when the positive pulsating vibration air supplied to the elastic membrane is constant, the discharge amount can be quantitatively varied while the discharge amount keeps an almost positive relation to the number of the penetrating apertures formed on the membrane.

According to the method of discharging powder material of the present invention, the positive pulsating vibration air is supplied from below the elastic membrane.

This discharge method applies the construction such that a positive pulsating vibration air is supplied under the elastic membrane so that a powder material spray apparatus with high quantitativeness which accurately sprays powder material with a desirable concentration at a desired place can be easily composed by utilizing a positive pulsating vibration air supplied for vibrating the elastic membrane as a pneumatic transport means of the powder material discharged from the plural penetrating apertures of the elastic membrane.

According to the method of discharging powder material of the present invention, the positive pulsating vibration air is supplied from above the powder material stored in the tubular body.

This discharge apparatus is constructed such that the positive pulsating vibration air is supplied from above the powder material stored in the tubular body so that caking of powder material doesn't occur on the cone like a conventional hopper.

As a result, such a discharge method is superior in quantitativeness of discharge material from the plural penetrating apertures.

According to the method of discharging powder material of the present invention, the elastic membrane is attached to the lower portion of the tubular body with by means of an elastic membrane installation means. The elastic membrane installation means comprises a pedestal with an opening at its center, a push-up member with an opening at its center, which is disposed in the standing status on the pedestal and a presser member with an opening at its center, the opening being a little larger than the periphery size of the push-up member. The pedestal has on its surface an annular V-groove so formed as to surround the opening of the pedestal outside of the periphery of the push-up member and outside of the opening of the pedestal, whereas the presser member has on its surface facing the pedestal an annular V-shape projection portion so formed as to engage into the annular V-groove on the surface of the pedestal. The push-up member is disposed on the surface of the pedestal, on which the elastic membrane is disposed, and further the presser member is so tightly secured as to cover the push-up member together with the elastic membrane to the pedestal, whereby the elastic membrane is expanded from its inner side to its outer side by being pushed up toward the presser member by means of the push-up member, while the periphery part of the elastic membrane is held between the periphery part of the push-up member and the surface forming an opening of the presser member and further expanded to be held between the annular V-groove formed on the surface of the pedestal and the annular V-shape projection portion formed on the surface facing the pedestal, and wherein the presser member is secured to the lower portion of the tubular body.

In this discharge method, the elastic membrane with plural penetrating apertures is attached to the lower part of the tubular body by means of the elastic membrane installation means. The elastic membrane is placed on the push-up member placed on the pedestal and the presser member is tightened to the pedestal, thereby the membrane is pushed into the presser member by the push-up member. As a result, the elastic membrane is expanded from its inner side to its outer side by being pushed into the direction of the presser member.

At first, the elastic membrane expanded by the push-up member is gradually inserted between the V-groove formed on the pedestal and the V-shaped projection formed on the surface of the presser member facing the pedestal via the space between the periphery of the push-up member and the surface (inner surface) forming opening of the presser member.

Furthermore, as the presser member is fastened to the pedestal, the elastic membrane comes to be held between the periphery of the push-up member and the inner surface of opening of the presser member while being pushed up into the presser member by the push-up member. When the elastic membrane is further pushed up into the presser member by the push-up member, the expanded part of the elastic membrane from inside to outside is held between the V-groove of the pedestal and the V-shaped projection on the surface of the presser member facing the pedestal.

As mentioned above, according to this discharge method, the elastic membrane can be uniformly stretched by a simple operation such that the elastic membrane is placed on the push-up member on the pedestal and the presser member is tightened to the pedestal.

According to the method of discharging powder material of the present invention, an inclined plane is formed on the periphery of the push-up member, the inclined plane having a bottom part broader than its top part when seen in section.

The elastic membrane installation means used for this discharge method has the inclined plane which is enlarged from top to bottom at the periphery of the push-up member of the elastic membrane installation means of the quantitative discharge apparatus. Therefore, the expanded part of the elastic membrane from inside to outside by being pushed up into the presser member is easily moved between the V-groove annularly formed on the pedestal and the V-shaped projection annularly formed on the surface of the presser member facing the pedestal.

When the presser member is fastened to the pedestal, the distance between the inclined plane of the periphery of the push-up member and the inner circumference of opening of the presser member becomes small, and the elastic membrane is tightly held between the inclined plane of the push-up member and the inner circumference of opening of the presser member, preventing the elastic membrane from being slack.

Thus, applying this method for discharging powder material, the elastic membrane doesn't get slack during usage so that the quantitative discharge apparatus can keep its accurate operation for a long time.

This discharge method applies the construction such that the inclined plane is formed on the periphery of the push-up member when seen sectionally. For attaching the elastic membrane on the elastic membrane installation means, the elastic membrane can be kept evenly and uniformly expanded by a simple operation such that the elastic membrane is placed on the push-up member on the pedestal and the presser member is tightened to the pedestal. Further, the elastic membrane doesn't get slack during operation according to this method, thereby the quantitative discharge apparatus capable of keeping accurate operation for a long timecan be achieved.

BRIEF DESCRIPTION OF DRAWINGS

FIG. 1 diagrammatically shows an elastic membrane used for a quantitative discharge apparatus of the present invention.

FIG. 4 is a diagrammatic view of other embodiment of an elastic membrane used for a quantitative discharge apparatus of the present invention.

FIG. 5 is a diagrammatic view of other embodiment of an elastic membrane used for a quantitative discharge apparatus of the present invention.

FIG. 6 is a diagrammatic view of other embodiment of an elastic membrane used for a quantitative discharge apparatus of the present invention.

FIG. 7 is a diagrammatic view of other embodiment of an elastic membrane used for a quantitative discharge apparatus of the present invention.

FIG. 8 is a diagrammatic view of other embodiment of an elastic membrane used for a quantitative discharge apparatus of the present invention.

FIG. 9 is a diagrammatic view of other embodiment of an elastic membrane used for a quantitative discharge apparatus of the present invention.

FIG. 10 is a diagrammatic view of other embodiment of an elastic membrane used for a quantitative discharge apparatus of the present invention.

FIG. 11 is a diagrammatic view of other embodiment of an elastic membrane used for a quantitative discharge apparatus of the present invention.

FIG. 12 is a diagrammatic view of other embodiment of an elastic membrane used for a quantitative discharge apparatus of the present invention.

FIG. 13 is a diagrammatic view of other embodiment of an elastic membrane used for a quantitative discharge apparatus of the present invention.

FIG. 14 is a diagrammatic view of other embodiment of an elastic membrane used for a quantitative discharge apparatus of the present invention.

FIG. 15 is a diagrammatic view of other embodiment of an elastic membrane used for a quantitative discharge apparatus of the present invention.

FIG. 16 is a diagrammatic view of other embodiment of an elastic membrane used for a quantitative discharge apparatus of the present invention.

FIG. 18 diagrammatically shows a hopper body of the quantitative discharge apparatus shown in FIG. 17.

FIG. 22 is a plan diagram showing a position of a pulsating vibration air supply port provided for a dispersion chamber when the dispersion chamber of a quantitative discharge apparatus of the present invention is seen from top.

FIG. 23 is a plan diagram showing a position of a pulsating vibration air supply port and its discharge port provided for a dispersion chamber when the dispersion chamber of a quantitative discharge apparatus of the present invention is seen from top.

FIG. 34 diagrammatically shows other embodiment of a quantitative discharge apparatus of the present invention.

BEST MODE FOR CARRYING OUT THE INVENTION

Now, preferable embodiments of the present invention will be detailed.

(Embodiment of the Invention 1)

In an embodiment of the invention 1, a quantitative discharge apparatus in which a positive pulsating vibration air is supplied under an elastic membrane provided in the discharge apparatus.

Figure 1A:
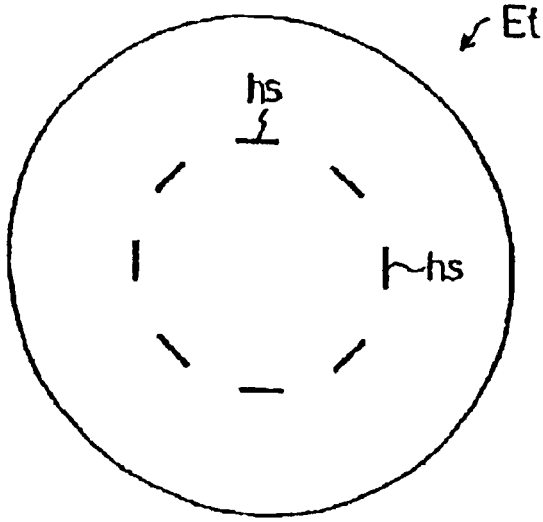
FIG. 1*a* is a plan view diagrammatically showing the elastic membrane for a quantitative discharge apparatus of the present invention and FIG. 1*b* is an explanatory view showing an arrangement rule of plural penetrating apertures formed on the elastic membrane.
Figure 1B:
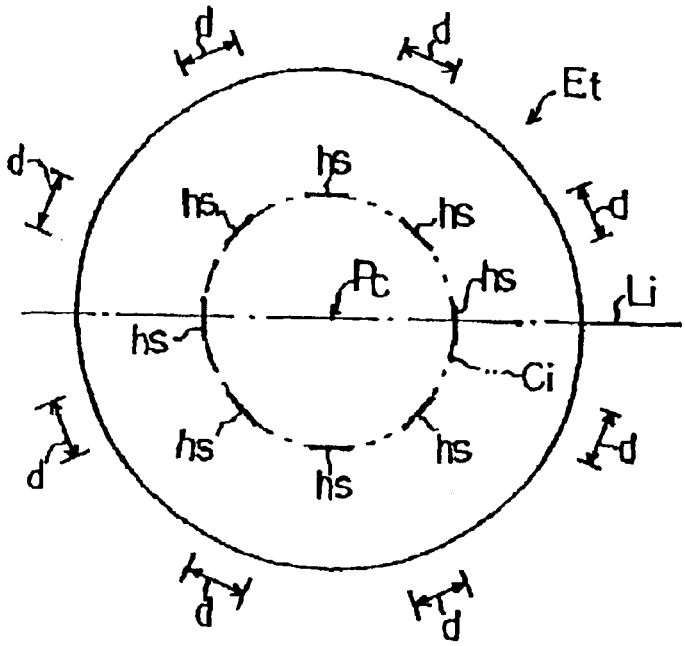

FIG. 1 diagrammatically shows an elastic membrane used for a quantitative discharge apparatus of the present invention, FIG. 1*a* is a plan view diagrammatically showing the elastic membrane for a quantitative discharge apparatus of the present invention and FIG. 1*b* is an explanatory view showing an arrangement rule of plural penetrating apertures formed on the elastic membrane.

The elastic membrane Et is made of an elastic material such as a silicone rubber and has a uniform thickness.

The elastic membrane Et is provided at the lower part of a tubular body such as a hopper (not shown) so as to form a bottom thereof.

Plural penetrating apertures hs . . . are formed on the elastic membrane Et.

The above-mentioned construction is the same as the conventional elastic membrane EtcA, however, the plural penetrating apertures hs . . . aren't formed on the elastic membrane Et at random. A virtual circle (a circle Ci shown with an imaginary line in FIG. 1*b*) is drawn around a specific point Pc (a dimensional center of the elastic membrane Et in this embodiment) and the plural penetrating apertures hs . . . are formed on its circumference.

In this embodiment, each one of plural penetrating apertures hs . . . is a cut aperture (slit) with the same length and the same shape.

Further each one of the apertures hs . . . are provided on the circumference of the virtual circle (a circle Ci shown with an imaginary line in FIG. 1*b*) at even intervals d.

Furthermore, each one of the apertures hs . . . are formed in a point symmetrical manner with respect to a specific point on the elastic membrane Pc (a dimensional center of the elastic membrane Et in this embodiment).

Each one of the apertures hs . . . are also formed in a point symmetrical manner with respect to a line (refer to a center line Li shown with an imaginary line in FIG. 1*b*) passing on the specific point Pc (a dimensional center of the elastic membrane Et in this embodiment) on the elastic membrane Et.

Still further, each one of the apertures hs . . . is substantially formed on a tangent of the virtual circle (see a circle Ci shown with an imaginary line in FIG. 1*b*).

Figure 2:
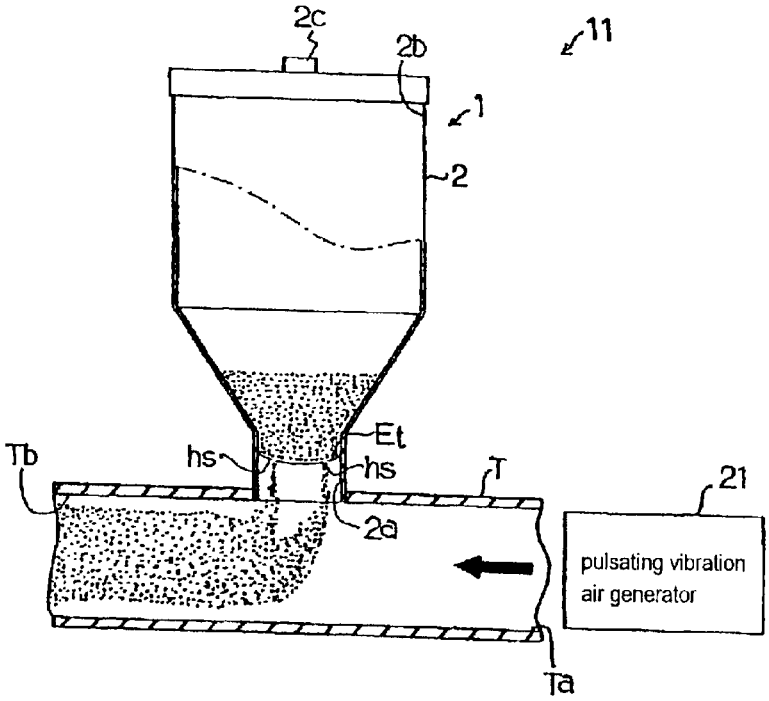
FIG. 2 is a diagrammatic construction view of a powder material spray apparatus having a quantitative discharge apparatus with an elastic membrane.

FIG. 2 is a diagrammatic construction view of a powder material spray apparatus having a quantitative discharge apparatus with an elastic membrane.

Figure 39:
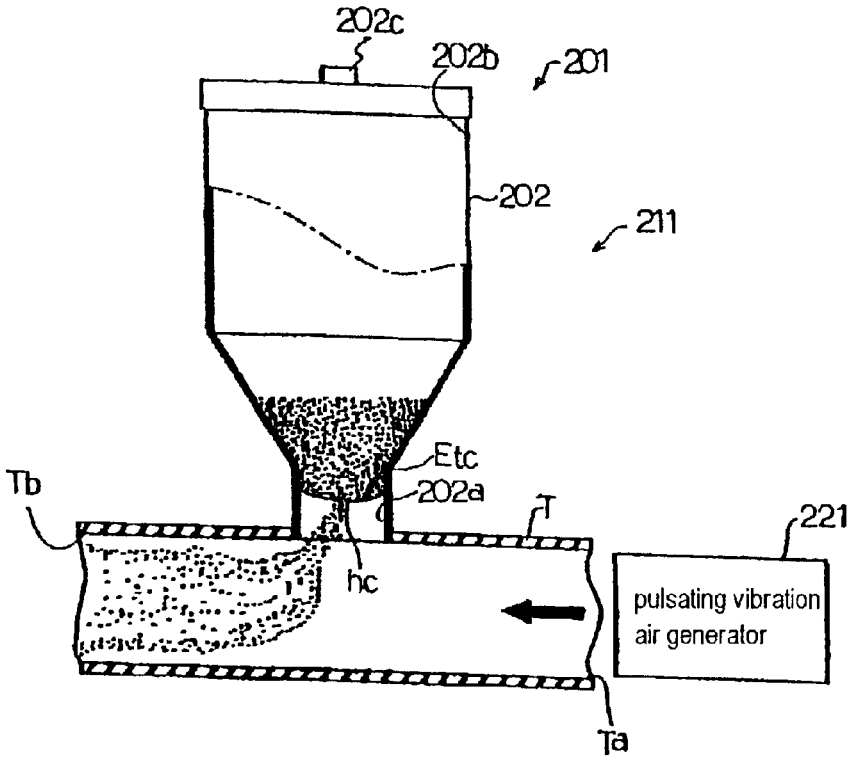
FIG. 39 is a constructional view showing a powder material spray apparatus using a conventional discharge apparatus for a minute amount of powder.
Figure 40:
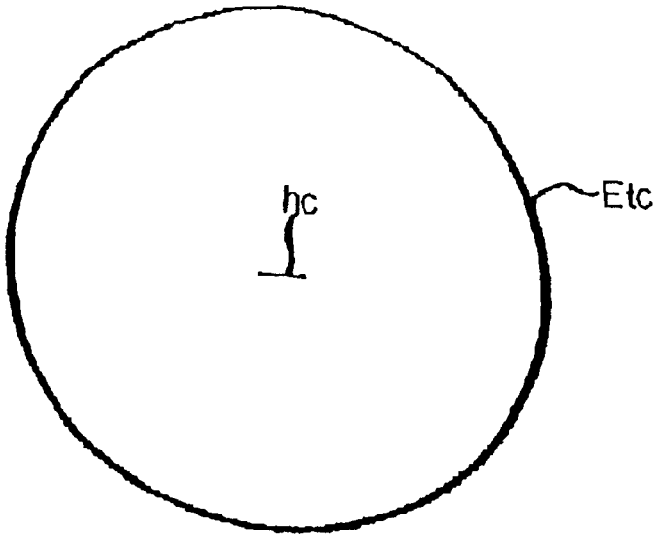
FIG. 40 is a plan view diagrammatically showing an elastic membrane used for a conventional discharge apparatus for a minute amount of powder.

The powder material spray apparatus 11 has the same construction as the powder material spray apparatus 211 shown in FIG. 39 except that the elastic membrane Et is used instead of the elastic membrane Etc.

The quantitative discharge apparatus 1 comprises a tubular body 2 for storing powder material (powder material storage hopper), the elastic membrane Et provided so as to form a bottom of the tubular body 2 (powder material storage hopper) at a discharge port 2*a* of the tubular body 2 and a pneumatic transport pipe T.

A cover 2*c* is detachably and airtightly provided for a material feed port 2*b* of the tubular body 2 (material storage hopper).

The powder material spray apparatus 11 is constructed such that the material discharge port 2*a* of the material storage hopper 2 of the quantitative discharge apparatus 1 is connected to the pneumatic transport T interposed by the elastic membrane Et.

One end Ta of the pneumatic transport pipe T is connected to a positive pulsating vibration air generation means 21 so that a positive pulsating vibration air generated by driving the positive pulsating vibration air generation means 21 is supplied from the end Ta into the pneumatic transport pipe T.

Next operations of the powder material spray apparatus 1 and the powder material spray apparatus 11 will be explained.

For spraying a fixed amount of powder material from the other end Tb of the pneumatic transport pipe T by means of the powder material spray apparatus 1, powder material is stored in the tubular body 2 (powder material storage hopper). Then the cover 2*c* is airtightly attached on the material feed port 2*b* of the tubular body 2 (powder material storage hopper).

Driving the positive pulsating vibration air generation means 21, a positive pulsating vibration air is supplied into the pneumatic transport pipe T.

Figure 41A:
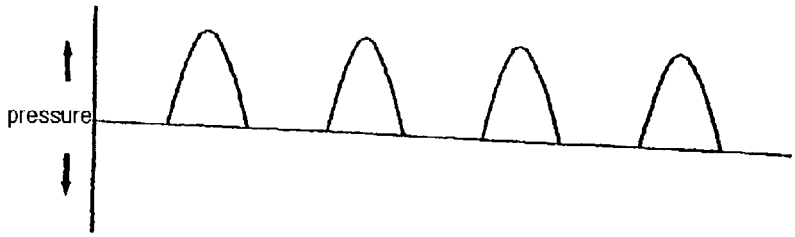
FIG. 41*a* and FIG. 41*b* are an explanatory view explaining a positive pulsating vibration air, respectively.
Figure 41B:
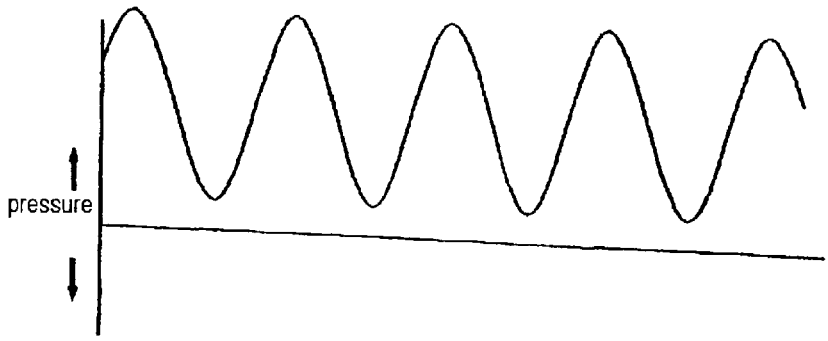

As a positive pulsating vibration air, the pulsating vibration air of which the amplitude peak is higher than atmospheric pressure and of which the amplitude valley is substantially at atmospheric pressure shown in FIG. 41*a* or the pulsating vibration air of which the amplitude peak and valley are higher than atmospheric pressure may be used.

In the powder material discharge apparatus 1, when a positive pulsating vibration air is supplied in the pneumatic transport pipe T, the pressure in the pipe T becomes high at the amplitude peak of the pulsating vibration air, the elastic membrane Et is elastically deformed to be curved upward in such a manner that its dimensional center Pc becomes the center of vibration antinode and its periphery becomes the node of vibration.

In this powder material discharge apparatus 1, the elastic membrane Et has plural penetrating apertures hs . . . which are cut apertures (slit) and have the same length and the same shape, the apertures hs . . . are substantially formed on a tangent of the virtual circle (see a circle Ci shown with an imaginary line in FIG. 1*b*) drawn around the specific point of the elastic membrane (a dimensional center of the elastic membrane Et in this embodiment).

Therefore, when the amplitude of the positive pulsating vibration air supplied in the pneumatic transport pipe T becomes its peak, the pressure in the pipe T is increased and the elastic membrane Et is elastically deformed with its dimensional center curved upwardly, each penetrating aperture hs . . . becomes V-shaped with its top opened when seen sectionally.

This time, if a virtual circle (see a circle Ci shown with an imaginary line in FIG. 1*b*) is drawn around the specific point of the elastic membrane Et (a dimensional center of the elastic membrane Et in this embodiment), the elastic membrane Et shows the same deformation on the circumference of the virtual circle according to the positive pulsating vibration air.

Accordingly, each penetrating aperture like a letter V (see penetrating apertures hs and hs shown in FIG. 3*a*) has the same shape.

Figure 3A:
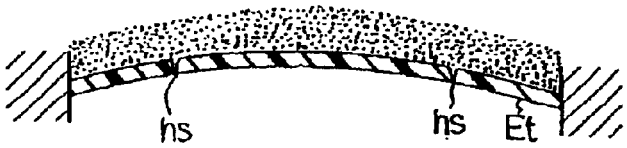
FIG. 3 is an explanatory view diagrammatically showing operations of an elastic membrane of a quantitative discharge apparatus of the present invention.

Hence, substantially the same amount of powder material stored in the tubular body 2 (powder material storage hopper) is dropped in the V-shaped penetrating apertures (see penetrating apertures hs and hs shown in FIG. 3*a*) having the same shape like a letter V (see FIG. 3*a*).

Figure 3B:
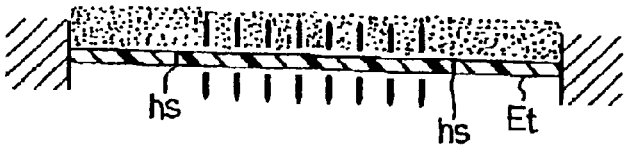

Next, as the positive pulsating vibration air supplied in the pneumatic transport pipe T goes on its amplitude valley and the pressure in the pipe T is gradually decreased, the elastic membrane Et returns to its original shape from the shape in which the specific point (a dimensional center Pc of the elastic membrane Et in this embodiment) is curved upwardly because of its resilience. The penetrating apertures (see penetrating apertures hs and hs shown in FIG. 3*b*) also return their original shape from the V-shape with its top open. The powder material dropped in each penetrating aperture (see penetrating apertures hs and hs shown in FIG. 3*b*) when the apertures are opened like a letter V is caught in therein (see FIG. 3*b*).

When the positive pulsating vibration air supplied in the transport pipe T becomes its amplitude valley and the pressure in the pneumatic transport pipe T is reduced, the elastic membrane Et is elastically deformed with the specific point (a dimensional center of the elastic membrane Et in this embodiment) curved downwardly. This time the penetrating apertures (see penetrating apertures hs and hs shown in FIG. 3*c*) are formed like a reverse V with its bottom open when seen sectionally (see FIG. 3*c*).

This time, if a virtual circle (see a circle Ci shown with an imaginary line in FIG. 1*b*) is drawn around the specific point of the elastic membrane Et (a dimensional center of the elastic membrane Et in this embodiment), the elastic membrane Et shows the same deformation on the circumference of the virtual circle according to the positive pulsating vibration air.

Accordingly, each penetrating apertures like a reverse letter V (see penetrating apertures hs and hs shown in FIG. 3*c*) has the same shape.

Figure 3C:
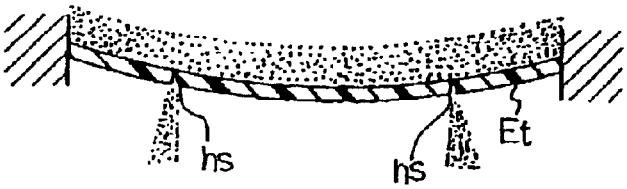

Hence, the powder material, which has been dropped in the penetrating apertures (see penetrating apertures hs and hs shown in FIG. 3*a*) while being V-shaped with the same shape, and then caught therein when the elastic membrane Et returns its original position from the shape with the specific point (a dimensional center of the elastic membrane Et in this embodiment) curved upwardly, is dropped in the pneumatic transport pipe T from each one of reverse V-shaped penetrating apertures (see penetrating apertures hs and hs shown in FIG. 3*c*) (see FIG. 3*c*).

Thus, the elastic membrane is provided so as to be the bottom of the tubular body for storing powder material 2 (powder material storage hopper) and the penetrating apertures are formed on the same circumference around the specific point Pc of the elastic membrane Et (a dimensional center of the elastic membrane Et in this embodiment), thereby each one of the penetrating apertures hs . . . shows substantially the same deformation depending on the positive pulsating vibration air.

Therefore, if this quantitative discharge means uses an elastic membrane in which a virtual circle (a circle Ci shown with an imaginary line in FIG. 1) is drawn around the specific point on the elastic membrane Et (a dimensional center of the elastic membrane Et in this embodiment) and plural penetrating apertures with the same size and the same shape are provided on the circumference of the circle Ci, the discharge amount of powder material is increased while keeping a positive relation when an elastic membrane with larger number of penetrating apertures is used without changing the supply amount of positive pulsating vibration air supplied onto the elastic membrane Et.

Further according to this quantitative discharge apparatus 1, a virtual circle is drawn around a specific point Pc on the elastic membrane Et (a dimensional center of the elastic membrane Et in this embodiment) and the penetrating apertures with the same size and the same shape are formed on the circumference of the virtual circle in a point symmetrical manner with respect to the specific point (a dimensional center of the elastic membrane Et in this embodiment). Thus designed elastic membrane is used so that each penetrating aperture provided in symmetric with respect to a point achieves the same deformation (expansion and contraction) and substantially the same amount of powder material can be discharged from each one of penetrating aperture hs . . . .

Thus, the discharge amount of powder material of this quantitative discharge apparatus 1 is increased keeping a positive relation depending on the number of the penetrating apertures formed on the elastic membrane without changing the supply amount of positive pulsating vibration air.

In this quantitative discharge apparatus 1, a virtual circle (see a circle Ci shown with an imaginary line in FIG. 1) is drawn around a specific point Pc on the elastic membrane Et (a dimensional center of the elastic membrane Et in this embodiment) and the penetrating apertures hs . . . with the same size and the same shape are formed on the circumference of the virtual circle around the point Pc (a dimensional center of the elastic membrane Et in this embodiment) on the elastic membrane at even intervals. Therefore, when the positive pulsating vibration air is supplied onto the elastic membrane Et of this quantitative discharge apparatus 1, the elastic membrane Et reproducibly repeats vibration in such a manner that the specific point Pc on the membrane Et (a dimensional center of the elastic membrane Et in this embodiment) is the antinode center of vibration and the periphery of the membrane Et is the node of vibration. As a result, the quantitative discharge apparatus 1 can quantitatively change the discharge amount of powder material keeping a substantial positive relation depending on the number of penetrating apertures hs . . . formed on the elastic membrane without changing the supply amount of positive pulsating vibration air supplied on the membrane Et.

Namely, this quantitative discharge apparatus 1 applies the elastic membrane Et in which a virtual circle (see a circle Ci shown with an imaginary line in FIG. 1) is drawn around a specific point on the elastic membrane Et (a dimensional center of the elastic membrane Et in this embodiment) and plural penetrating apertures with the same size and the same shape are formed on the circumference of the virtual circle, thereby the discharge amount of powder material is quantitatively increased keeping a positive relation when the elastic membrane Et with larger number of the penetrating apertures is used.

Further according to this quantitative discharge apparatus 1, a virtual circle is drawn around a specific point Pc on the elastic membrane Et (a dimensional center of the elastic membrane Et in this embodiment) and the penetrating apertures with the same size and the same shape are formed on the circumference of the virtual circle in an axial symmetrical manner with respect to the line passing on the specific point (a dimensional center of the elastic membrane Et in this embodiment) on the elastic membrane.

Thus, each penetrating aperture achieves the same deformation (expansion and contraction) depending on the positive pulsating vibration air and substantially the same amount of powder material can be discharged from each one of penetrating aperture hs . . . .

Thus, the discharge amount of powder material of this quantitative discharge apparatus 1 is varied keeping a positive relation to the number of the penetrating apertures hs . . . formed on the elastic membrane Et without changing the supply amount of positive pulsating vibration air.

The powder material dropped in the pneumatic transport pipe T is mixed with and dispersed in the positive pulsating vibration air supplied in the pipe T.

Then the powder material thus dropped in the pipe T is pneumatically transported to the other end Tb of the pipe T by the positive pulsating vibration air to be sprayed therefrom together with the positive pulsating vibration air.

As long as the positive pulsating vibration air is supplied from the end Ta of the pneumatic transport pipe T, powder material can be sprayed from the other end Tb of the pipe T.

The vibration of the elastic membrane Et of the powder material spray apparatus 11 defined only by the positive pulsating vibration air supplied in the pneumatic transport pipe T. Also, the amount of powder material supplied via the penetrating apertures hs into the transport pipe T is only defined by the vibration of the elastic membrane Et. Therefore, as long as the positive pulsating vibration air supplied in the pneumatic transport pipe is constant, a fixed amount of powder material is discharged in the transport pipe T.

Thereby, almost all of the powder material discharged via the penetrating apertures hs . . . of the elastic membrane Et in the transport pipe T is sprayed from the other end Tb of the pipe T.

Here, a preferable embodiment is explained referring to the elastic membrane Et wherein a virtual circle is drawn around a specific point Pc on the elastic membrane Et (a dimensional center of the elastic membrane Et in this embodiment) and the penetrating apertures with the same size and the same shape are formed on the circumference of the virtual circle at even intervals in symmetric with respect to a point or a line on the elastic membrane. However, the present invention isn't limited to the above-mentioned elastic membrane Et used for the quantitative discharge apparatus 1 and the powder material spray apparatus 11 incorporating the quantitative discharge apparatus 1 and several kinds of elastic membrane can be used following the rules mentioned below as far as the elastic membrane Et has plural penetrating apertures.

Figure 4A:
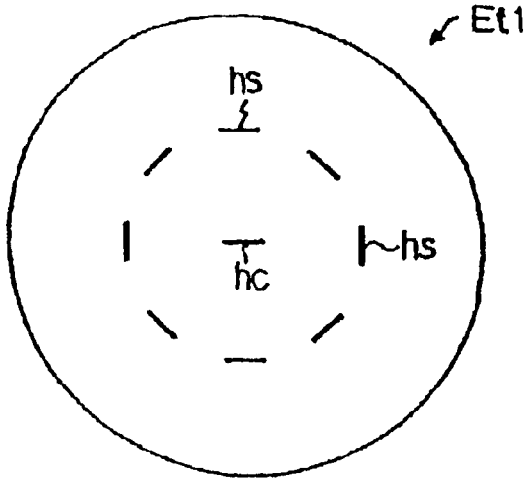
FIG. 4*a* is a plan view diagrammatically showing the elastic membrane for a quantitative discharge apparatus of the present invention and FIG. 4*b* is an explanatory view showing an arrangement rule of plural penetrating apertures formed on the elastic membrane.
Figure 4B:
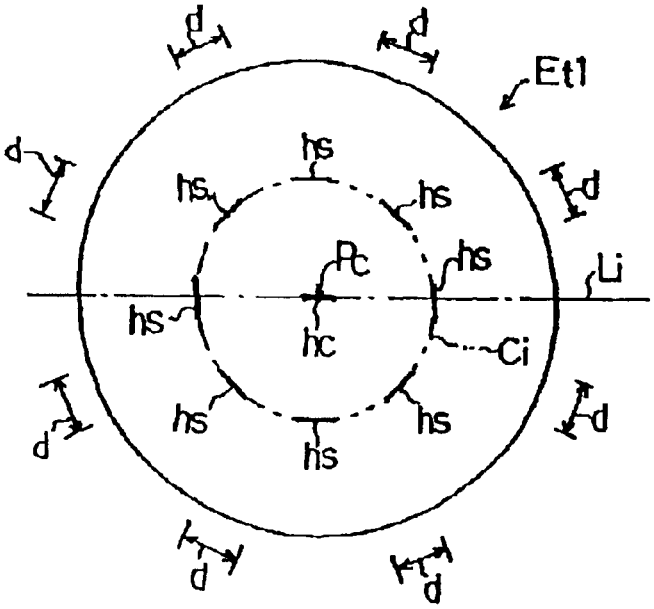

An elastic membrane Et1 as shown in FIG. 4 may be used as such an elastic membrane.

The elastic membrane Et1 further has a penetrating aperture hc at a specific point Pc (dimensional center of the elastic membrane Et in this embodiment) in addition to the construction of elastic membrane Et1 shown in FIG. 1.

According to this elastic membrane Et1, if the supply amount of positive pulsating vibration air is constant, the discharge amount of powder material is increased keeping a positive relation in the ratio of the penetrating aperture hc provided on the specific point Pc of the elastic membrane Et1 (dimensional center of the elastic membrane Et in this embodiment) comparing with the elastic membrane Et shown in FIG. 1.

Figure 5A:
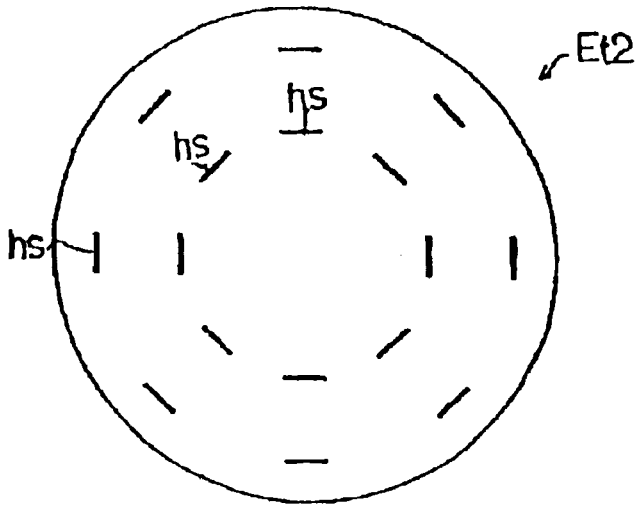
FIG. 5*a* is a plan view diagrammatically showing the elastic membrane for a quantitative discharge apparatus of the present invention and FIG. 5*b* is an explanatory view showing an arrangement rule of plural penetrating apertures formed on the elastic membrane.
Figure 5B:
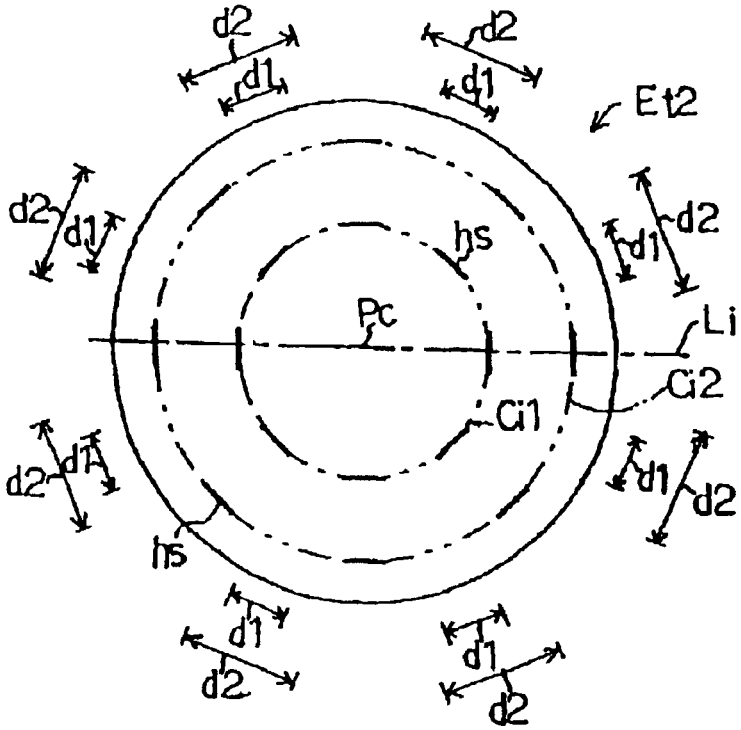

An elastic membrane Et2 in FIG. 5 can be preferably used as an elastic membrane of the quantitative discharge apparatus 1 and the powder material spray apparatus 11 incorporating the apparatus 1.

Plural concentric virtual circles (see circles Ci and Ci2 shown with an imaginary line in FIG. 5*b*) are drawn around a specific point Pc on the membrane Et2 (a dimensional center of the elastic membrane Et2 in this embodiment) and plural penetrating apertures hs . . . are formed on each circumference of the concentric virtual circles.

On the elastic membrane Et2 in FIG. 5, each one of penetrating aperture hs . . . on the circumference of the virtual circle Ci1 is formed with the same space d1 and each one of penetrating aperture hs . . . on the circumference of the virtual circle Ci2 is formed with the same space d2.

Figure 6A:
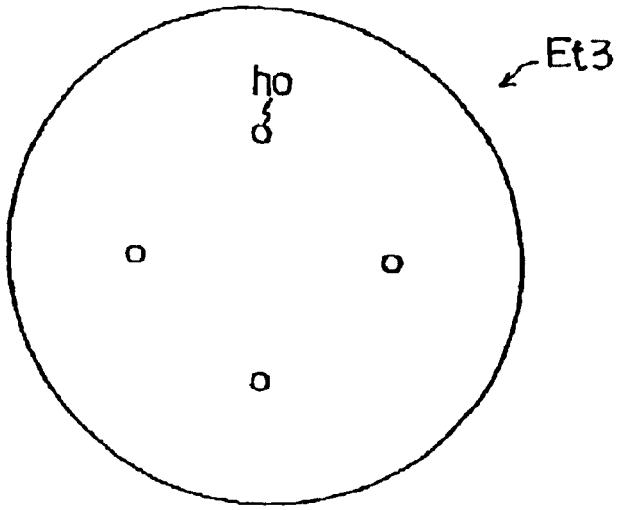
FIG. 6*a* is a plan view diagrammatically showing the elastic membrane for a quantitative discharge apparatus of the present invention and FIG. 6*b* is an explanatory view showing an arrangement rule of plural penetrating apertures formed on the elastic membrane.
Figure 6B:
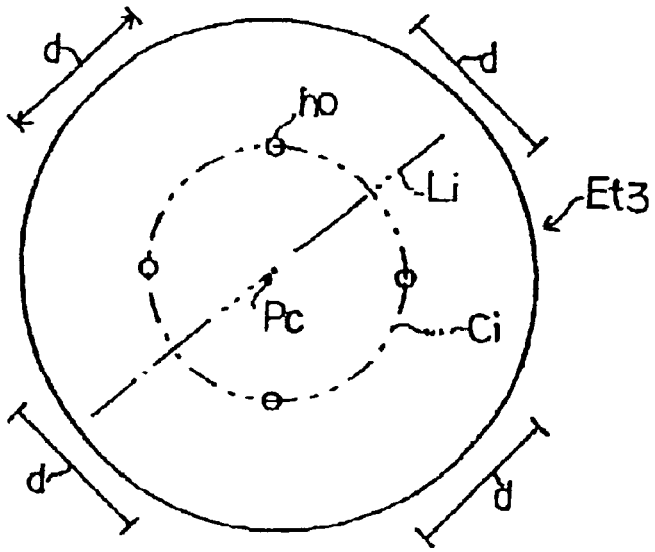

An elastic membrane Et3 as shown in FIG. 6 may be preferably used as an elastic membrane for the quantitative discharge apparatus 1 and the powder material spray apparatus 11 incorporating the apparatus 1.

Plural penetrating apertures ho . . . which are the same shape and the same size and are always opened are formed on the circumference of a virtual circles (see circles Ci shown with an imaginary line in FIG. 6*b*) drawn around a specific point Pc on the membrane Et3 (a dimensional center of the elastic membrane Et2 in this embodiment).

Each one of plural penetrating apertures on the elastic membrane is preferably a cut apertures (slit) in order to require a highly accurate quantitativeness of the discharge amount of powder from the quantitative discharge apparatus 1 or the spray amount of powder material from the powder material spray apparatus 11 incorporating the discharge apparatus 1. However, open penetrating apertures ho . . . like the elastic membrane Et3 as shown in FIG. 6 may be used.

Each one of the plural penetrating apertures ho . . . on the elastic membrane Et3 is provided in a point symmetrical manner with respect the specific point Pc (dimensional center of the elastic membrane Et3 in this embodiment) and further in an axial symmetrical manner with respect to a line (a straight line Li shown with a imaginary line in FIG. 6*b*) passing on the specific point Pc (dimensional center of the elastic membrane Et3 in this embodiment).

Figure 7A:
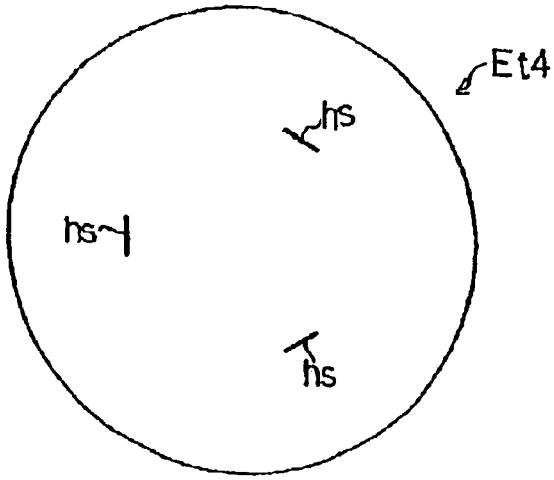
FIG. 7*a* is a plan view diagrammatically showing the elastic membrane for a quantitative discharge apparatus of the present invention and FIG. 7*b* is an explanatory view showing an arrangement rule of plural penetrating apertures formed on the elastic membrane.
Figure 7B:
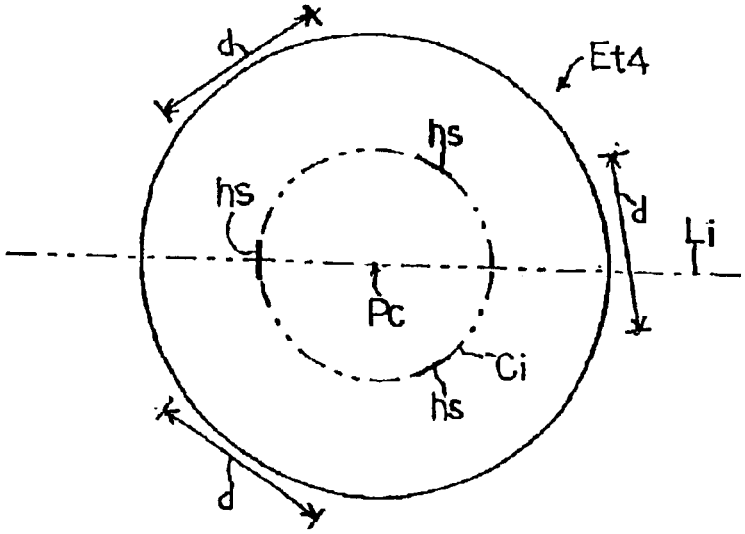

An elastic membrane Et4 shown in FIG. 7 may be preferably used as an elastic membrane of the quantitative discharge apparatus 1 and the powder material spray apparatus 11 incorporating the apparatus 1.

Plural virtual circles (see a circle Ci shown with an imaginary line in FIG. 7*b*) around a specific point Pc on the membrane Et4 (a dimensional center of the elastic membrane Et4 in this embodiment) and plural penetrating apertures hs . . . are formed on the circumference of the virtual circle.

The number of the penetrating apertures hs on the elastic membrane may be an odd number like the elastic membrane Et4.

Each one of the plural penetrating apertures hs . . . is a cut aperture (slit) with the same size and is formed at even interval d.

The cutting direction of each cut apertures hs . . . is a tangential direction of the circumference of the plural virtual circles (see a circle Ci shown with an imaginary line in FIG. 7*b*) around the specific point Pc on the membrane Et4 (a dimensional center of the elastic membrane Et4 in this embodiment).

Figure 8A:
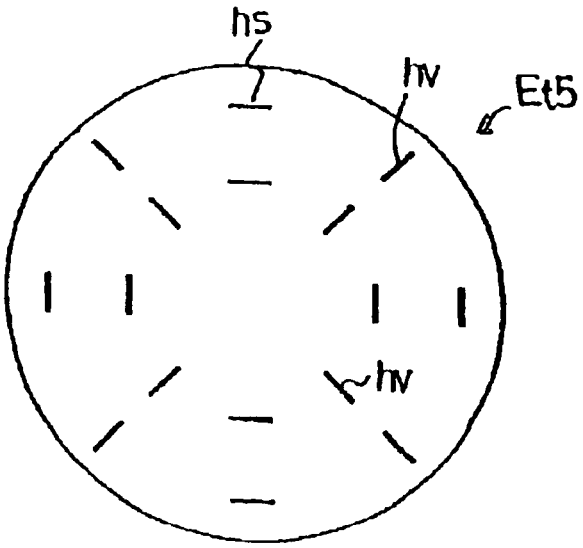
FIG. 8*a* is a plan view diagrammatically showing the elastic membrane for a quantitative discharge apparatus of the present invention and FIG. 8*b* is an explanatory view showing an arrangement rule of plural penetrating apertures formed on the elastic membrane.

An elastic membrane Et5 as shown in FIG. 8 may be preferably used as an elastic membrane of the quantitative discharge apparatus 1 and the powder material spray apparatus 11 incorporating the apparatus 1.

Plural concentric virtual circles (see circles Ci1 and Ci2 shown with an imaginary line in FIG. 8*b*) around a specific point Pc on the membrane Et5 (a dimensional center of the elastic membrane Et5 in this embodiment) and plural penetrating apertures hs . . . and hv . . . are formed on each circumference of each virtual circle.

More specifically, each one of plural penetrating apertures hs . . . and hv . . . is a cut aperture (slit).

The cutting direction of each cut apertures hs . . . is a tangential direction of the plural concentric virtual circles (see circles Ci1 and Ci2 shown with an imaginary line in FIG. 8*b*) around the specific point Pc on the membrane Et5 (a dimensional center of the elastic membrane Et5 in this embodiment).

The cutting direction of each penetrating apertures hv . . . is a radial direction from the specific point Pc on the membrane Et5 (a dimensional center of the elastic membrane Et5 in this embodiment).

The penetrating aperture hs and the penetrating aperture hv are alternately formed on each circumference of the virtual circles Ci1 and Ci2.

More specifically, the penetrating aperture hs and the penetrating aperture hv are formed on the circumference of the virtual circle Ci1 at even intervals d3.

The penetrating apertures hs are formed on the circumference of the virtual circle Ci1 at even intervals d4.

The penetrating apertures hv are formed on the circumference of the virtual circle Ci1 at even intervals d5.

The penetrating aperture hs and the penetrating aperture hv are formed on the circumference of the virtual circle Ci2 at even intervals d6.

The penetrating apertures hs are formed on the circumference of the virtual circle Ci2 at even intervals d7.

The penetrating apertures hv are formed on the circumference of the virtual circle Ci2 at even intervals d8.

Further in this embodiment, each one of penetrating apertures hs . . . has the same length.

Each one of penetrating apertures hs . . . also has the same length.

As mentioned above, the discharge amount of powder material from each one of the penetrating apertures hs . . . of the elastic membrane Et5 is almost the same and the discharge amount of powder material from each one of the penetrating apertures hs . . . of the elastic membrane Et5 is also almost the same.

When the penetrating apertures are cut apertures (slit) and its cutting direction of each penetrating apertures formed on the circumference of the virtual circle around the specific point Pc on the elastic membrane Et5 (a dimensional center of the elastic membrane Et5 in this embodiment) is a radial direction from the specific point Pc to the periphery of the membrane Et5 (a dimensional center of the elastic membrane Et5 in this embodiment) like the penetrating apertures hv, the expansion and contraction of the cut apertures (slit) aren't so large when the elastic membrane is vibrated by applying a positive pulsating vibration air comparing with the penetrating apertures hs of which cutting direction is tangential from the virtual circle around the specific point Pc on the elastic membrane Et5 (a dimensional center of the elastic membrane Et5 in this embodiment).

Figure 8B:
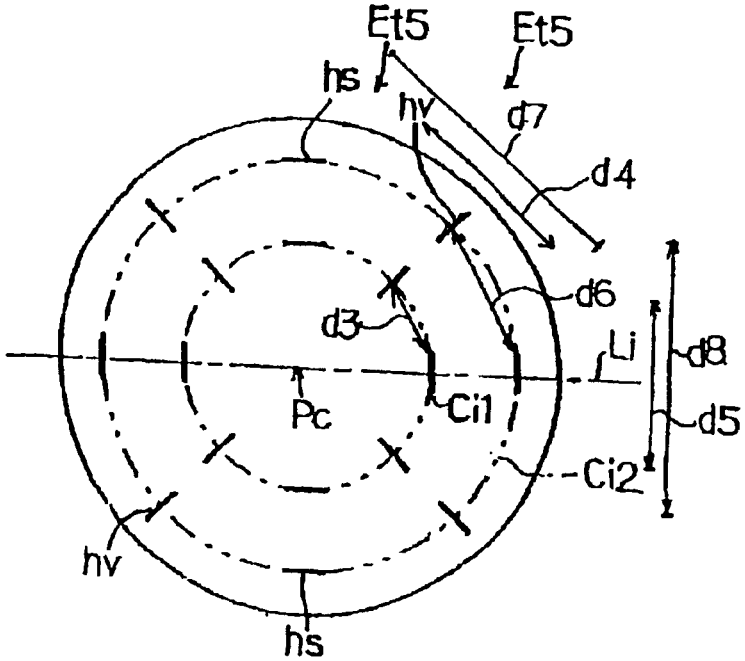

However, if plural penetrating apertures are formed on the elastic membrane, the cut apertures (slit) hv . . . which are formed on the circumference of a circle (see virtual circles Ci1 and Ci2 shown with an imaginary line in FIG. 8*b*) around the specific point Pc on the membrane Et5 (a dimensional center of the elastic membrane Et5 in this embodiment) and of which cutting direction is radial from the specific point Pc to the periphery of the elastic membrane Et5 (a dimensional center of the elastic membrane Et5 in this embodiment) and the cut apertures (slit) hs . . . which are formed on the circumference of the circle Ci and of which cutting direction is tangential against the circle Ci may be provided alternately, in symmetric with respect to a point and/or in symmetric with respect to a line.

Figure 9A:
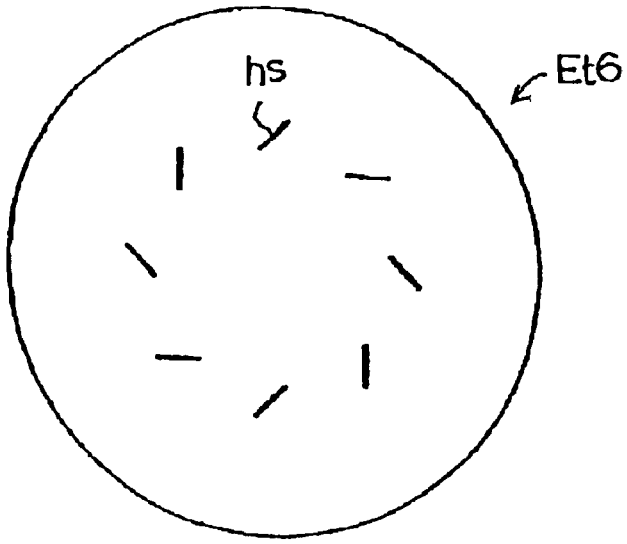
FIG. 9*a* is a plan view diagrammatically showing the elastic membrane for a quantitative discharge apparatus of the present invention and FIG. 9*b* is an explanatory view showing an arrangement rule of plural penetrating apertures formed on the elastic membrane.
Figure 9B:
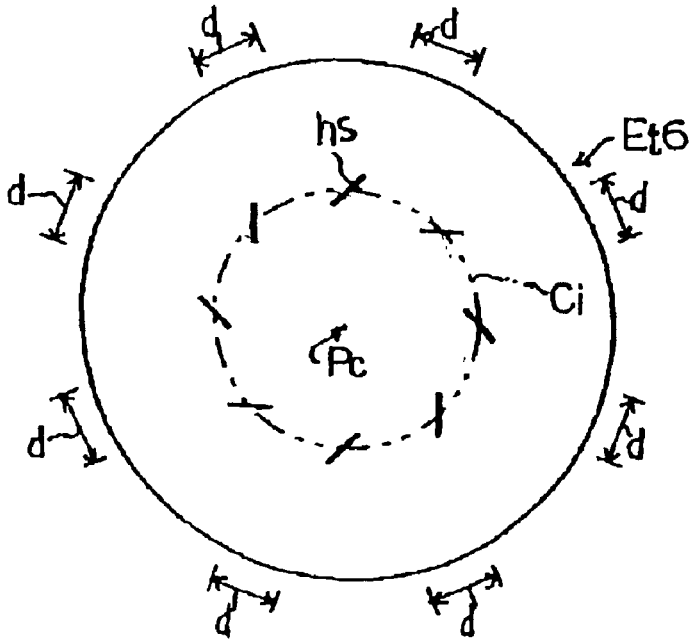

An elastic membrane Et6 shown in FIG. 9 may be preferably used as an elastic membrane of the quantitative discharge apparatus 1 and the powder material spray apparatus 11 incorporating the apparatus 1.

A virtual circle (see a circle Ci shown with an imaginary line in FIG. 9*b*) is drawn around a specific point Pc on the elastic membrane Et6 (a dimensional center of the elastic membrane Et6 in this embodiment) and plural penetrating apertures hs . . . are formed on its circumference.

More specifically, each one of the plural penetrating apertures hs . . . of the elastic membrane Et6 is a cut aperture (slit).

Each one of the plural cut apertures hs . . . is arranged so as to have the same fixed angle against the tangent of the virtual circle (see a circle Ci shown with an imaginary line in FIG. 9*b*) with the same space d on the circumference of the virtual circle (see a circle Ci shown with an imaginary line in FIG. 9*b*) around the specific point Pc on the elastic membrane Et6 (a dimensional center of the elastic membrane Et6 in this embodiment).

When plural penetrating apertures hs . . . have the same shape and, are positioned equivalently and are directed equivalently on the circumference of the virtual circle(see a circle Ci shown with an imaginary line in FIG. 9*b*) around the specific point Pc on the elastic membrane Et6 (a dimensional center of the elastic membrane Et6 in this embodiment), the discharge amount of powder material from each one of the plural penetrating apertures hs . . . becomes substantially the same.

Namely, if plural penetrating apertures hs . . . are formed according to the rule shown in the elastic membrane Et6, the discharge amount of powder material from the quantitative discharge apparatus 1 and the spray amount of powder material from the powder material spray apparatus 11 incorporating the discharge apparatus 1 can be changed keeping a positive correlation to the number of the penetrating apertures hs . . . on the elastic membrane without changing the supply conditions of the positive pulsating vibration air supplied on the elastic membrane.

Figure 10A:
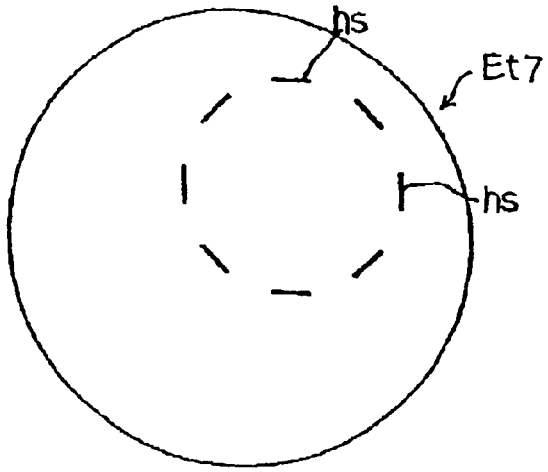
FIG. 10*a* is a plan view diagrammatically showing the elastic membrane for a quantitative discharge apparatus of the present invention and FIG. 10*b* is an explanatory view showing an arrangement rule of plural penetrating apertures formed on the elastic membrane.
Figure 10B:
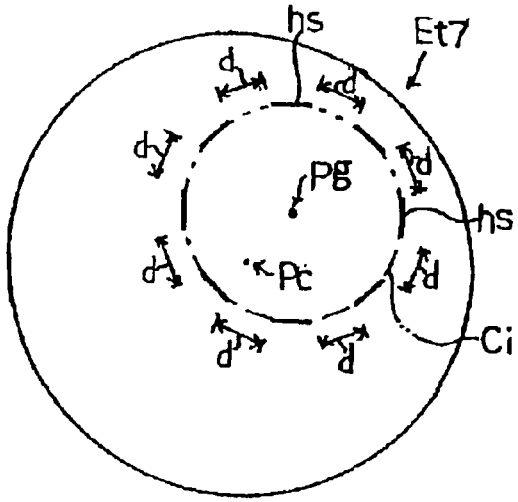

An elastic membrane Et7 in FIG. 10 may be preferably used as an elastic membrane of the quantitative discharge apparatus 1 and the powder material spray apparatus 11 incorporating the apparatus 1.

A virtual circle (see a circle Ci shown with an imaginary line in FIG. 10*b*) is drawn around a specific point on the membrane Et7 (a center of gravity of the elastic membrane Et7 in this embodiment) and plural penetrating apertures hs . . . are formed on its circumference.

When a positive pulsating vibration air is supplied on the elastic membrane to be vibrated by the air, the dimensional center of the elastic membrane generally becomes the center of vibration antinode. However, sometimes the center of gravity of the elastic membrane becomes the center of the vibration antinode and its periphery becomes the vibration node because of the shape of the elastic membrane and so on.

The center of gravity may agree with the dimensional center of the elastic membrane or they may not agree.

If they don't agree, it is preferable to use the elastic membrane Et7 in which a virtual circle (see a circle Ci shown with an imaginary line in FIG. 10*b*) is drawn around the center of gravity Pg of the elastic membrane Et7, not the dimensional center Pc, and plural penetrating apertures hs . . . are formed on its circumference.

In this elastic membrane Et7, each one of plural penetrating apertures hs . . . is a cut apertures (slit).

The cutting direction of each cut aperture hs . . . is a tangential direction against the circumference of the virtual circle (see a circle Ci shown with an imaginary line in FIG. 10*b*) around the point Pg on the membrane Et7 (a center of gravity of the elastic membrane Et7 in this embodiment) and the apertures hs . . . are provided at even intervals d.

Figure 11A:
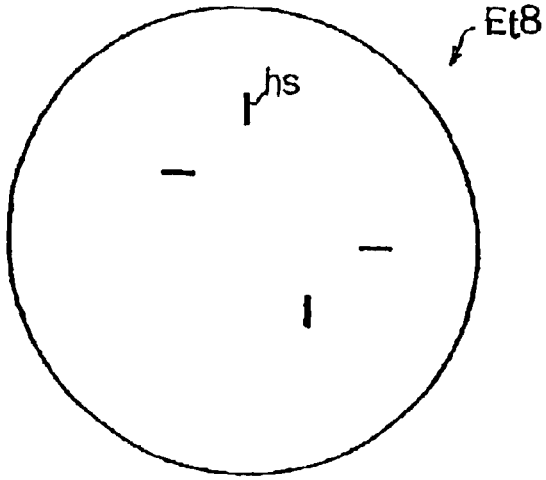
FIG. 11*a* is a plan view diagrammatically showing the elastic membrane for a quantitative discharge apparatus of the present invention and FIG. 11*b* is an explanatory view showing an arrangement rule of plural penetrating apertures formed on the elastic membrane.

An elastic membrane Et8 in FIG. 11 may be preferably used as an elastic membrane of the quantitative discharge apparatus 1 and the powder material spray apparatus 11 incorporating the apparatus 1.

A virtual circle (see a circle Ci shown with an imaginary line in FIG. 11*b*) is drawn around a specific point Pp on the membrane Et8 (an antinode of vibration on the elastic membrane Et8 when a positive pulsating vibration air is supplied thereon) and plural penetrating apertures hs . . . are formed on its circumference.

Figure 11B:
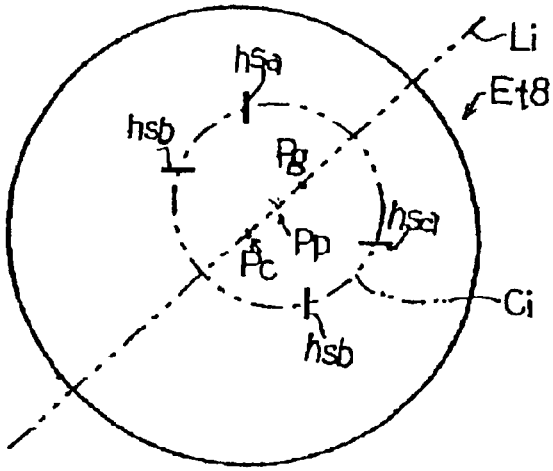

In FIG. 11*b*, for facilitating explanation, a pair of penetrating apertures hs . . . which are in symmetric with a line (see a straight line Li shown with an imaginary line in FIG. 11*b*) passing on the point Pp which is a center of antinode of vibration are shown as penetrating apertures hsa and hsa and another pair of penetrating apertures hs . . . which are in symmetric with a line (see a straight line Li shown with an imaginary line in FIG. 1*b*) passing on the point Pp which is a center of antinode of vibration are shown as penetrating apertures hsb and hsb.

When a positive pulsating vibration air is supplied on the elastic membrane to be vibrated by the air, the dimensional center of the elastic membrane generally becomes the center of vibration antinode. However, sometimes the center of gravity of the elastic membrane becomes the center of the vibration antinode and its periphery becomes the vibration node in some cases.

In such a case, as shown in FIG. 11, plural penetrating apertures hs . . . may be formed in symmetric with respect to the line (see a straight line Li shown with an imaginary line in FIG. 11*b*) passing on the point Pp which is the center of the antinode of vibration when a positive pulsating vibration air is supplied and the elastic membrane is vibrated, not on the dimensional center Pc or the gravity center Pg of the elastic membrane.

When each one of the plural penetrating apertures hs . . . is a cut aperture (slit), a pair of penetrating apertures (the penetrating apertures hsa and hsa in this embodiment) which are in symmetric with a line (see a straight line Li shown with an imaginary line in FIG. 11*b*) passing on the point Pp which is a center of antinode of vibration have the same length. Further, each cutting direction of the penetrating apertures hsa and hsa is in symmetric with a line (see a straight line Li shown with an imaginary line in FIG. 11*b*) passing on the point Pp which is a center of antinode of vibration. As a result, the discharge amount of powder material from each one of penetrating apertures hsa and hsa which are in symmetric with a line (see a straight line Li shown with an imaginary line in FIG. 11*b*) passing on the point Pp which is a center of antinode of vibration becomes almost the same.

Further, another pair of penetrating apertures (the penetrating apertures hsb and hsb in this embodiment) which are in symmetric with a line (see a straight line Li shown with an imaginary line in FIG. 11*b*) passing on the point Pp which is a center of antinode of vibration have the same length. Moreover, each cutting direction of the penetrating apertures hsb and hsb is in symmetric with a line (see a straight line Li shown with an imaginary line in FIG. 11*b*) passing on the point Pp which is a center of antinode of vibration. As a result, the discharge amount of powder material from each one of penetrating apertures hsb and hsb which are in symmetric with a line (see a straight line Li shown with an imaginary line in FIG. 11*b*) passing on the point Pp which is a center of antinode of vibration becomes almost the same.

Figure 12A:
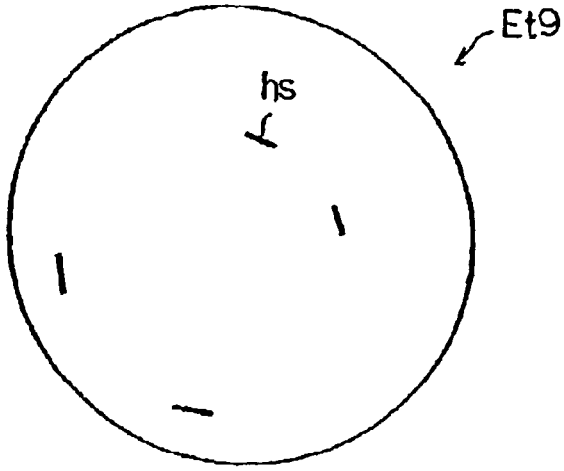
FIG. 12*a* is a plan view diagrammatically showing the elastic membrane for a quantitative discharge apparatus of the present invention and FIG. 12*b* is an explanatory view showing an arrangement rule of plural penetrating apertures formed on the elastic membrane.

An elastic membrane Et9 in FIG. 12 may be preferably used as an elastic membrane of the quantitative discharge apparatus 1 and the powder material spray apparatus 11 incorporating the apparatus 1.

Figure 12B:
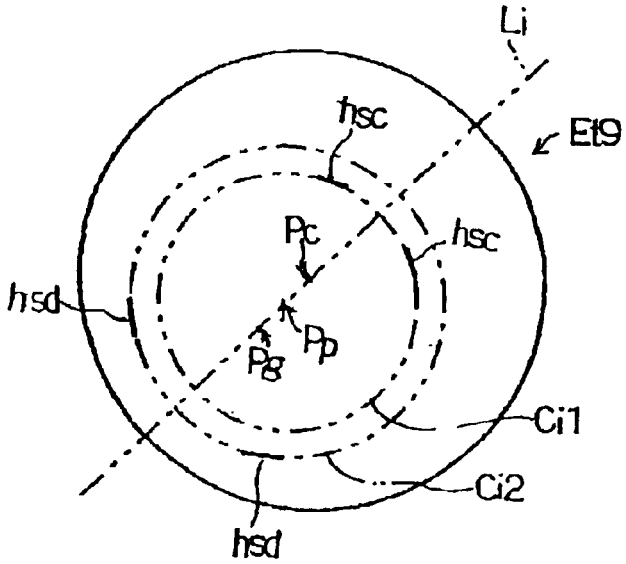

In FIG. 12*b*, for facilitating explanation, a pair of penetrating apertures hs . . . which are in symmetric with a line (see a straight line Li shown with an imaginary line in FIG. 12*b*) passing on the point Pp which is a center of antinode of vibration are shown as penetrating apertures hsc and hsc and another pair of penetrating apertures hs . . . which are in symmetric with a line (see a straight line Li shown with an imaginary line in FIG. 12*b*) passing on the point Pp which is a center of antinode of vibration are shown as penetrating apertures hsd and hsd.

Concentric virtual circles (see circles Ci1 and Ci2 shown with an imaginary line in FIG. 12*b*) are drawn around a specific point Pp on the elastic membrane Et8 (an antinode of vibration on the elastic membrane Et9 when a positive pulsating vibration air is supplied thereon) and plural penetrating apertures hs . . . are formed on each circumference of the concentric virtual circles.

When a positive pulsating vibration air is supplied on the elastic membrane to be vibrated by the air, sometimes a specific point becomes the center of the vibration antinode and its periphery becomes the vibration node.

In such a case, as shown in FIG. 12, each pair of the penetrating apertures (hsc, hsc) (hsd, hsd) may be formed on each circumference of the concentric virtual circles (see circles Ci1 and Ci2 shown with an imaginary line in FIG.

12*b*) in symmetric with respect to the line (see a straight line Li shown with an imaginary line in FIG. 12*b*) passing on the point Pp which is the center of the antinode of vibration when a positive pulsating vibration air is supplied and the elastic membrane is vibrated, instead of the dimensional center Pc or the gravity center Pg of the elastic membrane Et9.

In the embodiment as shown in FIG. 12, one pair of penetrating apertures (hsc, hsc) which are symmetric with respect to the line Li shown with an imaginary line in FIG. 12*b* are formed on the circumference of the virtual circle Ci1 drawn around the point Pp which is the center of the antinode of vibration of the elastic membrane Et9.

Further in FIG. 12*b*, another pair of penetrating apertures (hsd, hsd) which are symmetric with respect to the line Li shown with an imaginary line in FIG. 12*b* are formed on the circumference of the virtual circle Ci2 drawn around the point Pp which is the center of the antinode of vibration of the elastic membrane.

A pair of penetrating apertures hsc and hsc have the same length and are directed in a tangential direction against the circumference of the virtual circle Ci1 drawn around on the point Pp which is a center of antinode of vibration of the elastic membrane Et9.

Thereby, the discharge amount of powder material from each one of penetrating apertures hsc and hsc of the elastic membrane Et9 becomes almost the same.

A pair of penetrating apertures hsd and hsd have the same length and are directed in a tangential direction against the circumference of the virtual circle Ci2 drawn around on the point Pp which is a center of antinode of vibration of the elastic membrane Et9.

Thereby, the discharge amount of powder material from each one of penetrating apertures hsc and hsc of the elastic membrane Et9 becomes almost the same.

Figure 13A:
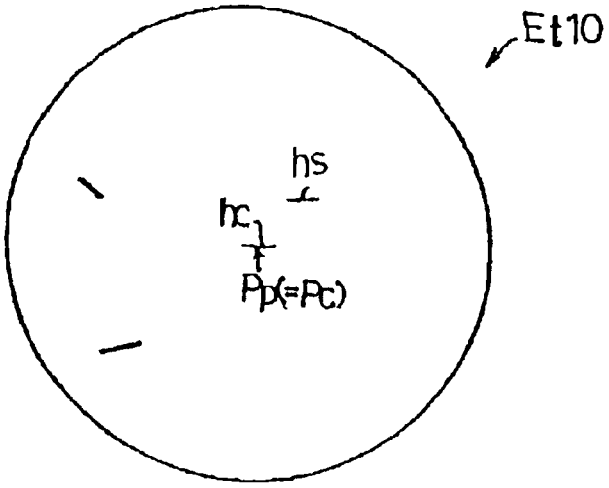
FIG. 13*a* is a plan view diagrammatically showing the elastic membrane for a quantitative discharge apparatus of the present invention and FIG. 13*b* is an explanatory view showing an arrangement rule of plural penetrating apertures formed on the elastic membrane.

An elastic membrane Et10 in FIG. 13 may be preferably used as an elastic membrane of the quantitative discharge apparatus 1 and the powder material spray apparatus 11 incorporating the apparatus 1.

Figure 13B:
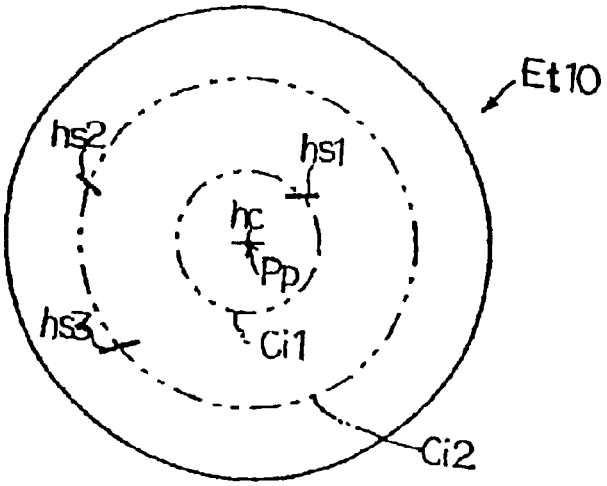

In FIG. 13*b*, each penetrating apertures hs are allotted with reference numbers for facilitating explanation.

In this embodiment, the elastic membrane Et10 is supplied with a positive pulsating vibration air to be vibrated and the antinode Pp of vibration of the elastic membrane Et10 accords with the dimensional center of the elastic membrane Et10.

Here the rule of increasing the number of the penetrating apertures hs on the elastic membrane Et10 is mainly explained.

The elastic membrane having a penetrating aperture hc at the dimensional center Pc of the membrane is provided for the quantitative discharge apparatus 1 and the powder material spray apparatus 11 incorporating the apparatus 1. Supplying a positive pulsating vibration air on the elastic membrane to be vibrated, the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are less than an objective amount, a virtual circle (see the virtual circle Ci1 in FIG. 13*b*) is drawn around the dimensional center Pc of the elastic membrane and a penetrating aperture (see a penetrating aperture hs1 in FIG. 13*b*) is formed on the circumference of the virtual circle Ci1.

Thereafter, the elastic membrane having the penetrating aperture hc and the penetrating aperture hs1 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc and hs1 is driven in earnest.

If the discharge amount of powder material from the discharge apparatus 1 and the spray amount of powder material from the spray apparatus 11 incorporating the apparatus 1 on which the elastic membrane with the penetrating apertures hc and hs1 is attached are less than an objective amount, a virtual circle (see the virtual circle Ci2 in FIG. 13*b*) is drawn around the dimensional center Pc of the elastic membrane and a penetrating aperture (see a penetrating aperture hs2 in FIG. 13*b*) is formed on the circumference of the virtual circle Ci2.

In this embodiment the penetrating aperture hs2 is provided on the virtual circle Ci2, however, it may be provided on the virtual circle Ci1.

Thereafter, the elastic membrane having the penetrating aperture hc, hs1 and hs2 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1 and hs2 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1 and hs2 is attached are less than an objective amount, a penetrating aperture (see a penetrating aperture hs3 in FIG. 13*b*) is formed on the circumference of the virtual circle (see a virtual circle Ci2 in FIG. 13*b*) on which the penetrating aperture hs2 is provided.

Thereafter, the elastic membrane having the penetrating apertures hc, hs1, hs2 and hs3 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2 and hs3 is driven in earnest.

FIG. 13 shows the elastic membrane Et10 on which the penetrating apertures hc, hs1, hs2 and hs3 are provided as mentioned above.

If the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached are less than an objective amount, a new penetrating aperture is further formed on the virtual circle (see the virtual circle Ci2 in FIG. 13*b*) on which the penetrating apertures hs2 and hs3 are provided, or a virtual circle (not shown) is further drawn around the dimensional center Pc of the elastic membrane and a new penetrating aperture (not shown) is further formed on the circumference of the virtual circle. Such operations like providing a penetrating aperture are repeated until the discharge amount of powder material from the discharge apparatus 1 and the spray amount of powder material from the spray apparatus 11 incorporating the apparatus 1 become objective values.

Figure 14A:
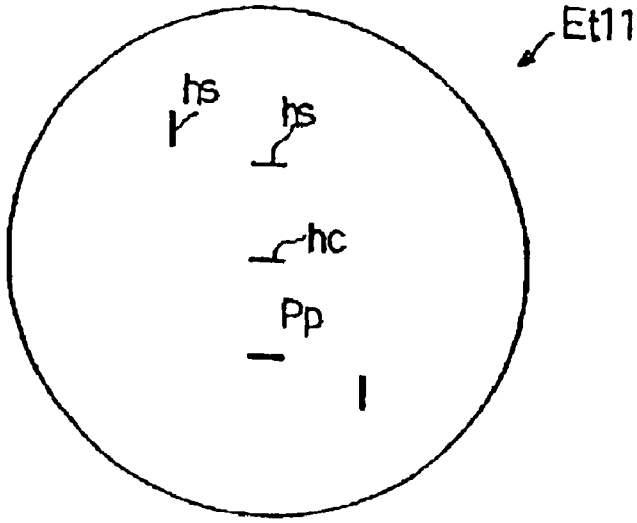
FIG. 14*a* is a plan view diagrammatically showing the elastic membrane for a quantitative discharge apparatus of the present invention and FIG. 14*b* is an explanatory view showing an arrangement rule of plural penetrating apertures formed on the elastic membrane.

An elastic membrane Et11 in FIG. 14 may be preferably used as an elastic membrane of the quantitative discharge apparatus 1 and the powder material spray apparatus 11 incorporating the apparatus 1.

Figure 14B:
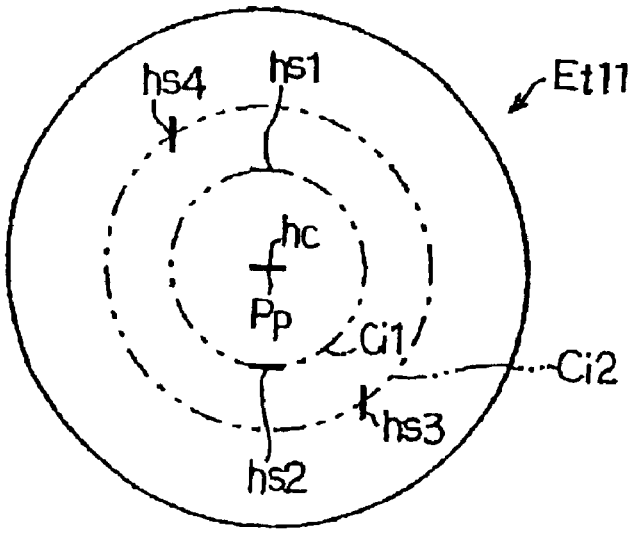

In FIG. 14*b*, each penetrating aperture hs is allotted with a reference number for facilitating explanation.

In this embodiment, the elastic membrane Et11 is supplied with a positive pulsating vibration air to be vibrated and the antinode Pp of vibration of the elastic membrane Et11 accords with the dimensional center of the elastic membrane Et11.

The rule of increasing the number of the penetrating apertures hs on the elastic membrane Et11 is also mainly explained.

The elastic membrane having the penetrating aperture hc at the dimensional center Pc of the membrane is attached to the quantitative discharge apparatus 1 and the powder material spray apparatus 11 incorporating the apparatus 1. Supplying a positive pulsating vibration air on the elastic membrane to be vibrated, the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are remarkably less than an objective amount, a virtual circle (see the virtual circle Ci1 in FIG. 14*b*) is drawn around the dimensional center Pc of the elastic membrane and a penetrating aperture (see a penetrating aperture hs1 in FIG. 14*b*) is formed on the circumference of the virtual circle Ci1.

This time the penetrating aperture hs1 is formed on a tangent of the virtual circle (see the virtual circle Ci1 in FIG. 14*b*) in order to heighten its discharge efficiency.

Thereafter, the elastic membrane having the penetrating aperture hc and the penetrating aperture hs1 is attached to the quantitative discharge apparatus 1 and the powder material spray apparatus 11 incorporating the apparatus 1, a positive pulsating vibration air with conditions same as mentioned above is supplied to vibrate the elastic membrane, then the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are remarkably less than objective values, a penetrating aperture (see a penetrating aperture hs2 in FIG. 14*b*) is further formed on the circumference of the virtual circle (see the virtual circle Ci1 in FIG. 14*b*) on which the penetrating aperture hs1 is formed.

The penetrating aperture hs2 is preferably provided on the circumference of the virtual circle (see the virtual circle Ci1 in FIG. 14*b*), however, more preferably, the penetrating aperture hs2 and hs1 may be provided in symmetric with respect to the dimensional center Pc of the elastic membrane around which the virtual circle (see the virtual circle Ci1 in FIG. 14*b*) is drawn and/or they may be provided in symmetric with respect to a line (not shown) passing on the dimensional center Pc.

Thereafter, the elastic membrane having the penetrating aperture hc, hs1 and hs2 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1 and hs2 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1 and hs2 is attached are less than an objective amount, a virtual circle (see the virtual circle Ci2 in FIG. 14*b*) is drawn around the dimensional center Pc of the elastic membrane and a penetrating aperture (see a penetrating aperture hs3 in FIG. 14*b*) is formed on the circumference of the virtual circle Ci2.

This time the cutting direction of the penetrating aperture (see the penetrating aperture hs3 in FIG. 14*b*) is directed so as to have an angle from a tangent of the virtual circle Ci2 in order that the discharge amount from the penetrating aperture hs3 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached come close to the objective discharge amount and the objective spray amount.

In this embodiment, the penetrating aperture hs3 is provided on the virtual circle Ci2, however, it may be provided on the virtual circle Ci1.

Thereafter, the elastic membrane having the penetrating aperture hc, hs1, hs2 and hs3 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2 and hs3 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached are less than an objective amount, a new penetrating aperture (see a penetrating aperture hs4 in FIG. 14*b*) is further formed on the virtual circle (see the virtual circle Ci2 in FIG. 14*b*) on which the penetrating apertures hs3 and is provided.

The penetrating aperture hs4 is preferably provided on the circumference of the virtual circle (see the virtual circle Ci2 in FIG. 14*b*) on which the penetrating aperture hs3 is provided, however, more preferably, the penetrating aperture hs3 and hs4 may be provided in symmetric with respect to the dimensional center Pc of the elastic membrane around which the virtual circle (see the virtual circle Ci2 in FIG. 14*b*) is drawn and/or may be provided in symmetric with respect to a line (not shown) passing on the dimensional center PC.

The cutting direction of the penetrating aperture (see the penetrating aperture hs4 in FIG. 14*b*) is directed so as to have an angle from a tangent of the virtual circle Ci2 in order that the discharge amount from the penetrating aperture hs4 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hs1, hs2, hs3 and hs4 is attached come close to the objective discharge amount and the objective spray amount.

Thereafter, the elastic membrane having the penetrating aperture hs1, hs2, hs3 and hs4 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3 and hs4 is driven in earnest.

FIG. 14 shows the elastic membrane Et11 on which the penetrating apertures hc1, hs2, hs3 and hs4 are provided as mentioned above.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3 and hs4 is attached are less than an objective amount, a new penetrating aperture (not shown) is further formed on the virtual circle (see the virtual circle Ci1 in FIG. 14*b*) on which the penetrating apertures hs1 and hs2 are provided, a new penetrating aperture (not shown) is further formed on the virtual circle (see the virtual circle Ci2 in FIG. 14*b*) on which the penetrating apertures hs3 and hs4 are provided, or a virtual circle (not shown) is further drawn around the dimensional center Pc of the elastic membrane and a new penetrating aperture (not shown) is further formed on the circumference of the virtual circle. Such operations like providing a penetrating aperture are repeated until the discharge amount of powder material from the discharge apparatus 1 and the spray amount of powder material from the spray apparatus 11 incorporating the apparatus 1 become objective values.

Figure 15A:
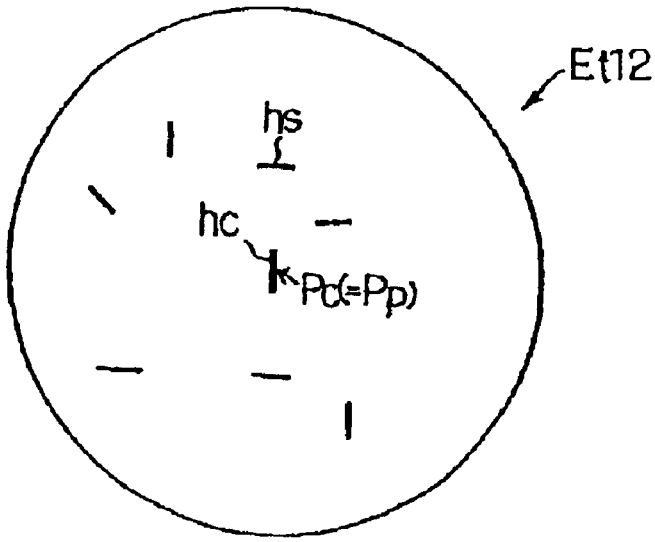
FIG. 15*a* is a plan view diagrammatically showing the elastic membrane for a quantitative discharge apparatus of the present invention and FIG. 15*b* is an explanatory view showing an arrangement rule of plural penetrating apertures formed on the elastic membrane.

An elastic membrane Et12 in FIG. 15 may be preferably used as an elastic membrane of the quantitative discharge apparatus 1 and the powder material spray apparatus 11 incorporating the apparatus 1.

Figure 15B:
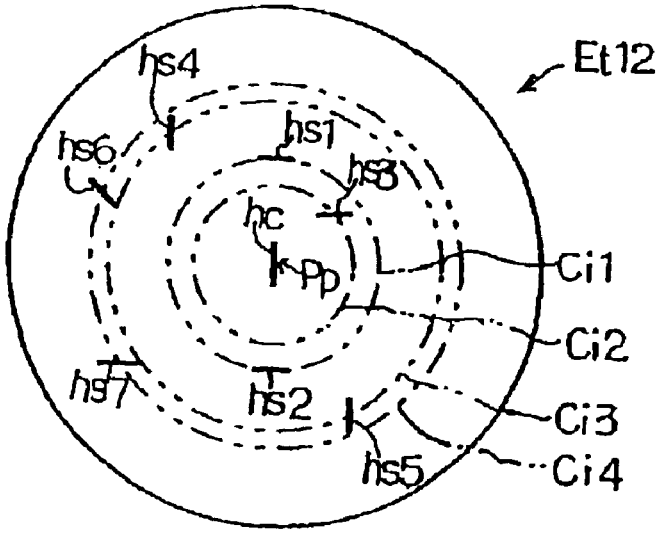

In FIG. 15*b*, each penetrating aperture hs is allotted with a reference number for facilitating explanation.

In this embodiment, the elastic membrane Et12 is supplied with a positive pulsating vibration air to be vibrated and the antinode Pp of vibration of the elastic membrane Et11 accords with the dimensional center of the elastic membrane Et12.

The rule of increasing the number of the penetrating apertures hs on the elastic membrane Et12 is also mainly explained.

The elastic membrane having the penetrating aperture hc at the dimensional center Pc of the membrane is provided for the quantitative discharge apparatus 1 and the powder material spray apparatus 11 incorporating the apparatus 1. Supplying a positive pulsating vibration air on the elastic membrane to be vibrated, the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are remarkably less than an objective amount, a virtual circle (see the virtual circle Ci1 in FIG. 15*b*) is drawn around the dimensional center of the elastic membrane and a penetrating aperture (see a penetrating aperture hs1 in FIG. 15*b*) is formed on the circumference of the virtual circle Ci1.

This time the penetrating aperture hs1 is formed on a tangent of the virtual circle (see the virtual circle Ci1 in FIG. 15*b*) in order to heighten its discharge efficiency.

Thereafter, the elastic membrane having the penetrating aperture hc and the penetrating aperture hs1 is attached to the quantitative discharge apparatus 1 and the powder material spray apparatus 11 incorporating the apparatus 1, a positive pulsating vibration air with conditions same as mentioned above is supplied on the elastic membrane, then the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are still less than objective values, a penetrating aperture (see a penetrating aperture hs2 in FIG. 15*b*) is further formed on the circumference of the virtual circle (see the virtual circle Ci1 in FIG. 15*b*) on which the penetrating aperture hs1 is formed.

The penetrating aperture hs2 is preferably provided on the circumference of the virtual circle (see the virtual circle Ci1 in FIG. 15*b*), however, more preferably, the penetrating aperture hs2 and hs1 may be provided in symmetric with respect to the dimensional center Pc of the elastic membrane around which the virtual circle (see the virtual circle Ci1 in FIG. 15*b*) is drawn and/or they may be provided in symmetric with respect to a line (not shown) passing on the dimensional center Pc.

Thereafter, the elastic membrane having the penetrating aperture hc, hs1 and hs2 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc and hs1 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1 and hs2 is attached are a little less than an objective amount, a virtual circle (see the virtual circle Ci2 in FIG. 15*b*) is drawn around the dimensional center Pc of the elastic membrane and a penetrating aperture (see a penetrating aperture hs3 in FIG. 15*b*) is formed on the circumference of the virtual circle Ci2.

This time the cutting direction of the penetrating aperture (see the penetrating aperture hs3 in FIG. 15*b*) is directed so as to have an angle from a tangent of the virtual circle Ci2 in order that the discharge amount from the penetrating aperture hs3 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached come close to the objective discharge amount and the objective spray amount.

In this embodiment, the penetrating aperture hs3 is provided on the virtual circle Ci2, however, it may be provided on the virtual circle Ci1.

Thereafter, the elastic membrane having the penetrating aperture hc, hs1, hs2 and hs3 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2 and hs3 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached are less than an objective amount, a new penetrating aperture (see a penetrating aperture hs4 in FIG. 15*b*) is further formed on the virtual circle (see the virtual circle Ci3 in FIG. 15*b*) around the dimensional center Pc of the elastic membrane.

The cutting direction of the penetrating aperture (see the penetrating aperture hs4 in FIG. 15*b*) is directed so as to have an angle from a tangent of the virtual circle Ci3 in order that the discharge amount from the penetrating aperture hs4 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached come close to the objective discharge amount and the objective spray amount.

Thereafter, the elastic membrane having the penetrating aperture hc, hs1, hs2, hs3 and hs4 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3 and hs4 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3 and hs4 is attached are less than an objective amount, a new penetrating aperture (see a penetrating aperture hs5 in FIG. 15*b*) is further formed on the virtual circle (see the virtual circle Ci3 in FIG. 15*b*) on which the penetrating aperture hs4 is provided.

The penetrating aperture hs5 is preferably provided on the circumference of the virtual circle (see the virtual circle Ci3 in FIG. 15*b*) on which the penetrating aperture hs4 is provided, however, more preferably, the penetrating aperture hs5 and hs4 may be provided in symmetric with respect to the dimensional center Pc of the elastic membrane around which the virtual circle (see the virtual circle Ci3 in FIG. 15*b*) is drawn and/or they may be provided in symmetric with respect to a line (not shown) passing on the dimensional center Pc.

The cutting direction of the penetrating aperture (see the penetrating aperture hs5 in FIG. 15*b*) is directed so as to have an angle from a tangent of the virtual circle Ci3 in order that the discharge amount from the penetrating aperture hs5 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4 and hs5 is attached come close to the objective discharge amount and the objective spray amount.

Thereafter, the elastic membrane having the penetrating aperture hc, hs1, hs2, hs3, hs4 and hs5 is attached to the quantitative discharge apparatus 1 and the powder material spray apparatus 11 incorporating the apparatus 1, a positive pulsating vibration air with conditions same as mentioned above is supplied on the elastic membrane, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3, hs4 and hs5 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4 and hs5 is attached are still less than an objective amount, a new penetrating aperture (see a penetrating aperture hs6 in FIG. 15*b*) is further formed on the virtual circle (see the virtual circle Ci4 in FIG. 15*b*) around the dimensional center Pc of the elastic membrane.

The cutting direction of the penetrating aperture (see the penetrating aperture hs6 in FIG. 15*b*) is directed so as to have an angle from a tangent of the virtual circle Ci4 in order that the discharge amount from the penetrating aperture hs5 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4, hs5 and hs6 is attached come close to the objective discharge amount and the objective spray amount.

Thereafter, the elastic membrane having the penetrating aperture hc, hs1, hs2, hs3, hs4, hs5 and hs6 is attached to the quantitative discharge apparatus 1 and the powder material spray apparatus 11 incorporating the apparatus 1, a positive pulsating vibration air with conditions same as mentioned above is supplied on the elastic membrane, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3, hs4, hs5 and hs6 is driven in earnest.

When the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4, hs5 and hs6 is attached are still less than objective amounts, a new penetrating aperture (see a penetrating aperture hs7 in FIG. 15*b*) is further formed on the virtual circle (see the virtual circle Ci4 in FIG. 15*b*) on which the penetrating aperture hs6 is provided.

The cutting direction of the penetrating aperture (see the penetrating aperture hs7 in FIG. 15*b*) is directed so as to have an angle from a tangent of the virtual circle Ci4 in order that the discharge amount from the penetrating aperture hs7 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4, hs5, hs6 and hs7 is attached come close to the objective discharge amount and the objective spray amount.

The penetrating aperture hs7 is preferably formed on the circumference of the virtual circle Ci4. When the elastic membrane Et12 is examined to be uniformly expanded or not and a specially strained part is found on the membrane Et12, the aperture hs7 may be provided for the area.

Thereafter, the elastic membrane having the penetrating aperture hc, hs1, hs2, hs3, hs4, hs5, hs6 and hs7 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3, hs4, hs5, hs6 and hs7 is driven in earnest.

FIG. 15 shows the elastic membrane Et12 on which the penetrating apertures hc1, hs2, hs3, hs4, hs5, hs6 and hs7 are provided as mentioned above.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4, hs5, hs6 and hs7 is attached are less than an objective amount, a new penetrating aperture (not shown) is further formed on the virtual circle (see the virtual circle Ci1 in FIG. 15*b*) on which the penetrating apertures hs1 and hs2 are provided, on the virtual circle (see the virtual circle Ci2 in FIG. 15*b*) on which the penetrating aperture hs3 is provided, on the virtual circle (see the virtual circle Ci3 in FIG. 15*b*) on which the penetrating apertures hs4 and hs5 are provided, and/or on the virtual circle (see the virtual circle Ci4 in FIG. 15*b*) on which the penetrating apertures hs6 and hs7 are provided. Or a virtual circle (not shown) is further drawn around the dimensional center Pc of the elastic membrane Et12 and anew penetrating aperture (not shown) is further formed on the circumference of the virtual circle. Such operations like providing a penetrating aperture are repeated until the discharge amount of powder material from the discharge apparatus 1 and the spray amount of powder material from the spray apparatus 11 incorporating the apparatus 1 become objective values.

Figure 16A:
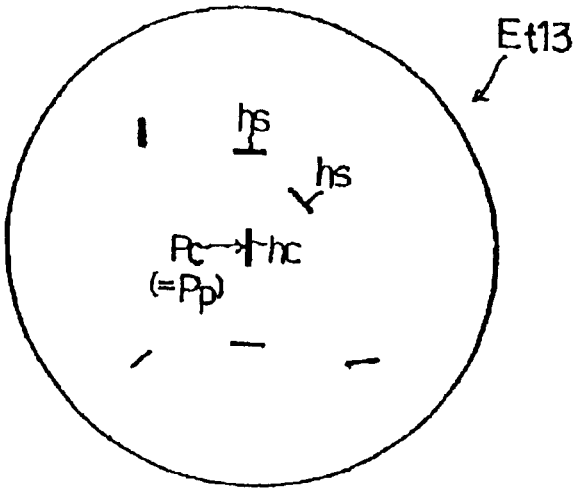
FIG. 16*a* is a plan view diagrammatically showing the elastic membrane for a quantitative discharge apparatus of the present invention and FIG. 16*b* is an explanatory view showing an arrangement rule of plural penetrating apertures formed on the elastic membrane.

An elastic membrane Et13 in FIG. 16 may be preferably used as an elastic membrane of the quantitative discharge apparatus 1 and the powder material spray apparatus 11 incorporating the apparatus 1.

Figure 16B:
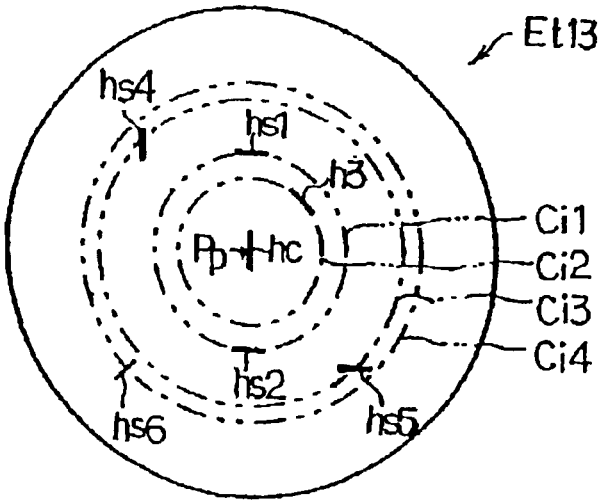

In FIG. 16*b*, each penetrating aperture hs is allotted with a reference number for facilitating explanation.

In this embodiment, the elastic membrane Et13 is supplied with a positive pulsating vibration air to be vibrated and the antinode Pp of vibration of the elastic membrane Et13 accords with the dimensional center of the elastic membrane Et13.

The rule of increasing the number of the penetrating apertures hs on the elastic membrane Et13 is also mainly explained.

The elastic membrane having the penetrating aperture hc at the dimensional center Pc of the membrane is provided for the quantitative discharge apparatus 1 and the powder material spray apparatus 11 incorporating the apparatus 1. Supplying a positive pulsating vibration air on the elastic membrane, the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are remarkably less than objective amounts, a virtual circle (see the virtual circle Ci1 in FIG. 16*b*) is drawn around the dimensional center Pc of the elastic membrane and a penetrating aperture (see a penetrating aperture hs1 in FIG. 16*b*) is formed on the circumference of the virtual circle Ci1.

Thus, when the discharge amount of powder material from the discharge apparatus 1 and the spray amount of powder material from the spray apparatus 11 incorporating the apparatus 1 are remarkably less than objective amounts, the penetrating aperture hs1 is formed on a tangent of the virtual circle (see the virtual circle Ci1 in FIG. 16*b*) in order to heighten its discharge efficiency.

Thereafter, the elastic membrane having the penetrating aperture hc and the penetrating aperture hs1 is attached to the quantitative discharge apparatus 1 and the powder material spray apparatus 11 incorporating the apparatus 1, a positive pulsating vibration air with conditions same as mentioned above is supplied to vibrate the elastic membrane, then the discharge amount of powder material from the quantitative discharge apparatus 1 and the spray amount of powder material from the powder material spray apparatus 11 incorporating the apparatus 1 are measured.

If the discharge amount of powder material from the discharge apparatus 1 and the spray amount of powder material from the spray apparatus 11 incorporating the apparatus 1 are still less than objective values, a penetrating aperture (see a penetrating aperture hs2 in FIG. 16*b*) is further formed on the circumference of the virtual circle (see the virtual circle Ci1 in FIG. 16*b*) on which the penetrating aperture hs1 is formed.

The penetrating aperture hs2 is preferably provided on the circumference of the virtual circle (see the virtual circle Ci1 in FIG. 16*b*), however, more preferably, the penetrating aperture hs2 and hs1 may be provided in symmetric with respect to the dimensional center Pc of the elastic membrane around which the virtual circle (see the virtual circle Ci1 in FIG. 16*b*) is drawn and/or they may be provided in symmetric with respect to a line (not shown) passing on the dimensional center Pc.

If the discharge amount of powder material from the discharge apparatus 1 and the spray amount of powder material from the spray apparatus 11 incorporating the apparatus 1 are still less than objective values, the cutting direction of the penetrating aperture hs2 is directed to a tangential line of the virtual circle (see the virtual circle Ci1 in FIG. 16*b*).

Thereafter, the elastic membrane having the penetrating aperture hc, hs1 and hs2 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc and hs1 is driven in earnest.

If the discharge amount of powder material from the discharge apparatus 1 and the spray amount of powder material from the spray apparatus 11 incorporating the apparatus 1 which are provided with the elastic membrane with penetrating apertures hc, hs1 and hs2 are still remarkably less than objective values, a penetrating aperture (see a penetrating aperture hs3 in FIG. 16*b*) is further formed on the circumference of the virtual circle (see the virtual circle Ci2 in FIG. 16*b*) on which the penetrating aperture hs1 is formed.

In this case, the cutting direction of the penetrating aperture hs3 is in a tangential direction against the circumference of the virtual circle (see the virtual circle Ci2 in FIG. 16*b*) in order to increase the discharge amount therefrom.

In this embodiment, the penetrating aperture hs3 is provided on the virtual circle Ci2, however, it may be provided on the virtual circle Ci1.

Thereafter, the elastic membrane having the penetrating aperture hc, hs1, hs2 and hs3 is attached to the quantitative discharge apparatus 1 and the powder material spray apparatus 11 incorporating the apparatus 1, a positive pulsating vibration air with conditions same as mentioned above is supplied on the elastic membrane, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2 and hs3 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached are a little less than objective amounts, a virtual circle (see the virtual circle Ci3 in FIG. 16*b*) is drawn around the dimensional center Pc of the elastic membrane and a penetrating aperture (see a penetrating aperture hs4 in FIG. 16*b*) is formed on the circumference of the virtual circle Ci3.

This time the cutting direction of the penetrating aperture (see the penetrating aperture hs4 in FIG. 16*b*) is directed so as to have an angle from a tangent of the virtual circle Ci3 in order that the discharge amount from the penetrating aperture hs4 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2 and hs3 is attached come close to the objective discharge amount and the objective spray amount.

Thereafter, the elastic membrane having the penetrating aperture hc, hs1, hs2, hs3 and hs4 is attached to the quantitative discharge apparatus 1 and the powder material spray apparatus 11 incorporating the apparatus 1, a positive pulsating vibration air with conditions same as mentioned above is supplied to vibrate the elastic membrane, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3 and hs4 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3 and hs4 is attached are less than objective amounts, a new penetrating aperture (see a penetrating aperture hs5 in FIG. 16*b*) is further formed on the virtual circle (see the virtual circle Ci3 in FIG. 16*b*) around the dimensional center Pc of the elastic membrane.

The penetrating aperture hs5 is preferably provided on the circumference of the virtual circle (see the virtual circle Ci3 in FIG. 16*b*) on which the penetrating aperture hs4 is provided, however, more preferably, the penetrating aperture hs5 and hs4 may be provided in symmetric with respect to the dimensional center Pc of the elastic membrane around which the virtual circle (see the virtual circle Ci3 in FIG. 16*b*) is drawn and/or they may be provided in symmetric with respect to a line (not shown) passing on the dimensional center Pc.

The cutting direction of the penetrating aperture (see the penetrating aperture hs5 in FIG. 16*b*) is directed so as to have an angle from a tangent of the virtual circle Ci3 in order that the discharge amount from the penetrating aperture hs5 becomes less than that from each penetrating aperture hs1 and hs2, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4 and hs5 is attached come close to the objective discharge amount and the objective spray amount.

Thereafter, the elastic membrane having the penetrating aperture hc, hs1, hs2, hs3, hs4 and hs5 is attached to the quantitative discharge apparatus 1 and the powder material spray apparatus 11 incorporating the apparatus 1, a positive pulsating vibration air with conditions same as mentioned above is supplied on the elastic membrane to be vibrated, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3, hs4 and hs5 is driven in earnest.

If the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4 and hs5 is attached are only a little less than an objective amount, a new penetrating aperture (see a penetrating aperture hs6 in FIG. 16*b*) is further formed on the virtual circle (see the virtual circle Ci4 in FIG. 16*b*) around the dimensional center Pc of the elastic membrane.

The cutting direction of the penetrating aperture (see the penetrating aperture hs6 in FIG. 16*b*) is directed so as to be radial against the center of the virtual circle Ci4 in order that the discharge amount from the penetrating aperture hs6 becomes less than that from each penetrating aperture hs1, hs2, hs3, hs4 and hs5, considering the discharge efficiency in such a manner that the discharge amount of powder material from the discharge apparatus 1 and the spray amount of powder material from the spray apparatus 11 incorporating the apparatus 1 on which the elastic membrane with the penetrating apertures hc, hs1, hs2, hs3, hs4, hs5 and hs6 is attached come close to the objective discharge amount and the objective spray amount.

Thereafter, the elastic membrane having the penetrating aperture hc, hs1, hs2, hs3, hs4, hs5 and hs6 is attached to the quantitative discharge apparatus 1 and the powder material spray apparatus 11 incorporating the apparatus 1, a positive pulsating vibration air with conditions same as mentioned above is supplied on the elastic membrane, then the discharge amount of powder material from the quantitative discharge apparatus 1 and the spray amount of powder material from the powder material spray apparatus 11 incorporating the apparatus 1 are measured.

When the discharge amount of powder material from the discharge apparatus 1 and the spray amount of powder material from the spray apparatus 11 incorporating the apparatus 1 are objective values, the quantitative discharge apparatus 1 or the powder material spray apparatus 11 incorporating the apparatus 1 which is provided with the elastic membrane with the penetrating apertures hc, hs1, hs2, hs3, hs4, hs5 and hs6 is driven in earnest.

FIG. 16 shows the elastic membrane Et13 on which the penetrating apertures hc, hs1, hs2, hs3, hs4, hs5 and hs6 are provided as mentioned above.

If the discharge amount of powder material from the discharge apparatus 1 and the spray amount of powder material from the spray apparatus 11 incorporating the apparatus 1 on which the elastic membrane with the penetrating apertures hc1, hs2, hs3, hs4, hs5 and hs6 is attached are less than objective amounts, a new penetrating aperture (not shown) is further formed on the virtual circle (see the virtual circle Ci1 in FIG. 16*b*) on which the penetrating apertures hs1 and hs2 are provided, on the virtual circle (see the virtual circle Ci2 in FIG. 16*b*) on which the penetrating aperture hs3 is provided, on the virtual circle (see the virtual circle Ci3 in FIG. 16*b*) on which the penetrating apertures hs4 and hs5 are provided, and/or on the virtual circle (see the virtual circle Ci4 in FIG. 16*b*) on which the penetrating aperture hs6 is provided. Or a virtual circle (not shown) is further drawn around the dimensional center Pc of the elastic membrane Et13 and a new penetrating aperture (not shown) is further formed on the circumference of the virtual circle. Such operations like providing a penetrating aperture are repeated until the discharge amount of powder material from the discharge apparatus 1 and the spray amount of powder material from the spray apparatus 11 incorporating the apparatus 1 become objective values.

Next, a preferable embodiment of a quantitative discharge apparatus of the present invention other than an elastic membrane will be detailed.

Figure 17:
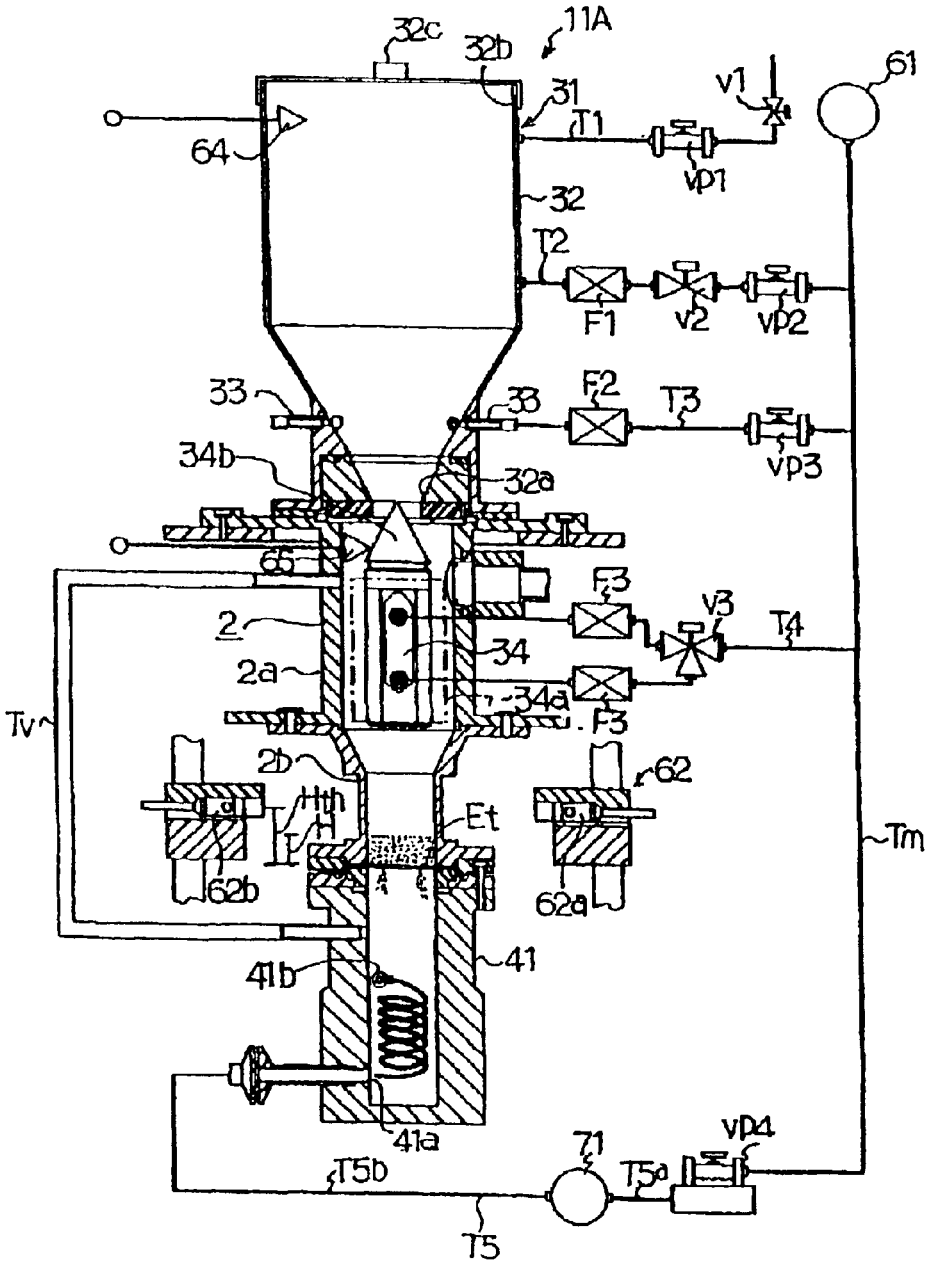
FIG. 17 is an explanatory view diagrammatically showing a specific construction of a powder material spray apparatus applying a quantitative discharge apparatus of the present invention.

FIG. 17 is an explanatory view diagrammatically showing a specific construction of a powder material spray apparatus using a quantitative discharge apparatus of the present invention.

The powder material spray apparatus 11A is comprised of a powder material storage hopper 31, a tubular body 2 airtightly connected to a discharge port 32*a* of a hopper body 32 of the powder material storage hopper 31, a material feed valve 34 provided so as to be able to open and close the material discharge port 32*a* of the hopper body 32, an elastic membrane Et provided so as to form a bottom of the tubular body 2, a dispersion chamber 41 airtightly connected under the tubular body 2 via the elastic membrane Et, an air source 61 such as a blower provided for driving the powder material spray apparatus 11A, an air supply pipe Tm for supplying the air generated from the air source 61 into the hopper body 32, gas injection means 33 and 33 and the dispersion chamber 41 and a pulsating vibration air generation means 71.

The material feed valve 34 is provided at an upper tubular body 2*a* of the tubular body 2.

A conduit T1 is connected to the hopper body 32 so as to communicate with atmosphere and a switch valve v1 for opening and closing the conduit T1 and a pressure regulating valve vp1 are provided in the midstream of the conduit T1.

Further, the hopper body 32 and the air supply tube Tm are connected with a conduit T2 and a switch valve v2 and a pressure regulating valve vp2 are provided in the midstream of the conduit T2.

The member indicated by the reference numeral F1 and provided in the midstream of the conduit T2 is a filter for removing dust in the air supplied in the conduit T2. The filter F1 may be provided if necessary.

Each gas injection means 33 and 33 and the air supply pipe Tm are connected with a conduit T3.

Figure 18A:
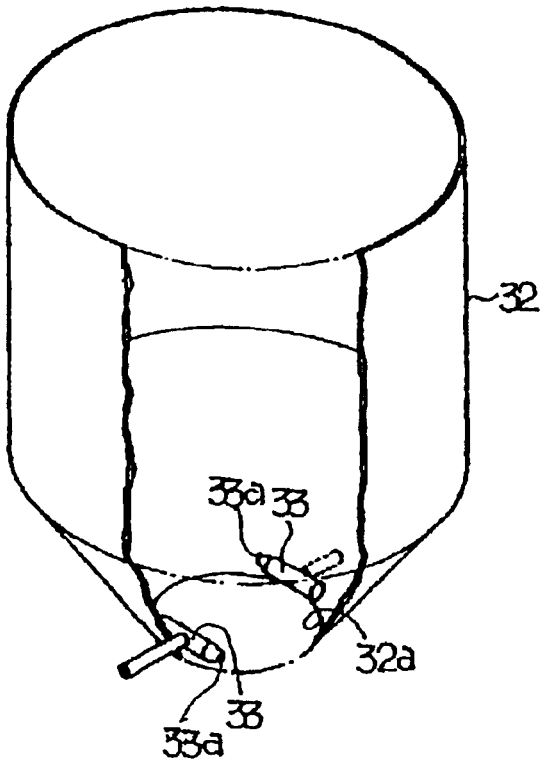
FIG. 18*a* is a partially cut section diagrammatically showing the hopper body of the quantitative discharge apparatus shown in FIG. 17
Figure 18B:
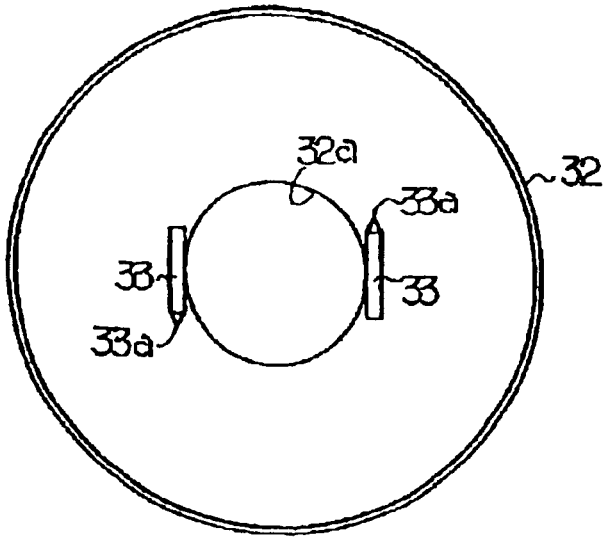
FIG. 18*b* is a plan view diagrammatically showing the hopper body of the quantitative discharge apparatus shown in FIG. 17.

The gas injection means 33 and 33 are provided in a substantially tangential direction against the inner circumference of the hopper body 32 as shown in FIG. 18.

More specifically, each gas injection means 33 and 33 is positioned at an outer circumference above the material discharge port 32*a* in a cone area 32*c* of the hopper body 32 so as to be in a substantially tangential direction against the material discharge port 32*a*.

In FIG. 18, two gas injection means 33 are provided, however, the number of the gas injection means 33 isn't limited to two. One or more than three gas injection means may be provided. Further, if more than two gas injection means 33 are provided, they are arranged in such a manner that gas is injected in the same rotational direction from each gas injection port 33*a* . . . of the gas injection means 33 . . . .

The member indicated by the reference numeral 32*c* in FIG. 17 is a cover detachably and airtightly provided for a material feed port 32*b* of the hopper body 32, if necessary.

FIG. 17 only shows how the conduit T3 is connected to one of the gas injection means 33 is shown and the other conduit T3 connected to the other gas injection means 33 is omitted. A pressure regulating valve vp3 is provided for the conduit T3.

The member indicated by the reference numeral F2 provided in the midstream of the conduit T3 is a filter for removing dust in the air supplied in the conduit T3, however, the filter F2 is only provided if necessary.

In this embodiment the material feed valve 34 has a valve plug 34*b* and an open-close drive means (actuator) 34*a* for moving the valve plug 34*b* up and down.

Open and close of the material feed valve 34 is driven by air. A conduit T4 is a pipe for supplying air into the open-close drive means (actuator) 34*a* of the material feed valve 34. The conduit T4 is branched into two pipes T34*a* and T4*b* to be connected with the open-close drive means (actuator) 34*a* of the material feed valve 34.

A switch valve v3 is provided in the midstream of the conduit T4. In this embodiment when the branch pipe T34*a* side of the control valve v3 is opened and the branch pipe T4*b* side is closed, the valve plug 34*b* of the material feed valve 34 is moved down to open the material discharge port 2*a* of the hopper body 32. When the branch pipe T4*b* side of the control valve v3 is opened and the branch pipe T34*a* side is closed, the valve plug 34*b* of the material feed valve 34 is moved up to close the material discharge port 2*a* of the hopper body 32.

The member indicated by the reference numeral F3 provided in the midstream of the branch pipe T34*a* and T4*b* is a filter for removing dust in the air supplied in the conduit T4, however, the filter F3 is only provided if necessary.

The filter F3 may be provided if necessary.

The dispersion chamber 41 has a pulsating vibration air supply port 41*a* at its lower position and has a discharge port 41*b* for discharging a positive pulsating vibration air supplied from the pulsating vibration air supply port 41*a* at its upper part.

The pulsating vibration air supply port 41*a* of the dispersion chamber 41 and the air supply pipe Tm are connected with a conduit T5.

A pressure regulating valve vp4 and a pulsating vibration air generation means 71 for generating a positive pulsating vibration air are provided for the conduit T5.

In this embodiment, when the air source 61 is driven, the pressure regulating valve vp4 is controlled appropriately and the pulsating vibration air generation means 71 is driven, a positive pulsating vibration air with a predetermined amplitude, frequency and wave shape is supplied in the dispersion chamber 41 via the conduit T5*b* and the pulsating vibration air supply port 41*a*.

The elastic membrane Et is attached between the tubular body 2 and the dispersion chamber 41 by means of the elastic membrane installation means 51.

Figure 19:
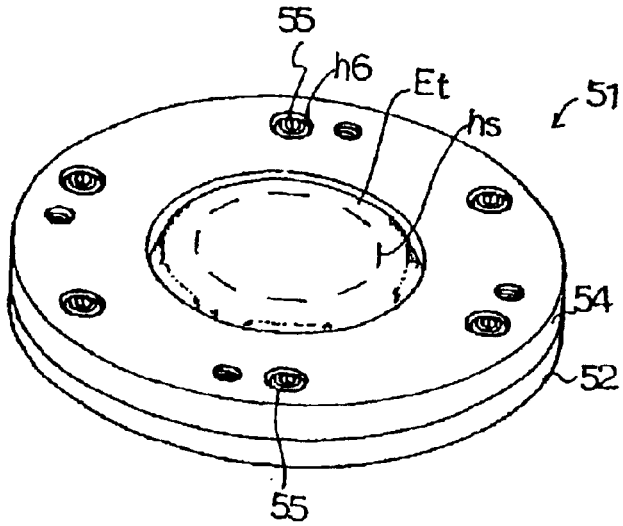
FIG. 19 is a perspective view diagrammatically showing when an elastic membrane is attached on an elastic membrane installation means used for a quantitative discharge apparatus of the present invention.
Figure 20:
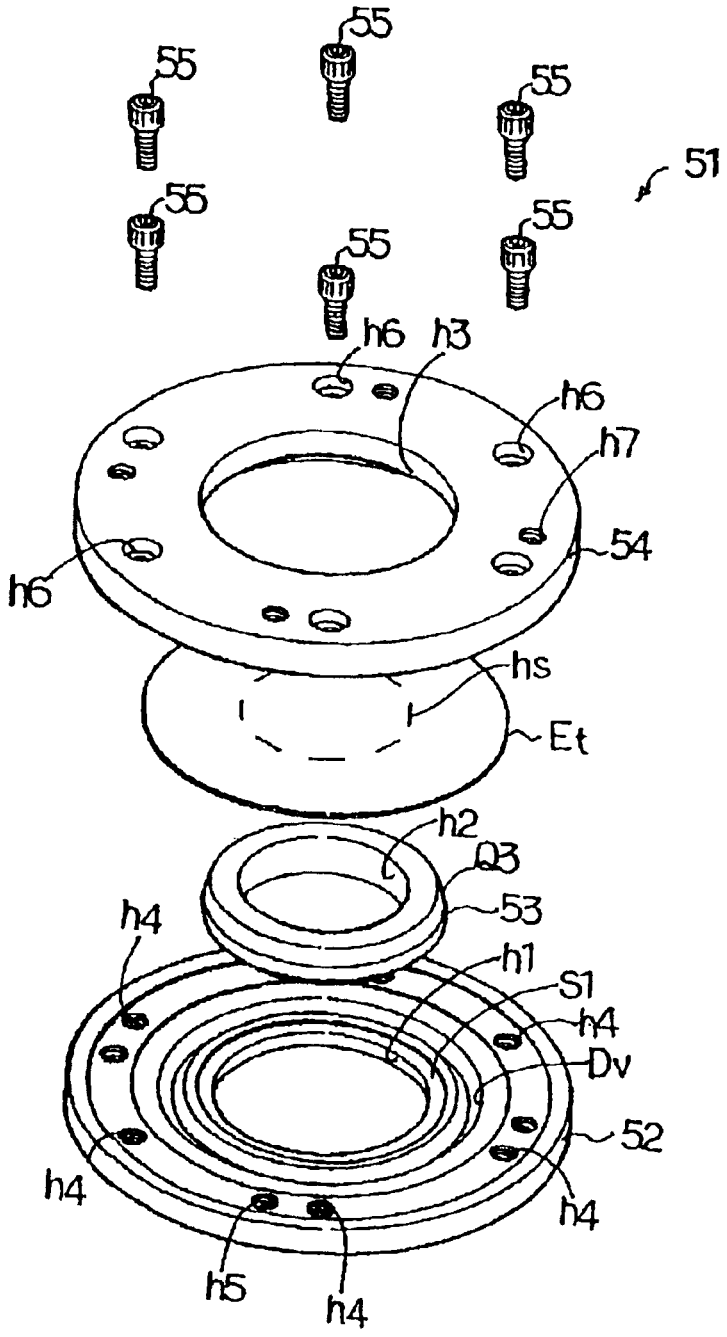
FIG. 20 is an exploded view diagrammatically showing a construction of the elastic membrane installation means shown in FIG. 19.
Figure 21:
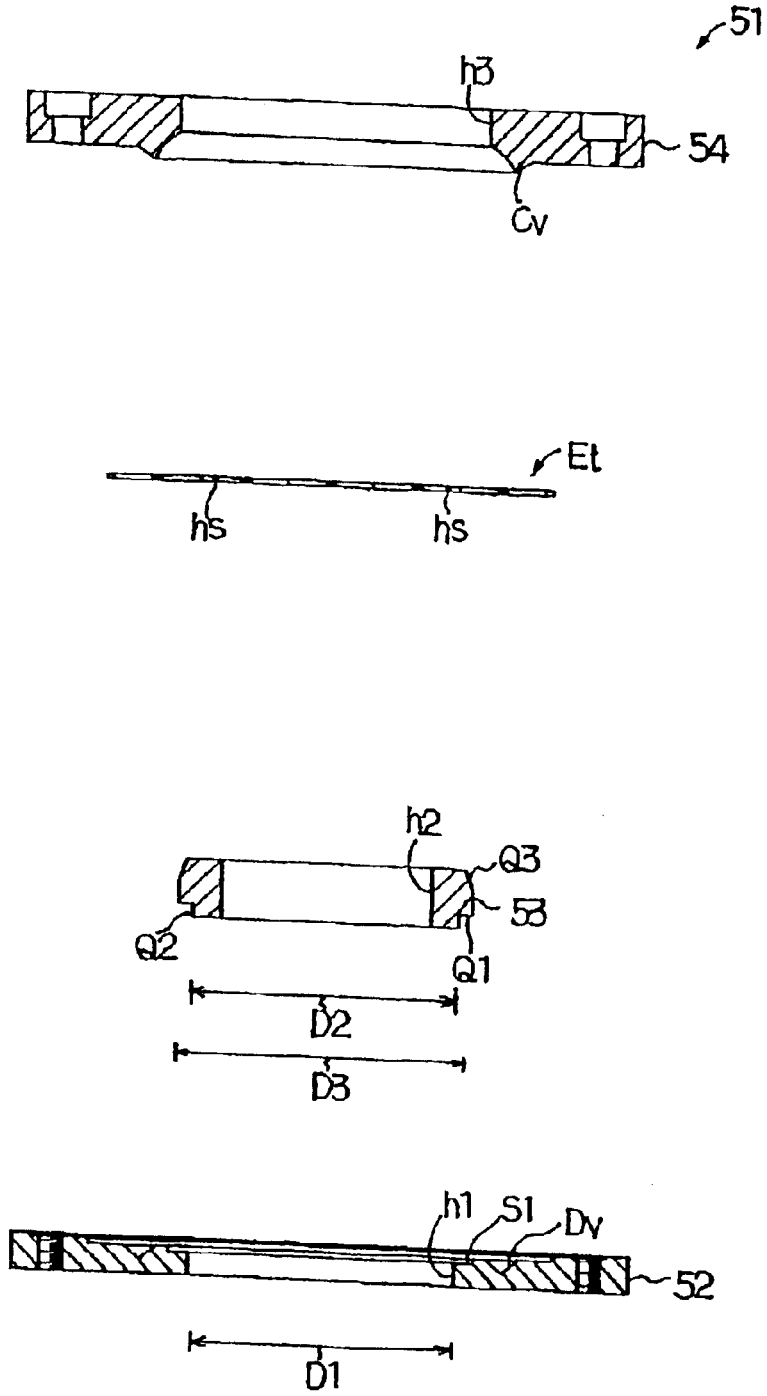
FIG. 21 is a sectional view diagrammatically showing an exploded construction of the elastic membrane installation means shown in FIG. 19.

FIG. 19 is a perspective view when the elastic membrane is attached on the elastic membrane installation means used for the quantitative discharge apparatus of the present invention. FIG. 20 is an exploded view diagrammatically showing the construction of the elastic membrane installation means shown in FIG. 19. FIG. 21 is a sectional view diagrammatically showing the construction of the expanded elastic membrane installation means shown in FIG. 19.

The elastic membrane installation means 51 has a pedestal 52, a push-up member 53 and a presser member 54.

The pedestal 52 has an opening h1 and a ring-like platform S1 for placing the push-up member 53 is provided at the periphery of the opening h1. Further, a V-groove Dv is provided for the pedestal 52 so as to surround the opening h1 like a ring.

The push-up member 53 has an opening h2. In this embodiment, the push-up member 53 has a stepped part Q1 at its lower part as shown in FIG. 21 in such a manner that the part Q1 is positioned on the platform S1 of the pedestal 52 when the push-up member 53 is placed on the pedestal 52.

When the push-up member 53 is placed on the pedestal 52 in this embodiment, a lower extended part Q2 formed so as to be extended downward from the step Q1 of the push-up member 53 is designed to be incorporated in the opening h1 of the pedestal 52. Namely, the lower extended part Q2 of the push-up member 53 is precisely processed in such a manner that its outer diameter D2 is almost the same or a little smaller than the inside diameter D1 of the opening h1 of the pedestal 52.

Furthermore in this embodiment, an inclined plane extending from top to bottom in a sectional view is provided at the periphery of an upper part Q3 of the push-up member 53.

The presser member 54 has an openeing h3. An annular V-shaped projection Cv is provided for a surface S4 of the presser member 54 facing the pedestal 52 so as to be engaged in the V-groove Dv on the surface of the pedestal 52.

The member indicated by a numeral 55 in FIG. 19 and FIG. 20 shows fastening means such as a bolt.

The hole shown as h4 in FIG. 20 is a fixing hole of the fastening means 55 formed on the pedestal 52, and the hole shown as h6 is a fixing hole of the fastening means 55 formed on the presser member 54, respectively. The hole shown as h5 in FIG. 20 is a fixing hole of the pedestal 52 for attaching the elastic membrane installation means 51 to a desired device by means of fixing means such as a bolt (not shown). The hole h7 of the presser member 54 is for attaching the elastic membrane installation means 51 to a desired device by means of fixing means such as a bolt (not shown).

In this embodiment, the inside diameter D4 of the opening h3 of the presser member 54 is precisely processed so as to be the same as or a litter larger than the external diameter D3 of the push-up member 53.

Next, installation procedures of the elastic membrane Et on the elastic membrane installation means 51 will be explained hereinafter.

The push-up member 53 is placed on the surface of the pedestal 52 at first for installing the elastic membrane Et on the elastic membrane installation means 51.

Then, the elastic membrane Et is placed on the push-up member 53.

The presser member 54 is placed on the push-up member 53 so as to cover both the push-up member 53 and the elastic membrane Et in such a manner that each fixing hole h4 . . . on the pedestal 52 is aligned with each fixing hole h6 . . . on the presser member 54.

Next, the presser member 4 is fastened to the pedestal 52 by screwing each fastening means such as a bolt 55 . . . into each fastening hole h4 . . . and each corresponding fastening hole h6 . . . .

Accordingly, the elastic membrane Et is placed on the push-up member 53 on the pedestal 52 of the elastic membrane installation means 51 and the presser member 54 is fastened to the pedestal 52 so that the elastic membrane Et is pushed upward to the presser member 54 by the push-up member 53. As a result, the elastic membrane Et is expanded from its inside to its periphery by being pushed upward into the presser member 54.

At first, the elastic membrane Et expanded by the push-up member 53 is gradually inserted between the V-groove Dv formed on the pedestal 52 and the V-shaped projection Cv formed on the surface of the presser member 54 facing the pedestal 52 via the space between the periphery P3 of the push-up member 53 and the surface (inner surface) forming the opening h3 of the presser member 54.

Furthermore, as the presser member 54 is fastened to the pedestal 52 by means of the fastening means such as a bolt 55 . . . the elastic membrane Et comes to be held between the periphery P3 of the push-up member 53 and the inner surface of the opening h3 of the presser member 54 while being pushed up into the presser member 54 by the push-up member 53. When the elastic membrane Et is further pushed up into the presser member 54 by the push-up member 53, the expanded part of the elastic membrane Et from inside to outside is held between the V-groove Dv of the pedestal 52 and the V-shaped projection Cv on the surface of the presser member 54 facing the pedestal 52.

In other words, according to the elastic membrane installation means 51, the elastic membrane Et is placed on the push-up member 53 on the pedestal 52 and the presser member 54 is fastened to the pedestal 52, then the elastic membrane Et is pushed up to the presser member 54 by the push-up member 53, thereby the elastic membrane Et is kept being stretched from its inside to outside. Furthermore, the periphery of the elastic membrane Et expanded by the push-up member 53 is held between the V-groove Dv of the pedestal 52 and the V-shaped projection Cv provided on the face of the presser member 54 opposing the pedestal 52. As a result, the elastic membrane installation means 51 can keep the elastic membrane Et stretched only by a simple operation such that the elastic membrane Et is placed on the push-up member 53 on the pedestal 52 and the presser member 54 is fastened to the pedestal 52.

In addition, the inclined plane Q3 enlarging from top to bottom in its section is provided at the periphery of the push-up member 53 of the elastic membrane installation means 51.

The inclined plane Q3 is an important element of the elastic membrane installation means 51 and is detailed hereinafter.

The inclined plane Q3 of which the bottom is broader than the top is provided for the periphery of the push-up member 53 of the elastic membrane installation means 51. Therefore, the expanded part of the elastic membrane Et from inside to outside by being pushed up into the presser member 54 is easily moved into between the V-groove Dv annularly formed on the pedestal 52 and the V-shaped projection Cv annularly formed on the surface of the presser member 54 facing the pedestal 52.

More specifically, when the external diameter of the inclined plane Q3 of the push-up member 53 is substantially smaller than the inner diameter D4 of the opening h3 of the presser member 54, there is an adequate gap (space) between the inclined plane Q3 of the push-up member 53 and the surface forming the opening h3 of the presser member 54, thereby the expanded part of the elastic membrane Et from inside to outside by the push-up member 53 being easily guided to the V-groove Dv annularly provided on the surface of the pedestal 52 by the gap.

The inclined plane Q3 of the periphery of the push-up member 53 is designed so as to be enlarged from top to bottom in a section. Therefore, the expanded part of the elastic member Et from inside to outside by the push-up member 53 is guided to the V-groove Dv annularly provided on the pedestal 52 along the surface of the inclined plane Q3.

Then the presser member 54 is fastened to the pedestal 52 by screwing each fastening means such as a bolt 55 . . . into each fixing hole h4 . . . and each corresponding fixing hole h6 . . . . Accordingly the external diameter of the inclined plane Q3 of the push-up member 53 gets closer to the inner diameter D4 of the opening h3 of the presser member 54. When the gap (space) between the inclined plane Q3 of the push-up member 53 and the surface consisting the opening h3 of the presser member 54 becomes about the thickness (wall thickness) of the elastic membrane Et, the elastic membrane Et comes to be held between the inclined plane Q3 of the push-up member 53 and the surface consisting the opening h3 of the presser member 54.

According to the above-mentioned operations, the elastic membrane Et is placed on the push-up member 53 on the pedestal 52 of the elastic membrane installation means 51, then the presser member 54 is fastened to the pedestal 52 by means of the fixing means such as a bolt 55 . . . , thereby keeping the elastic membrane Et strained by such simple operations.

When the presser member 54 is fastened to the pedestal 52 by means of the fixing means such as a bolt 55 . . . , the distance between the inclined plane Q3 of the periphery of the push-up member 53 and the inner circumference of the opening h3 of the presser member 54 becomes small, and the elastic membrane Et is tightly held between the inclined plane Q3 of the push-up member 53 and the inner circumference of the opening h3 of the presser member 54, preventing the elastic membrane Et from being slack.

Further, if the elastic membrane Et is attached by the elastic membrane installation means 51, it is doubly locked between the inclined plane Q3 of the push-up member 53 and the surface consisting the opening h3 of the presser member 54 and between the V-shaped projection Cv annularly provided on the surface of the presser member 54 facing the pedestal 52 and the V-groove Dv annularly provided on the pedestal 52. Thereby, the elastic membrane Et doesn't get slack after the presser member 54 is fastened to the pedestal 52.

According to the powder material spray apparatus 11A, the presser member 54 of the elastic membrane installation means 51 on which the elastic membrane Et is attached is airtightly installed at the lower part of the tubular body 2 and the pedestal 52 is airtightly provided on the top of the dispersion chamber 41.

The lower tube 2*b* of the tubular body 2 is made of clear resin, specifically a light permeable material such as glass, acrylate resin, polycarbonate resin, and so on.

Further, it is preferable that the lower tube 2*b* is made of polycarbonate and its inner circumferential wall is mirror finished.

It is because that if the lower tubular body 2*b* is made of polycarbonate and its inner circumferential wall is mirror finished, a powdered material is hardly adhered on the inner circumference of the lower tubular body 2*b* comparing with the case when other material is used, thereby obtaining high detection accuracy of a level sensor 62.

The level sensor 62 for detecting the amount of lubricants (powder) stored on the elastic membrane Et in a lower tubular body 2*b* is provided for the lower tubular part 2*b*. The level sensor 62 has a light emitting element 62*a* for generating light such as infrared rays and visible rays and a light receiving element 62*b* for receiving the light generated from the light emitting element 62*a*.

The light emitting element 62*a* and the light receiving element 62*b* are provided to be opposed each other so as to interpose the lower tubular part 2*b*.

The amount of lubricants (powder) stored on the elastic membrane Et in the lower tube 2*b* can be detected at a position Hth (at height where the level sensor 62 is provided above the elastic membrane Et).

Namely, when the amount of lubricants (powder) stored on the elastic membrane Et in the lower tube 2*b* exceeds the position Hth (height where the level sensor 62 is provided above the elastic membrane Et), the light radiated from the light emitting element 62*a* is blocked off by the lubricants (powder) and isn't received by the light receiving element 62*b* (off). Then it can be detected that the height H of the lubricant stored on the elastic membrane Et in the lower tube 2*b* exceeds the height Hth (H>Hth).

On the other hand, when the amount of lubricants (powder) stored on the elastic membrane Et in the lower tube 2*b* becomes lower than the position Hth (height where the level sensor 62 is provided above the elastic membrane Et), the light emitted from the light emitting element 62*a* can be received by the light receiving element 62*b* (on). Then it can be detected that the height H of the lubricants (powder) stored on the elastic membrane Et in the lower tube 2*b* is under the height Hth (H<Hth).

In this embodiment the material feed valve 34 moves up and down depending on the detected values of the level sensor 62 so as to open and close the discharge port 2*a* of the material storage hopper 2. More specifically according to the powder material spray apparatus 11A, the light emitting element 62*a* of the level sensor 62 is turned on while the spray appratus 11A is driven. When the light from the light emitting element 62*a* doesn't come to be received in the light receiving element 62*b* (off), the material feed valve 34 is moved up to close the discharge port 2*a* of the material storage hopper 2. When the light from the light emitting element 62*a* is received by the light receiving element 62*b* (on), the material feed valve 34 is moved down to open the discharge port 2*a* of the hopper 2 until the light isn't received by the light receiving element 62*b* (off), thereby approximately the same quantity of lubricants (powder) is always stored on the elastic membrane Et in the lower tube 2*b* while the powder material spray apparatus 11A is driven.

The inner shape of the dispersion chamber 41 is designed to be approximately tubular so as to make a positive pulsating vibration air swirl therein. In this embodiment, such a dispersion chamber 41 of which inner shape is tubular is used, however, its shape isn't limited as long as a positive pulsating vibration air easily swirls therein. Therefore, the inner shape isn't limited to be approximately tubular.

The pulsating vibration air supply port 41*a* is provided at a lower part of the dispersion chamber 41 in approximately a tangential direction of the inside perimeter of the chamber 41. The discharge port 41*b* is provided at an upper part of the dispersion chamber 41 in approximately a tangential direction of the inside perimeter of the chamber 41. A conduit T5 is connected to the pulsating vibration air supply port 41*a* and a conduit (for example see the conduit T6 in FIG. 26) is connected to the pulsating vibration air discharge port 41*b*.

Here the position of the pulsating vibration air supply port 41*a* provided for the dispersion chamber 41 is detailed referring to FIG. 22.

Figure 22A:
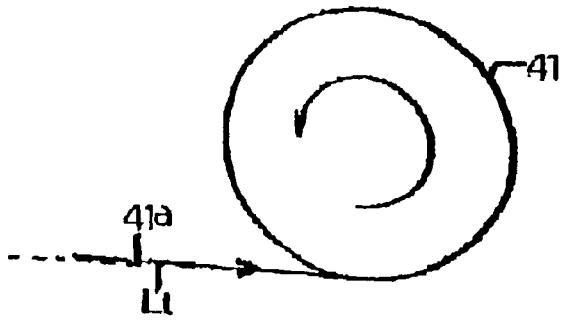
FIG. 22*a* is an explanatory view showing a preferable position of the pulsating vibration air supply port for the dispersion chamber and FIG. 22*b* is an explanatory view showing an actual attachable position of the pulsating vibration air supply port for the dispersion chamber.
Figure 22B:
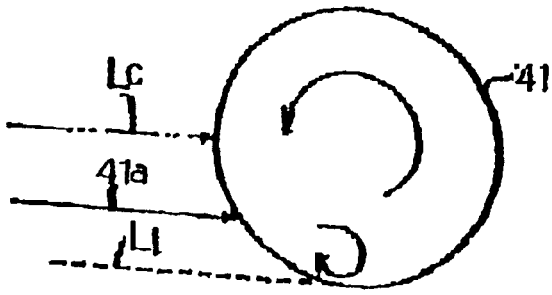

FIG. 22 is a plan view diagrammatically showing a position of the pulsating vibration air supply port 41*a* provided for the dispersion chamber 41 when the chamber 41 is seen from top, FIG. 22*a* is an explanatory view showing a preferable position for providing the pulsating vibration air supply port 41*a* against the dispersion chamber 41 and FIG. 22*b* is an explanatory view showing an actual attachable position for providing the pulsating vibration air supply port 41*a* against the dispersion chamber 41.

The curved arrows in FIG. 22*a* and FIG. 22*b* diagrammatically show the directions of the swirling positive pulsating vibration air generated in the dispersion chamber 41.

The pulsating vibration air supply port 41*a* is preferably provided in a substantially tangential direction (a direction shown with a dashed line Lt in FIG. 22*a*) against the inside perimeter of the dispersion chamber 41 in order to generate a swirling positive pulsating vibration air in the dispersion chamber 41.

However, the supply port 41*a* isn't always provided in a tangential direction against the inside perimeter of the chamber 41 as shown in FIG. 22*a*. It may be provided in an equivalent direction (namely, in a direction parallel to the tangential direction (a direction shown with a dashed line Lt in FIG. 22*b*) of the inner circumference of the dispersion chamber 41, shown with a dashed line Lt in FIG. 22*b*) to the tangential direction (a direction shown with a dashed line Lt in FIG. 22*b*) as far as one dominant swirling flow is generated in the dispersion chamber 41.

If the pulsating vibration air supply port 41*a* is provided in a direction into a center line of the dispersion chamber 41 as shown with an imaginary line Lc in FIG. 22*b*, two swirls, both of which don't seem a dominant flow, are generated when the inner shape of the dispersion chamber 41 is approximately cylindrical. Therefore, it isn't preferable to provide the supply port 41*a* in such a position considering generation of the swirling positive pulsating vibration air in the dispersion chamber 41.

Next, the positional relation of the pulsating vibration air supply port 41*a* and the discharge port 41*b* in the dispersion chamber 41 is detailed referring to FIG. 23.

Figure 23A:
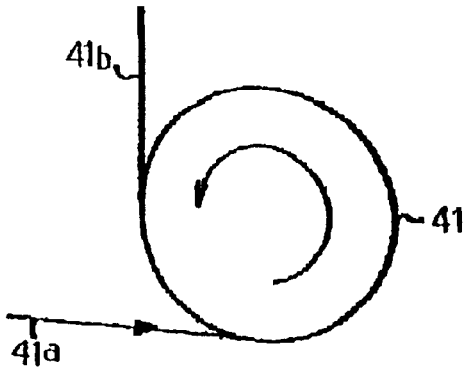
FIG. 23*a* is an explanatory view showing a preferable position of the pulsating vibration air supply port and its discharge port for the dispersion chamber and FIG. 23*b* is an explanatory view showing an actual attachable position of the pulsating vibration air supply port and its discharge port for the dispersion chamber.
Figure 23B:
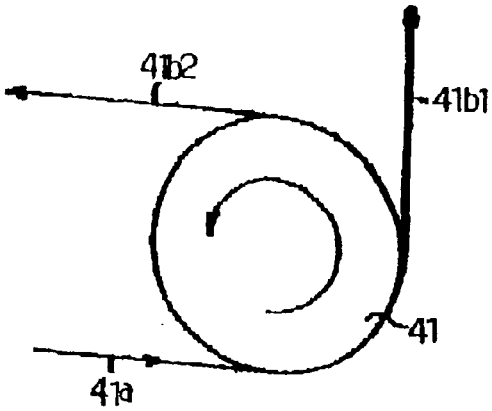

FIG. 23 is a plan view diagrammatically showing a position of the pulsating vibration air supply port 41*a* and its discharge port 41*b* provided for a dispersion chamber 41 when the chamber 41 is seen from top, FIG. 23*a* is an explanatory view showing a preferable position for providing the pulsating vibration air supply port 41*a* and its discharge port 41*b* against the dispersion chamber 41 and FIG. 23*b* is an explanatory view showing an actual attachable position for providing the pulsating vibration air supply port 41*a* and its discharge port 41*b* against the dispersion chamber 41.

The curved arrows in FIG. 23*a* and FIG. 23*b* diagrammatically show directions of the swirling positive pulsating vibration air generated in the dispersion chamber 41.

When the discharge port 41*b* is provided for the dispersion chamber 41 as shown in FIG. 23*a*, the position of the port 41*b* becomes opposite to the direction of the swirling pulsating vibration air (movement of the air flow) generated in the chamber 41. In such a case, the discharge efficiency of the lubricants (powder) fluidized by being dispersed in air from the discharge port 41*b* can be set low.

Contrary, if the discharge efficiency of the fluidized lubricant from the discharge port 41*b* is to be heightened, the port 41*b* is preferably provided in a forward direction of the swirling positive pulsating vibration air generated in the dispersion chamber 41 like the discharge port 41*b*1 or 41*b*2 illustrated in FIG. 23*b*.

The powder material spray apparatus 11A has a bypass pipe Tv between the dispersion chamber 41 and the tubular body 2 as shown in FIG. 17. The bypass pipe Tv is provided in order to quickly achieve the balance between the pressures in the dispersion chamber 41 and the tubular body 2.

Next, operations of the elastic membrane Et and the bypass pipe Tv when a positive pulsating vibration air is supplied in the dispersion chamber will be explained.

FIG. 24 is an explanatory view diagrammatically showing operations of the elastic membrane Et and the bypass pipe Tv when a positive pulsating vibration air is supplied in the dispersion chamber 41.

When the pulsating vibration air generation means 71 is driven, a positive pulsating vibration air with a desired flow amount, pressure, wavelength, wave shape is supplied in the conduit T5.

The positive pulsating vibration air supplied in the conduit T5 is supplied from a pulsating vibration air supply port 41*a* to the dispersion chamber 41 and becomes a positive pulsating vibration air swirling upwardly like a convolution such as a tornado therein, then is discharged from the discharge port 41*b*.

The swirling positive pulsating vibration air generated in the dispersion chamber 41 doesn't lose its nature as a pulsating vibration air so that the elastic membrane Et vibrates according to the frequency, amplitude, and wave shape of the positive pulsating vibration air.

Figure 24A:
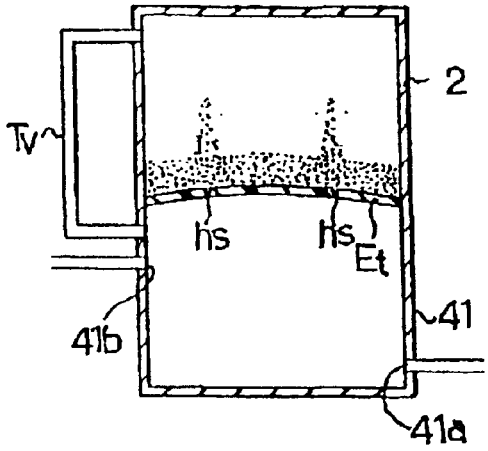
FIG. 24 is an explanatory view showing operations of an elastic membrane and a bypass pipe when a positive pulsating vibration air is supplied in a dispersion chamber of a quantitative discharge apparatus of the present invention.

At a peak of the positive pulsating vibration air supplied to the dispersion chamber 41 and when the pressure Pr41 in the dispersion chamber 41 becomes higher than the pressure Pr21 in the tubular body 2 (pressure Pr41>pressure Pr21), the elastic membrane Et is elastically deformed such that the point (for example a dimensional center or a center of gravity) is curved upwardly as shown in FIG. 24*a*.

Each penetrating apertures hs and hs becomes V-shaped with its upper end opened in a sectional view and a part of the lubricant powders stored on the elastic membrane Et in the tubular body 2 falls in the V-shaped apertures hs and hs.

An air communication passage between the tubular body 2 and the dispersion chamber 41 is formed with two systems in this powder material spray apparatus 11A: the penetrating apertures hs and hs of the elastic membrane Et and the bypass pipe Tv. Therefore, air can pass between the tubular body 2 and the dispersion chamber 43 via an available system.

When the air flows from the dispersion chamber 41 to the tubular body 2 via the penetrating apertures hs and hs of the elastic membrane Et as shown in FIG. 24*a*, air flow from the tubular body 2 to the dispersion chamber 41 is generated in the bypass pipe Tv. Accordingly the air can smoothly flow from the dispersion chamber 41 to the tubular body 2 via the apertures hs and hs of the elastic membrane Et.

Then as the positive pulsating vibration air supplied in the dispersion chamber 41 moves to its valley, the elastic membrane Et returns to its original position from an upwardly curved position in which a specific point (dimensional center or a gravity center of the elastic membrane Et) is curved downward 1 by its resilience. At the same time the penetrating aperture Eta returns to its original shape from the V shape with its top end open and the lubricant powders dropped in the opened apertures hs and hs are kept therein (see FIG. 24*b*).

As the air communication passage between the tubular body 2 and the dispersion chamber 41 of the apparatus 1 is comprised of two lines: the penetrating apertures hs and hs of the elastic membrane Et and the bypass pipe Tv, air can flow therebetween via an available one.

Figure 24B:
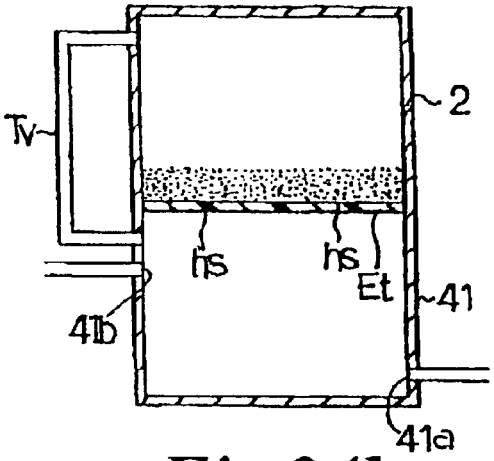

In other words, in case of the condition as shown in FIG. 24*b*, even if the penetrating aperture Eta is closed, the air can flow from the tubular body 2 to the dispersion chamber 41 via the bypass pipe Tv, therefore, the pressures in the chamber 41 and in the tubular body 2 are quickly balanced.

Then when the positive pulsating vibration air supplied in the dispersion chamber 41 becomes its amplitude valley and the pressure in the dispersion chamber 41 is reduced, the elastic membrane Et is elastically deformed with a specific point (dimensional center or the center of gravity of the elastic membrane Et) curved downwardly. Each one of the penetrating aperture hs and hs becomes reverse V-shaped with its lower end opened in its section. Then the powders kept in the apertures hs and hs fall in the dispersion chamber 41 (see FIG. 24*c*).

When the powders kept in the apertures hs and hs fall in the dispersion chamber 41, as the air communication passage between the tubular body 2 and the dispersion chamber 41 of the apparatus 1 is comprised of two lines: the penetrating apertures hs and hs of the elastic membrane Et and the bypass pipe Tv, the air can flow therebetween via an available one.

In other words, the elastic membrane Et is curved such that a specific point (dimensional center or the center of gravity of the elastic membrane Et) goes downwardly and the volume of the tubular body 2 becomes larger, air flows from the dispersion chamber 41 to the tubular body 2 via the bypass pipe Tv. Therefore, air flow from the dispersion chamber 41 to the tubular body 2 via the penetrating apertures hs and hs isn't caused. Accordingly, the powder material can be discharged through the aperture hs and hs safely and quantitatively.

As the result of providing the bypass pipe Tv between the dispersion chamber 41 and the tubular body 2, the pressure in the tubular body 2 and the pressure in the dispersion chamber 41 are instantly balanced when the positive pulsating vibration air is supplied to the dispersion chamber 41 of the apparatus 11A so that the elastic membrane Et vibrates up and down with the same amplitude being its original expanding position as a neutral position according to the vibration of the positive pulsating vibration air.

Namely, according to this apparatus A, the elastic membrane Et can vibrate up and down at high reproducibility and responsibility against the positive pulsating vibration air because of the bypass pipe Tv. As a result, material discharge via the penetrating apertures hs and as can be well done.

Further, when a conduit (for example, see the conduit T6 in FIG. 26) is connected to the discharge port 41*b* of the dispersion chamber 41, the powder material spray apparatus 11A can be preferably used as a powder material spray apparatus for quantitatively spraying powder material together with air.

Namely when the conduit T6 is connected to the discharge port 41*b* of the dispersion chamber 41, the lubricant (powder) dropped in the dispersion chamber 41 is mixed with and dispersed in the positive pulsating vibration air swirling in the dispersion chamber 41 to be fluidized and is discharged to the conduit T6 from the discharge port 41*b* together with the positive pulsating vibration air.

According to the powder material spray apparatus 11A, the up and down vibrations wherein a specific point (dimensional center or the center of gravity of the elastic membrane Et) is operated as its antinode of the vibration and the periphery is operated as its node only depend on the frequency, amplitude and wave shape of the positive pulsating vibration air supplied to the dispersion chamber 41. Therefore, as far as the positive pulsating vibration air supplied to the dispersion chamber 41 is constant, a fixed amount of lubricant powder is always accurately discharged to the dispersion chamber 41 via the penetrating apertures hs . . . of the elastic membrane Et. This powder material spray apparatus 11A is superior as a powder material spray apparatus for supplying a fixed amount of powder material to a desired place (apparatus and so on).

The powder material spray apparatus 11A also has an advantage that if the frequency, amplitude and wave shape of the positive pulsating vibration air supplied to the dispersion chamber 41 are controlled, the amount of powder supplied to a desired place (instrument) can be easily changed.

Furthermore according to the powder material spray apparatus 11A, the positive pulsating vibration air becomes a swirl directing upward in the dispersion chamber 41. Even if the aggregated particles with a large diameter are contained in the powder material discharged to the dispersion chamber 41, most of all can be pulverized and dispersed to be small particles by being caught in the positive pulsating vibration air swirling in the dispersion chamber 41.

In addition, the positive pulsating vibration air in the dispersion chamber 41 becomes an upward swirling flow so that the dispersion chamber 41 has a size classification function like a cyclone. Therefore, the powder material with a predetermined particle size can be discharged to the conduit from the discharge port 41*b*.

Namely, the aggregated particles with a large diameter keep swirling in the lower part of the dispersion chamber 41 and are pulverized into a predetermined particle size by being caught in the positive pulsating vibration air swirling in the chamber 41. Thereby, the aggregated material is controlled to be a predetermined particle size while being dispersed and is discharged to the conduit from the discharge port 41*b*.

The powder material supplied to the conduit connected to the discharge port 41*b* is pneumatically transported to the other end of the conduit by supplying the positive pulsating vibration air.

Thereby, according to the powder material spray apparatus 11A, a deposit phenomenon and a pinhole phenomenon aren't caused in the conduit, which have been seen in transportation means wherein the powder material supplied to the conduit is pneumatically transported by a steady pressure air with constant flow.

Therefore, according to the powder material spray apparatus 11A, the powder material can be discharged from the other end of the conduit while keeping the concentration of the original powder discharged in the conduit from the discharge port 41*b* of the dispersion chamber 41, thereby enabling an accurate control of the quantitativeness of the powders sprayed from the other end of the conduit.

Furthermore, according to the powder material spray apparatus 11A, substantially a fixed amount of powder material is placed on the elastic membrane Et (at the height Hth where the level sensor 62 is provided above the membrane Et) while operating the powder material spray apparatus 11A. The amount of powder material discharged from the penetrating aperture Eta of the elastic membrane Et doesn't vary depending on the change in the amount of powder material placed on the elastic membrane Et. Accordingly, a fixed amount of powder material can be stably supplied to a desired place (apparatus and so on).

Still further according to the powder material spray apparatus 11A, even if large size powders are discharged to the dispersion chamber 41, such powders are pulverized into a predetermined particle size by being caught in the positive pulsating vibration air swirling in the chamber 41 to be discharged to the conduit from the discharge port 41*b*, so that the large size powders aren't deposited in the dispersion chamber 41.

Therefore, if the powder material spray apparatus 11A is operated for a long time, the powder material doesn't deposit in the dispersion chamber 41 so that the number of cleaning in the dispersion chamber 41 can be reduced.

When such a powder material spray apparatus 11A is attached to an external lubrication type tabletting machine A, cleaning in the dispersion chamber 41 isn't almost required while executing a continuous tabletting. Therefore, there is an effect that an externally lubricated tablet (tablet without including lubricant powders) can be effectively produced using such a tabletting machine A.

In addition, according to this powder material spray apparatus 11A, the elastic membrane Et is stretched by means of the elastic membrane installation means 51 as shown in FIG. 19, FIG. 20 and FIG. 21. The quantitativeness of the powder material spray apparatus 11A isn't damaged because of a loosed elastic membrane Et.

Further, the pressure Pr21 in the tubular body 2 and the pressure Pr41 in the dispersion chamber 41 are rapidly balanced by providing the bypass pipe Tv between the tubular body 2 and the dispersion chamber 41, thereby improving response of the elastic membrane Et corresponding to the vibration of positive pulsating vibration air. Thus the discharge of powder material through the penetrating aperture Eta of the elastic membrane Et can be stably and quantitatively performed. Therefore, the quantitativeness of powder material discharged in the dispersion chamber against the positive pulsating vibration air becomes superior.

The powder material fed in the discharge port 41*b* of the dispersion chamber 41 while being mixed with and dispersed in the positive pulsating vibration air is pneumatically transported by the positive pulsating vibration air and is quantitatively sprayed from the other end of the conduit connected to the discharge port 41*b* of the dispersion chamber 41 together with air.

Discharge of lubricant (powder) in the dispersion chamber 41 via the penetrating apertures hs . . . of the elastic membrane Et, as mentioned above, is repeated while the positive pulsating vibration air is supplied in the dispersion chamber 41 of the powder material spray apparatus 11A.

Furthermore, the emitting element 62*a* of the level sensor 62 is lighted while the powder material spray apparatus 11A is operated. When the light receiving element 62*b* comes to receive the light emitted from the light emitting element 62*a*, the material feed valve 34 goes down to open the discharge port 2*a* of the material storage hopper 2. Then, when the light receiving element 62*b* comes not to receive the light emitted from the light emitting element 62*a*, the material feed valve 35 goes up to close the discharge port 2*a* of the material storage hopper 2. Because of such operations, substantially a fixed amount (at height where the level sensor 52 is provided, namely height Hth of the level sensor 62 above the elastic membrane Et) of lubricant (powder) constantly exists on the elastic membrane Et.

According to the powder material spray apparatus 11A, the up and down vibrations wherein a specific point (dimensional center or the center of gravity of the elastic membrane Et) is operated as its antinode of the vibration and the periphery is operated as its node only depend on the frequency, amplitude and wave shape of the positive pulsating vibration air supplied to the dispersion chamber 41. Therefore, as far as the positive pulsating vibration air supplied to the dispersion chamber 41 is constant, a fixed amount of lubricant powder is always accurately discharged to the dispersion chamber 41 via the penetrating apertures Eta of the elastic membrane Et. This powder material spray apparatus 11A is superior as a powder material spray apparatus for supplying a fixed amount of powder material to a desired place (apparatus and so on).

The powder material spray apparatus 11A also has an advantage that if the frequency, amplitude and wave shape of the positive pulsating vibration air supplied to the dispersion chamber 41 are controlled, the amount of powder supplied to a desired place (instrument) can be easily changed.

Furthermore according to the powder material spray apparatus 11A, the positive pulsating vibration air becomes a swirl directing upward in the dispersion chamber 41. Even if the aggregated particles with a large diameter are contained in the powder material discharged to the dispersion chamber 41, most of all can be pulverized and dispersed to be small particles by being caught in the positive pulsating vibration air swirling in the dispersion chamber 41.

In addition, the positive pulsating vibration air in the dispersion chamber 41 becomes an upward swirling flow so that the dispersion chamber 41 has a size classification function like a cyclone. Therefore, the powder material with a predetermined particle size can be discharged to the conduit from the discharge port 41*b*. On the other hand, the particles with a large diameter keep swirling in the lower part of the dispersion chamber 41 and are pulverized into a predetermined particle size by being caught in the positive pulsating vibration air swirling in the chamber 41.

Therefore, according to the powder material spray apparatus 11A, a fixed amount of powder material having uniform size can be advantageously supplied into a desired place (apparatus and so on).

The powder material supplied into the conduit connected to the discharge port 41*b* of the dispersion chamber 41 is pneumatically transported to the other end of the conduit by supplying the positive pulsating vibration air.

Thereby, according to the powder material spray apparatus 11A, a deposit phenomenon and a pinhole phenomenon aren't caused in the conduit, which have been seen in transportation means wherein the powder material supplied to the conduit is pneumatically transported by a steady pressure air with constant flow.

Therefore, according to the powder material spray apparatus 11A, the powder material can be discharged from the other end of the conduit while keeping the concentration of the original powder originally discharged in the conduit from the discharge port 41*b* of the dispersion chamber 41, thereby enabling an accurate control of the quantitativeness of the powders sprayed from the other end of the conduit.

Furthermore, according to the powder material spray apparatus 11A, substantially a fixed amount of powder material is placed on the elastic membrane Et (at the height Hth where the level sensor 62 is provided above the membrane Et) while operating the powder material spray apparatus 11A. The amount of powder material discharged from the penetrating aperture hs . . . of the elastic membrane Et doesn't vary depending on the change in the amount of powder material placed on the elastic membrane Et.

Accordingly, a fixed amount of powder material can be stably supplied to a desired place (apparatus and so on).

Still further according to the powder material spray apparatus 11A, even if the large size powders are discharged to the dispersion chamber 41, such powders are pulverized into a predetermined particle size by being caught in the positive pulsating vibration air swirling in the chamber 41 to be discharged to the conduit from the discharge port 41*b*, so that the large size powders aren't deposited in the dispersion chamber 41.

Therefore, if the powder material spray apparatus 11A is operated for a long time, the powder material doesn't deposit in the dispersion chamber 41 so that the number of cleaning in the dispersion chamber 41 can be reduced.

Next, operations of the material feed valve 34 of the material spray apparatus 11A will be detailed.

Figure 25:
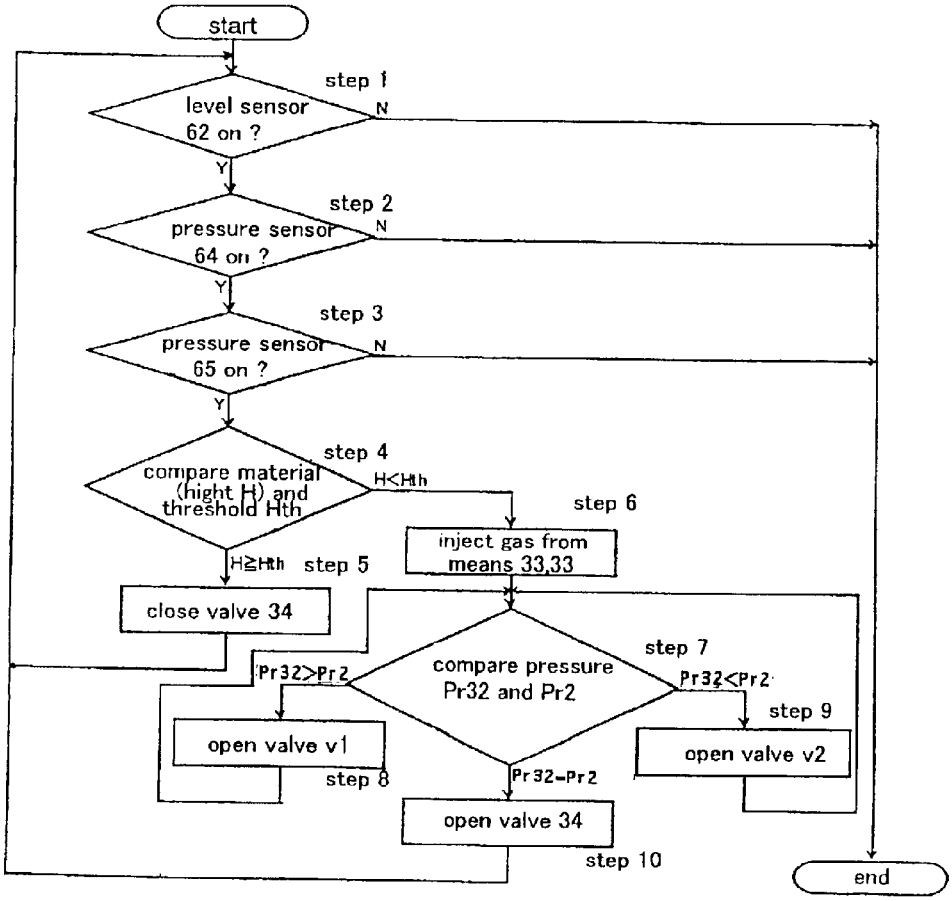
FIG. 25 is a flow chart diagrammatically showing operations of a powder material spray apparatus using a quantitative discharge apparatus of the present invention.

FIG. 25 is a flow chart diagrammatically showing operations of the powder material spray apparatus 11A.

The powder material spray apparatus 11A has a pressure sensor 64 for measuring the pressure in a hopper body 32 and has a pressure sensor 65 for measuring the pressure in the tubular body 2 as shown in FIG. 17.

An embodiment wherein operation control of the powder material spray apparatus 11A is executed by means of a processing unit (not shown) is explained.

The open and close operations of the material feed valve 34 are executed as follows in the powder material spray apparatus 11A.

At an initial condition, the material feed valve 34 of the powder material spray apparatus 11A closes the material discharge port 2*a* of the hopper body 32.

An operator stores powder material in the hopper body 32, attaches a cover 2*c* on the material feed port 2*b* and controls the pressure regulating valves vp1, vp2, vp3 and vp4 appropriately.

Next, an air source 111 is driven.

At an initial condition, the switch valves v1, v2, and v3 are closed.

The level sensor 62 is actuated (see step 1) and each pressure sensor 64 and 65 is also actuated (see steps 2 and 3).

The light emitted from the light emitting element 62*a* of the level sensor 62 is received in the light receiving element 62*b*. The signal indicating the light receiving element 62*b* has received the light emitted from the light emitting element 62*a* is sent to the processing unit (not shown).

When the processing unit (not shown) receives the signal indicating the light receiving element 62*b* has received the light emitted from the light emitting element 62*a*, the processing unit decides that the height H of the powder material on the elastic membrane Et in the tubular body 2 is under a threshold (see step 4).

In this case the processing unit (not shown) opens the pressure regulating valve vp3 at a step 6 for a predetermined time. Thereby, gas is injected from the gas injection means 33 and 33 for a predetermined time so as to destroy the caked part generated in the powder material stored in the hopper body 32.

The pressure (Pr32) in the hopper body 32 measured by the pressure sensor 64 and the pressure (Pr2) in the tubular body 2 measured by the pressure sensor 65 are sent to the processing unit (not shown).

When the processing unit (not shown) receives a signal indicating gas has injected for a fixed time from the gas injection means 33 and 33 (signal showing the pressure regulating valve vp3 is opened for a fixed time and closed thereafter), the pressure (Pr32) in the hopper body 32 and the pressure (Pr2) in the tubular body 2 after gas is injected for a fixed time are compared (see step 7).

When the processing unit (not shown) detects that the pressure (Pr32) in the hopper body 32 is the same as the pressure (Pr2) in the tubular body 2 (pressure Pr32=pressure Pr2) in the step 7, the unit (not shown) keeps the material feed valve 34 opened. Namely, in this embodiment, the processing unit (not shown) keeps the branch pipe T34*a* side of the switch valve v3 opened, and the branch pipe T4*b* side closed.

Then, the processing unit (not shown) receives the signal indicating that the light receiving element 62*b* doesn't receive the light emitted from the light emitting element 62*a* of the level sensor 62, the material feed valve 34 is closed. Namely in this embodiment, the processing unit (not shown) closes the branch pipe T34*a* side of the switch valve v3 and opens the branch pipe T4*b* side (see step 10).

The processing unit (not shown) detects that the pressure (Pr32) in the hopper body 32 is higher than the pressure (Pr2) in the tubular body 2 (Pr32>Pr2) in the step 7, the processing unit keeps the switch valve v1 opened until the pressure (Pr2) in the hopper body 32 becomes equal to the pressure (Pr2) in the tubular body 2. When the pressure (Pr32) in the hopper body 32 becomes substantially equal to the pressure (Pr2) in the tubular body 2, the switch valve v1 is closed again (see step 7 and step 8). Thereafter, the processing unit (not shown) detects that the pressure (Pr32) in the hopper body 32 is the same as the pressure (Pr2) in the tubular body 2 (Pr32=Pr2) in the step 7, the processing unit keeps the material feed valve 34 opened. Namely, in this embodiment, the processing unit (not shown) keeps the branch pipe T34*a* side of the switch valve v3 opened, and the branch pipe T4*b* side closed (see step 10).

Then, the processing unit (not shown) receives the signal indicating that the light receiving element 62*b* doesn't receive the light emitted from the light emitting element 62*a* of the level sensor 62, the material feed valve 34 is closed. Namely in this embodiment, the processing unit (not shown) closes the branch pipe T34*a* side of the switch valve v3 and opens the branch pipe T4*b* side (see step 5).

The processing unit (not shown) detects that the pressure (Pr32) in the hopper body 32 is lower than the pressure (Pr2) in the tubular body 2 (Pr32<Pr2) in the step 7, the processing unit keeps the switch valve v2 opened until the pressure (Pr32) in the hopper body 32 becomes equal to the pressure (Pr2) in the tubular body 2. When the pressure (Pr32) in the hopper body 32 becomes substantially equal to the pressure (Pr2) in the tubular body 2, the switch valve v2 is closed again (see step 7 and step 8). Thereafter, the processing unit (not shown) detects that the pressure (Pr32) in the hopper body 32 is the same as the pressure (Pr2) in the tubular body 2 (Pr32=Pr2) in the step 7, the processing unit keeps the material feed valve 34 opened. Namely, in this embodiment, the processing unit (not shown) keeps the branch pipe T34*a* side of the switch valve v3 opened, and the branch pipe T4*b* side closed. Thereafter, the processing unit (not shown) receives the signal indicating that the light receiving element 62*b* doesn't receive the light emitted from the light emitting element 62*a* of the level sensor 62, the material feed valve 34 is closed. Namely in this embodiment, the processing unit (not shown) closes the branch pipe T34*a* side of the switch valve v3 and opens the branch pipe T4*b* side (see step 5).

Thus a fixed amount of powder material is stored on the elastic membrane Et in the tubular body 2, the pulsating vibration air generation means 71 is driven.

Then, a swirling positive pulsating vibration air is generated in the dispersion chamber, the elastic membrane Et repeats vibration up and down as shown in FIG. 24, and powder material on the elastic membrane Et is discharged into the dispersion chamber 41 through the penetrating aperture Eta formed on the elastic membrane Et. The powder material thus discharged in the dispersion chamber 41 is mixed with the positive pulsating vibration air swirling in the dispersion chamber 41 to be dispersed and discharged to the conduit T6 from the discharge port 41*b* of the dispersion chamber 41 together with the positive pulsating vibration air.

When the powder material on the elastic membrane Et is discharged in the dispersion chamber 41, the processing unit (not shown) again receives a signal from the light receiving element 62*b* indicating the light emitted from the light emitting element 62*a* is received, then the above-mentioned steps 4–10 are repeated again.

Such steps are repeated until the air source 61 and the pulsating vibration air generation means 71 are stopped and the level sensor 62, the pressure sensor 64 or the pressure sensor 65 is tuned off.

According to this powder material spray means 11A, the material feed valve 34 is opened or closed after the pressure (Pr32) in the hopper body 32 and the pressure (Pr2) in the tubular body 2 are balanced, thereby achieving an effect that powder material can be supplied in the tubular body 2 from the material discharge port 2*a* of the hopper body 32 more stably.

Next, a concrete example using this powder material spray apparatus 11A is exemplified.

Figure 26:
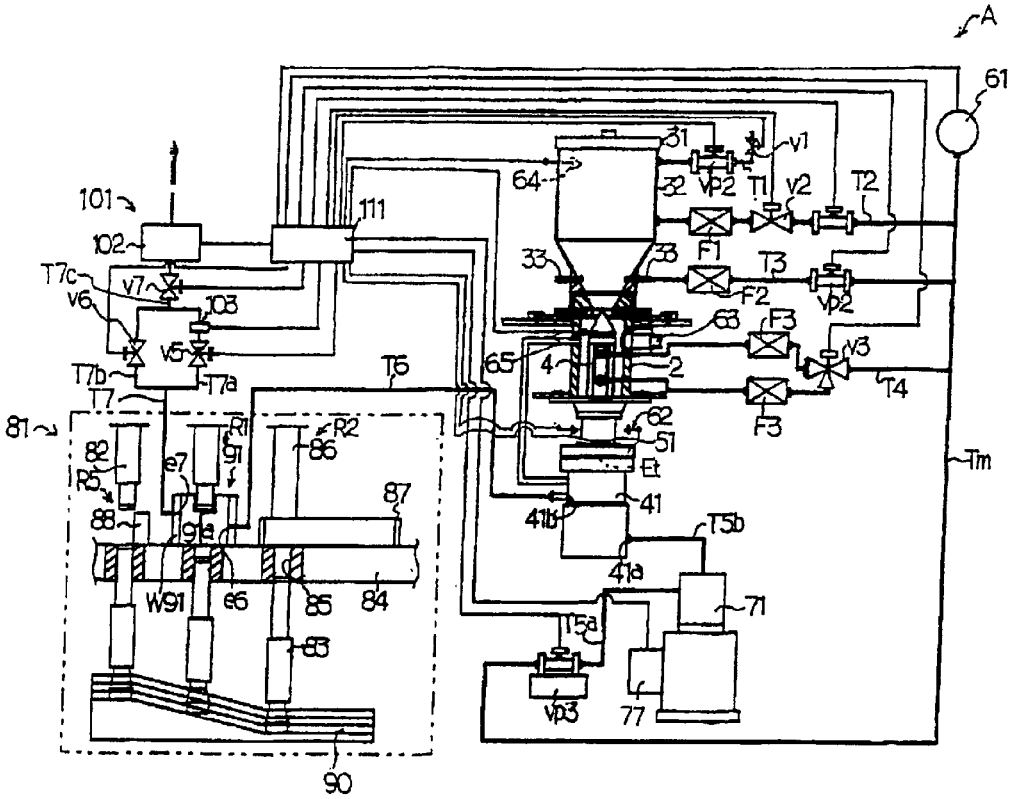
FIG. 26 shows a diagrammatic construction of a specific embodiment using a quantitative discharge apparatus of the present invention.

FIG. 26 is a constructional view diagrammatically showing the concrete example of the apparatus using the powder material spray apparatus 11A, specifically an external lubrication type tabletting machine using the powder material spray apparatus 11A.

In this embodiment, the conduit T6 is connected to the discharge port 41*b* of the dispersion chamber 41 of the powder material spray apparatus 11A.

The external lubrication type tabletting machine A is comprised of a pulsating vibration air generation means 71, the powder material spray apparatus 11A, a rotary type tabletting machine 81, a lubricant spray chamber 91 provided at a fixed position of the rotary type tabletting machine 81, a lubricant suction means 101 for removing extra lubricants sprayed from the chamber 85, and a processing unit 111 for controlling and supervising the entire external lubrication type tabletting machine A.

The members constructing the external lubrication type tabletting machine A in FIG. 26 corresponding to the members constructing the powder material spray apparatus 11A in FIG. 17 have the same numbers and their explanations are omitted here.

The powder material spray apparatus 11A and the lubricant spray chamber 91 are connected by the conduit T6 in such a manner hat lubricants (powder) which is discharged from the powder material spray apparatus 11A and mixed with and dispersed in the positive pulsating vibration air in the conduit T6 are supplied into the lubricant spray chamber 91 via the conduit T6.

The reference numeral e6 in FIG. 26 indicates the other end of the conduit T6.

Next, a construction of the rotary type tabletting machine 81 is explained.

Figure 27:
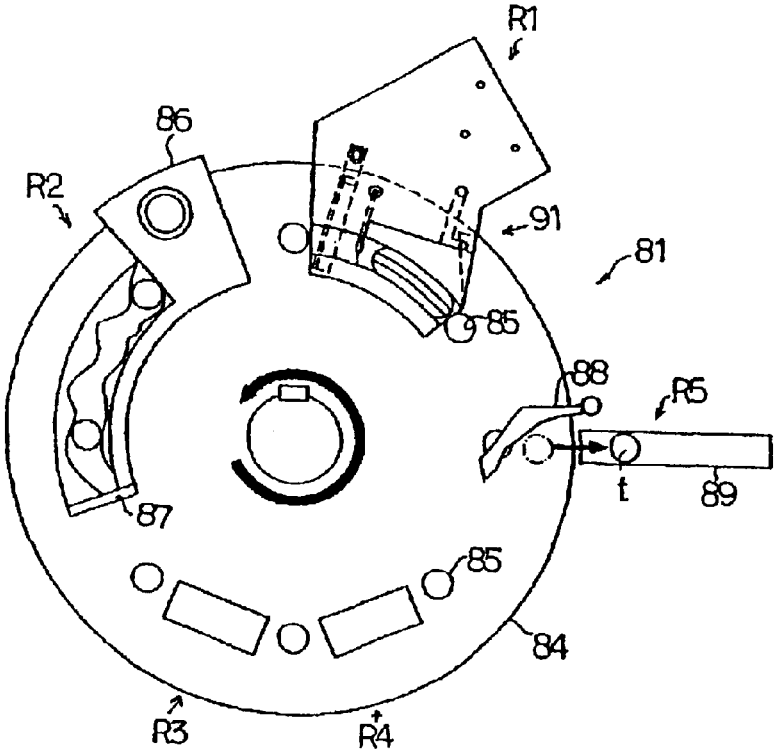
FIG. 27 is a plan view diagrammatically showing a rotary type tabletting machine constructing the embodiment shown in FIG. 26.

FIG. 27 is a plan view diagrammatically showing the rotary type tabletting machine 81.

A normal rotary type tabletting machine is used as the rotary tabletting machine 81.

The rotary type tabletting machine 81 has a turntable 84 rotatably provided for a rotary axis, plural upper punches 82 . . . and plural lower punches 83 . . . .

Plural dies 85 . . . are provided for the turntable 84 and the upper punch 82 . . . and its corresponding lower punch 83 . . . are provided for each die 85 . . . Those upper punches 82 . . . , corresponding lower punches 83 . . . and corresponding die 85 . . . are synchronously rotated.

Further, the upper punches 82 . . . are constructed so as to move up and down in a rotary axis direction at a predetermined position by means of a cam mechanism (not shown). The lower punches 83 . . . are also constructed so as to move up and down in a rotary axis direction at a predetermined position by means of a cam mechanism 90.

The member shown as a reference numeral 86 in FIG. 26 and FIG. 27 indicates a feed shoe for charging a molding material in each die 85. . . , 87 shows a scraping plate for making the molding material charged in the dies 85 . . . at a fixed amount, and 88 shows a scraper for discharging the produced tablet t into a discharge chute 89.

The reference numeral R1 in FIG. 27 is a lubricant spray position. According to this external lubrication type tabletting machine A, the lubricant spray chamber 91 is provided at the lubricant spray point R1. More specifically, the lubricant spray chamber 91 is fixedly provided on the turntable 84 in such a manner that the lubricants are applied on each surface of the dies 85. . . , the upper punches 82 . . . and the lower punches 83 . . . which are sequentially accommodated in the lubricant spray chamber 91 when the turntable 84, the plural upper punches 82 . . . and the plural lower punches 83 . . . are rotated. The method of applying lubricants on each surface of the dies 85 . . . , the upper punches 82 . . . and the lower punches 83 . . . in the lubricant spray chamber 91 will be detailed later.

The position shown as R2 in FIG. 27 is a material charge position where the molding material m is charged in the cavity made by the die 85 and the lower punch 83 inserted to a predetermined position in the die 85 by the feed shoe 86.

A position R3 in FIG. 27 is a pre-tabletting point where a fixed amount of molding material which is filled in the cavity formed by the die 85 and the lower punch 83 and is scraped by the scraping plate 87 is preliminary tabletted by means of the upper punch 82 and the corresponding lower punch 83.

A position R4 in FIG. 27 is a main tabletting point where the pre-tabletted molding material is fully compressed by the upper punch 82 and the corresponding lower punch 83 so as to produce a tablet t.

A position R5 in FIG. 27 is a tablet discharge point where the tablet t is discharged to the discharge chute 89 by means of the tablet discharge scraper 88 when the upper face of the lower punch 83 is inserted into the upper end of the die 85.

Next, the construction of the lubricant spray chamber 91 will be detailed.

Figure 28:
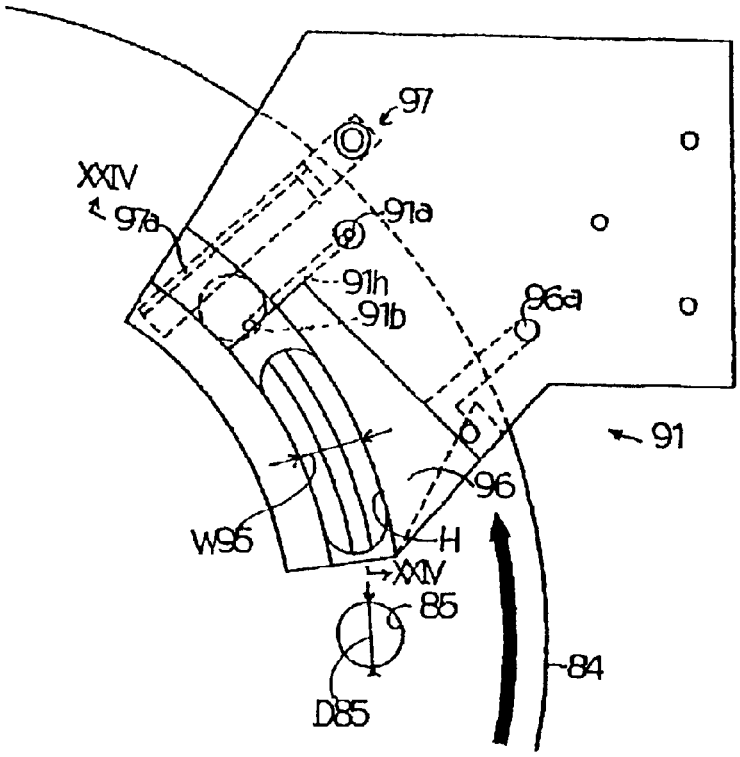
FIG. 28 is a plan view diagrammatically explaining around a lubricant spray chamber constructing the embodiment shown in FIG. 26.
Figure 29:
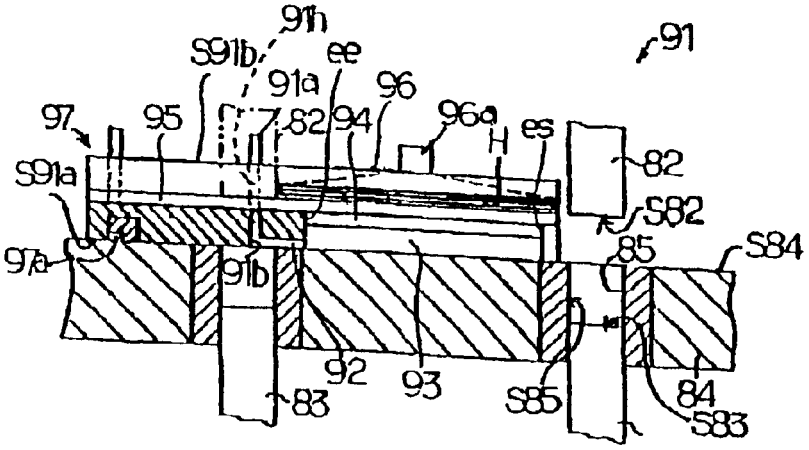
FIG. 29 is a sectional view diagrammatically showing a construction of a lubricant spray chamber along the line XXIV—XXIV in FIG. 28.

FIG. 28 is a plan view around the lubricant spray chamber 91. FIG. 29 shows a diagrammatical section of the lubricant spray chamber 91 along the line XXIV—XXIV in FIG. 28.

Next, the construction of the lubricant spray chamber 91 will be detailed.

The lubricant spray chamber 91 is fixedly provided at a predetermined position on the turntable 84 of the rotary type tabletting machine 81.

A surface (bottom) S91*a* of the lubricant spray chamber 91 facing the turntable 84 is designed to get in touch with a surface S84 of the turntable 84 and the turntable 84 rubs on the bottom S91*a*.

The lubricant spray chamber 91 has a lubricant introduction port 91*a* connecting the conduit T2 on its outer surface S91*b*.

The lubricant powders which have been supplied from the lubricant introduction port 91*a* and dispersed in a positive pulsating vibration air is fed to the surface (bottom) facing the turntable 84 of the lubricant spray chamber 91 via a penetrating hole 91*h* which penetrates the lubricant spray chamber 91. Then the lubricant powders are sprayed on the surface (upper face) S83 of the lower punch 83 inserted in a predetermined portion in the die 85 of the turntable 84 from the discharge port 91*b* of the penetrating hole 91*h*.

Further in this embodiment, the lubricant powders dispersed in air is designed to be perpendicularly sprayed on the surface (upper face) S83 of the lower punch 83 from the discharge port 91*b* of the penetrating hole 91*h*.

A groove 92 is provided for the surface (bottom) S91*a* of the lubricant spray chamber 91 facing the turntable 84 in the reverse direction of the rotation of the turntable 84 from the discharge port 91*b* of the penetrating hole 91*h*.

The extra lubricant powders accumulated on the surface (upper face) S83 of the lower punch 83 are blown off by the air supplied together with the lubricant powders. A part of blown-out powders is designed to be applied on the surface S85 (inner circumference) of the die 85.

Further, the lubricant powders pass through a tubular portion formed by the groove 92 provided on the surface (bottom) of the lubricant spray chamber 91 facing the turntable 84 and by the surface of the turntable 84 and are fed in reverse direction of the rotation of the turntable 84.

The end of the groove 92 provided on the surface (bottom) of the lubricant spray chamber 91 facing the turntable 84 is communicated with a hollow chamber 93 provided at the surface (bottom) side of the lubricant spray chamber 91 facing the turntable 84.

A slit 94 is formed above the hollow chamber 93 so as to penetrate the lubricant spray chamber 91.

At the outer surface of the lubricant spray chamber 91, an upper punch accommodation part 95 for sequentially accommodating the upper punches 82 . . . which rotate in sync with the turntable 84 along the slit 94 is formed along the rotary orbit of the upper punches 82 . . . .

The width W95 of the upper punch accommodation part 95 is equal to or a little larger than the diameter of the upper punch 82.

A suction head 96 is provided above the slit 94.

The numeral 96*a* in FIG. 29 is a connection port to be connected with a conduit (the conduit T7 in FIG. 26).

The size of a suction port H of the suction head 96 is designed so as to cover the entire slit 94 and so as to be a similar shape to the slit 94.

As a result, when a suction means (the suction means 102 in FIG. 26) is driven, an upward air flow is uniformly and evenly generated from one end es to the other end ee of the slit 94.

Therefore, lubricant powders can be applied taking enough time on the surface (lower face) S82 of the upper punch 82 on which lubricant powders have difficulty to be applied while the upper punch 82 moves from the end es to the other end ee of the slit 94 in the upper punch accommodation part 95.

Further in this embodiment, at the downstream of the lubricant spray point of the lubricant spray chamber 91 (at the upstream of the material charge point), a lubricant suction part 97 is provided for removing the lubricant powders flown out on the turntable 84 or the lubricant powders exceedingly attached on the surface (upper face) S83 of the lower punch 83 and on the circumferential wall (inner circumference) S85 of the die 85.

A suction means such as a blower (not shown) is connected to the lubricant suction part 97. When the suction means (not shown) is driven, the lubricant powders flown out on the die 85 of the turntable 84 or the lubricant powders exceedingly attached on the surface (upper face) S83 of the lower punch 83, on the surface (inner circumference) S85 of the die 85 and on the surface (upper face) S83 of the lower punch 83 can be suck and removed from the suction port 97*a*.

The suction port 97*a* is formed like a slit (long shape) on the surface (bottom) facing the turntable 84 in such a manner that the longitudinal direction becomes a substantially central direction from the periphery of the turntable 84 and the suction port 97*a* bridges the die 85.

The distance between the suction port 97*a* and the discharge port 91*b* is set to be a little larger than the diameter D85 of the die 85.

Therefore, when the suction means such as a blower (not shown) connected to the lubricant suction part 97 is driven, the turntable 84 around the dies 85 can be always kept clean. As a result, the lubricant powders attached around the die 85 on the turntable 84 don't fall in the die 85 so that externally lubricated tablet which doesn't include any lubricant in the tablet can be continuously tabletted.

Next, the construction of the lubricant suction means 101 will be detailed.

Figure 30:
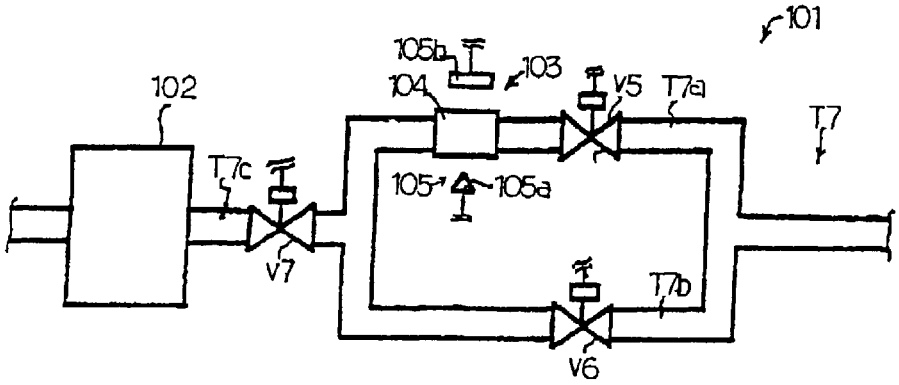
FIG. 30 is a constructional view diagrammatically showing an enlarged part around a lubricant suction means shown in FIG. 26.

FIG. 30 is a constructional view diagrammatically enlarging around the lubricant suction means 101 shown in FIG. 26.

The lubricant suction means 101 has a suction means 102 such as a blower and a suction duct T7 connected to the suction means 102.

One end of the suction duct T7 (see the end e7 of the suction duct T7 in FIG. 26) is connected to the lubricant spray chamber 91 and is branched into two branch pipes T7*a* and T7*b*, integrated into one pipe T7*c* again and connected to the suction means 102.

A switch valve v5 and a light permeable type powder concentration measuring means 103 are sequentially provided from the end e7 of the suction duct T7 into the suction means 102.

The light permeable type powder concentration measuring means 103 has a measurement cell 104 and a light permeable type measuring means 105.

The measurement cell 104 is made of quartz and connected in midstream of the branch pipe T7*a*.

The light scattering type measuring means 105 is provided with a laser beam emitting system 105*a* for emitting laser beams and a scattering beam receiving system 105*b* for receiving the light scattered by an object and is designed to measure the flow rate, particle diameter, particle size distribution and concentration of the object according to the Mie theory. In this embodiment, the laser beam emitting system 105*a* and the scattering beam receiving system 105*b* are opposed so as to interpose the measurement cell 104 in such a manner that the flow rate, particle diameter, particle size distribution and concentration of the powdered material (lubricants (powder) in this embodiment) running in the branch pipe T7*a* can be measured in the measurement cell 104.

A switch valve v6 is provided for the branch pipe T7*b*.

Further, a switch valve v7 is provided for the conduit T7*c*.

For controlling the concentration of the lubricants (powder) in the lubricant spray chamber 91 by means of the lubricant suction means 102, the switch valves v5 and v7 are opened while the switch valve v6 is closed, and then the suction means 102 is driven.

Driving the pulsating vibration air generation means 71 and the powder material spray apparatus 11A, respectively, the lubricants (powder) mixed with and dispersed by a positive pulsating vibration air are supplied in the lubricant spray chamber 91 together with the positive pulsating vibration air.

Then a part of the lubricants (powder) fed in the lubricant spray chamber 91 is used for spraying on each surface (lower face) S82 of the upper punches 82 . . . , each surface S83 (upper face) of the lower punches 83 . . . , and each inner circumference S85 of the dies 85 . . . . The extra lubricants are sucked to the suction means 102 from the end e5 of the suction duct T5 via the branch pipe T5*a* and the conduit T5*c*.

This time the light permeable type measuring means 105 consisting of the light permeable type powder concentration measuring means 103 is driven to measure the flow rate, particle diameter, particle size distribution, and concentration of the lubricants (powder) running in the measurement cell 104, namely in the branch pipe T5*a*.

The concentration of the lubricants (powder) in the lubricant spray chamber 91 is controlled by appropriately adjusting the drive amount of suction means 102 and the drive amount of pulsating vibration air generation means 71 depending on the measured value of the light permeable type measuring means 105.

Under such operations, a problem is caused such that the lubricants (powder) are adhered in the inner circumference of the measurement cell 104 and the permeable type measuring means 105 can't accurately measure the flow rate and so on of the lubricants (powder) running in the branch pipe T5*a* because of thus adhered lubricants (powder) in the measurement cell 104. In such a case a compensation is required for removing the affection (noise) caused by the lubricants (powder) adhered in the measurement cell 104 from the measured value of the measuring means 105. However, according to this suction means 102, the switch valve v5 is closed and the switch valve v6 is opened while keeping the suction means 102 driven for measuring the affection (noise) by the lubricants (powder) attached in the measurement cell 104. The lubricants (powder) sucked in the suction duct T7 from the end e7 thereof is further sucked in the suction means 102 through the branch pipe T7*b* and the conduit T7*c* so that the lubricants (powder) don't run in the branch pipe T7*a*.

When the light permeable type measuring means 105 is driven at this time, the affection (noise) by the lubricants (powder) adhered in the measurement cell 104 can be measured.

The measured value of the affection (noise) by the lubricants (powder) adhered in the cell 104 is temporarily stored in a memory means of the processing unit 111.

Thereafter, the switch valve v5 is opened and the switch valve v6 is closed while keeping the suction means 102 driven so as to run the lubricants (powder) through the branch pipe T7*a*. Then the powder concentration measuring means 103 is driven to measure the flow rate and so on of the lubricants (powder) running in the branch pipe T7*a*. The compensation value obtained by removing the affection (noise) of the lubricants (powder) adhered in the cell 104 from the measured value of the light permeable type measurement means 105 based on the compensation program and the measured value of the affection (noise) of the lubricants (powder) adhered in the cell 104 stored in the memory means of the processing unit 111 in advance. Then the concentration of the lubricants (powder) in the lubricant spray chamber 91 is controlled by adjusting the driving amount of suction means 102 and that of pulsating vibration air generation means 21 based on the obtained compensation value.

In the external lubrication type tabletting machine A in FIG. 26, the processing unit 111 and each member v1, v2, v3, v5, v6, v7, vp1, vp2, vp3, 61, 62, 63, 71, 102 and 105 are connected by signal lines so as to be able to drive, stop or control each member v1, v2, v3, v5, v6, v7, vp1, vp2, vp3, 61, 62, 63, 71, 102 and 105 by command signals from the processing unit 111.

Next, a construction of a pulsating vibration air generation means 71 will be detailed.

Figure 31:
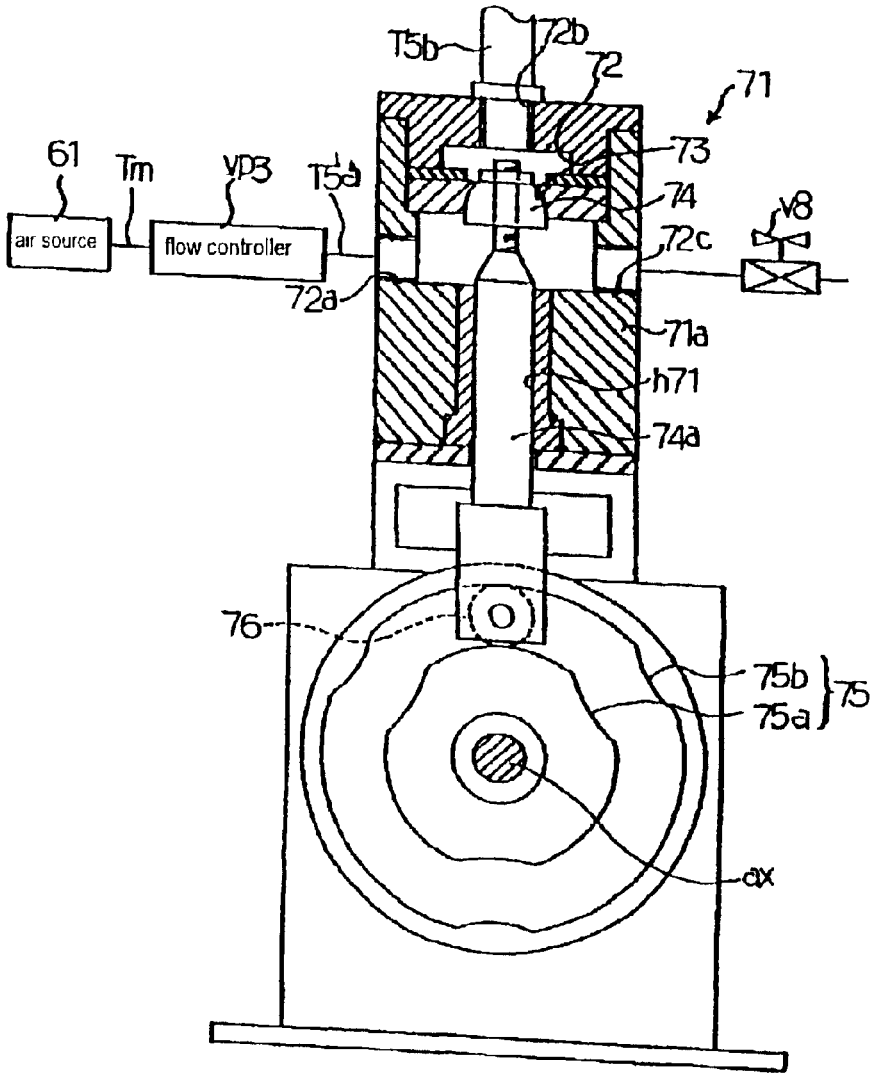
FIG. 31 is a sectional view diagrammatically showing a construction of a pulsating vibration air generation means.

FIG. 31 is a diagrammatic sectional view showing the construction of the pulsating vibration air generation means 71.

The pulsating vibration air generation means 71 has a hollow chamber 72 with an air supply port 72*a* and an air discharge port 72*b*, a valve seat 73 provided in the chamber 72, a valve plug 74 for opening and closing the valve seat 73, and a rotary cam 75 for opening and closing the valve plug 74 for the valve seat 73.

A conduit Ta5 is connected to the air supply port 72*a* and a conduit T5*b* is connected to the air discharge port 72*b*.

The member 72*c* in FIG. 31 is a pressure control port provided for the hollow chamber 72 if required and a pressure regulating valve v8 is provided for the pressure control port 72*c* so as to communicate with and block off the atmosphere.

The valve plug 74 has a shaft 74*a*, under which a rotary roller 76 is rotatably connected.

A shaft hole h71 for containing the shaft 734*a* of the valve plug 74 airtightly and movably up and down is provided for a main body 71*a* of the pulsating vibration air generation means 71.

The rotary cam 75 has an inside rotary cam 75*a* and an outside rotary cam 75*b*.

A predetermined concavo-convex pattern is formed on each one of the inside rotary cam 75*a* and the outside rotary cam 75*b* so as to have a space about the distance of the diameter of the rotary roller 76.

The rotary cam 75 which has a concavo-convex pattern suitable for mixing and dispersing lubricants (powder) depending on their physical property is used.

The rotary roller 76 is rotatably inserted between the inside rotary cam 75*a* and the outside rotary cam 75*b* of the rotary cam 75.

A member shown as ax in FIG. 31 is a rotary axis of the rotary drive means such as a motor (rotary drive means 77 in FIG. 26) and the rotary cam 75 is detachably provided for the rotary axis ax.

Next, a method for supplying a positive pulsating vibration air to the conduit T5*b* by supplying the pulsating vibration air generation means 71 is explained.

At first, when positive pulsating vibration air is supplied in the conduit T1, the rotary cam 75 with a concavo-convex pattern suitable for mixing and dispersing lubricants (powder) depending on their physical property is attached on the rotary axis ax of the rotary drive means 77.

Then the air source 61 is driven to supply a compressed air to the conduit T5*a*.

When the flow rate control valve vp3 is provided, the compressed air supplied in the conduit T5*a* is further supplied to the hollow chamber 72 from the air supply port 72*a* after being adjusted to a predetermined flow amount by the flow rate control valve vp3.

The air source 61 and the rotary drive means 77 are driven, so that the rotary cam 75 attached to the rotary axis ax of the rotary drive means 77 is rotated at a fixed rotational speed.

Accordingly, the rotary roller 76 is rotated between the inside rotary cam 75*a* and the outside rotary cam 75*b* of the rotary cam 75 which are rotated at a predetermined rotational speed in such a manner that the rotary roller 76 reproducibly moves up and down according to the concavo-convex pattern of the rotary cam 75. As a result, the valve plug 74 opens and closes the valve seat 73 according to the concavo-convex pattern formed on the rotary cam 75.

If a pressure-control port 72*c* and a pressure regulating valve v8 are provided for the hollow chamber 72, the pressure of the positive pulsating vibration air supplied to the conduit T5*b* is regulated by appropriately controlling the pressure regulating valve v8 provided for the pressure control port 72*c*.

Thus a positive pulsating vibration air is fed to the conduit T5*b*.

The wavelength of the positive pulsating vibration air fed in the conduit T5*b* is properly controlled depending on the concavo-convex pattern of the rotary cam 75 and/or the rotational speed of the rotary cam 75. The wave shape of the positive pulsating vibration is adjusted by the concavo-convex pattern of the rotary cam 75. The amplitude of the positive pulsating vibration air is controlled by adjusting the drive amount of air source 61, by adjusting the pressure regulating valve vp3 if it is provided or by adjusting the pressure regulating valve v8 and the pressure regulating port 72*c* if they are provided, or by combining and adjusting them.

Next, operations of the external lubrication type tabletting machine A are explained.

For quantitatively supplying lubricants (powder) in the lubricant spray chamber 91 using the powder material spray apparatus 11A, lubricant (powder) is contained in the powder material storage hopper 32 and a cover 32*b* is attached airtightly on the material feed port 32*b* of the powder material storage hopper 32.

A rotary cam 75 which has a concavo-convex pattern suitable for the lubricants (powder) being mixed and dispersed is attached on a rotary axis ax of the rotary drive means 77 of the pulsating vibration air generation means 71 depending on the physical property of the lubricants (powder).

Next, the air source 61 is driven and the rotary drive means 77 of the pulsating vibration air generation means 71 is rotated at a fixed rotational speed, thereby supplying a positive pulsating vibration air with a desired flow rate, pressure, wavelength and wave shape in the conduit T5*b*. Then, the level sensor 62 is operated.

When the level sensor 62 is actuated to emit light from the light emitting element 62*a* and the emitted light is received by the light receiving element 62*b*, gas is injected for a predetermined time from gas injection means 33 and 33 provided in the hopper body 32. After controlling such that the pressure Pr2 in the hopper body 32 and the pressure Pr21 in the tubular body 2 become equal, the material feed valve 34 provided at the discharge port 2*a* of the material storage hopper 2 is moved downward to open the discharge port 2*a*. Then the lubricants (powder) stored in the hopper 2 are discharged to the cylindrical body 2 from the discharge port 2*a* to be accumulated on the elastic membrane Et.

When the height H of the accumulated lubricants (powder) on the elastic membrane Et exceeds the height Hth where the level sensor 62 is provided, the light emitted from the light emitting element 62*a* is intercepted by the lubricants (powder) accumulated on the membrane Et, therefore the light receiving element 62*b* doesn't receive the light emitted from the light emitting element 62*a*. Thus, the material feed valve 34 provided at the material discharge port 2*a* of the powder material storage hopper 2 moves upward to close the port 2*a*. The lubricants (powder) are accordingly accumulated on the elastic membrane Et to the position Hth where the level sensor 62 is provided.

The positive pulsating vibration air fed in the conduit T5*b* is supplied from a pulsating vibration air supply port 41*a* to the dispersion chamber 41 as shown in FIG. 17 and becomes a positive pulsating vibration air swirling upwardly like a convolution such as a tornado therein, then is discharged from the discharge port 41*b*.

The swirling positive pulsating vibration air generated in the dispersion chamber 41 doesn't lose its nature as a pulsating vibration air so that the elastic membrane Et vibrates according to the frequency, amplitude, and wave shape of the positive pulsating vibration air.

Discharge of lubricants (powder) in the dispersion chamber 41 via the penetrating aperture Eta of the elastic membrane Et is repeated by vibration of the elastic membrane Et.

Furthermore, the emitting element 62*a* of the level sensor 62 is lighted while the powder material spray apparatus 11A is operated. When the light receiving element 62*b* comes to receive the light emitted from the light emitting element 62*a*, gas is injected for a while from the gas injection means 33 and 33 provided in the hopper body 32. After controlling such that the pressure Pr2 in the hopper body 32 and the pressure Pr2 in the tubular body 2 are balanced, the material feed valve 34 goes down to open the discharge port 32*a* of the material storage hopper 32. Then, when the light receiving element 62*b* comes not to receive the light emitted from the light emitting element 62*a*, the material feed valve 34 goes up to close the discharge port 2*a* of the material storage hopper 2. Because of such operations, substantially a fixed amount (at height where the level sensor 52 is provided, namely height Hth of the level sensor 62 above the elastic membrane Et) of lubricant (powder) constantly exists on the elastic membrane Et.

The turntable 84, the upper punches 82 . . . , the lower punches 83 . . . of the rotary tabletting machine 81 are synchronously rotated and the suction means 102 is driven at a fixed driving amount.

When the turntable 84, the upper punches 82 . . . , the lower punches 83 . . . are synchronously rotated, lubricants (powder) are sequentially applied on the surface (upper face) S83 of the lower punch 83 inserted in a fixed position in the die 85, the upper part of the inner circumference S85 of the die 85 above the surface (upper face) S83 of the lower punch 83 and the surface (lower face) S82 of the upper punch 82 when they are fed in the lubricant spray chamber 91.

According to this lubricant spray chamber 91, lubricants (powder) are applied under a positive pulsating vibration air on the surface S83 (upper face) of the lower punch 83, the upper part of the inner circumference S85 of the die 85 above the surface (upper face) S83 of the lower punch 83 and the surface (lower face) S82 of the upper punch 82. Even if surplus lubricants (powder) are attached on the surface S83 (upper face) of the lower punch 83, the upper part of the inner circumference S85 of the die 85 above the surface (upper face) S83 of the lower punch 83 and/or the surface (lower face) S82 of the upper punch 82, such lubricants exceedingly applied thereon are blown out when the positive pulsating vibration air becomes its peak. Further, thus blown lubricants (powder) are sucked from one end e7 of the suction duct T7 so that a minimum amount of lubricants (powder) is uniformly applied on the surface S83 (upper face) of the lower punch 83, the upper part of the inner circumference S85 of the die 85 above the surface (upper face) S83 of the lower punch 83 and the surface (lower face) S82 of the upper punch 82.

Next, molding material is sequentially charged in a cavity formed by the die 85 and the lower punch 83 inserted in a fixed position in the die 85 from a feed shoe 88 at a material charge point R2.

The molding material fed in the die 85 is scraped by the scraping plate 87 to be a predetermined amount and then fed to a pre-tabletting point R3 wherein the material is pre-tabletted with the upper punch 82 and its corresponding lower punch 85. The pre-tabletted material is compressed in earnest by means of the upper punch 82 and its corresponding lower punch 85 at a main tabletting point R4.

Thus produced tablet t is sequentially fed to a tablet discharge point R5 to be discharged to a discharge chute 89 by a tablet discharge scraper 88.

An operator observes the tablet t discharged in the discharge chute 89.

If sticking, capping or laminating is appeared in the tablets t . . . , the concentration of the lubricant (powder) in the lubricant spraying chamber 91 is controlled to be increased so as to reduce the frequency of such tablet problems. It can be achieved by controlling the drive amount of air source 61 or suction means 102, by controlling the flow rate control valve vp3 if it is provided, or by controlling the pressure regulating valve v8 if it is provided for the pressure regulating port 72*c*. Furthermore, the elastic membrane Et may be exchanged for the one with a larger penetrating aperture Eta for its purpose.

The external lubrication type tabletting machine A can constantly produce a large amount of externally lubricated tablets at a high industrial productivity, which has been difficult in prior arts.

On the other hand, when the lubricant amount in the tablet composition is found to be larger than the predetermined amount by analyzing the composition in the tablets t . . . even if tabletting problems such as sticking, capping and laminating aren't caused for the produced tablet t . . . , the concentration of the lubricant (powder) in the lubricant spraying chamber 91 is controlled to be reduced. It can be achieved by controlling the drive amount of compression air source 61 or suction means 102, by controlling the flow rate control valve vp3 if it is provided, or by controlling the pressure regulating valve v8 if it is provided for the pressure regulating port 72*c*. Consequently the amount of lubricant (powder) applied on each surface of the upper punch 82 . . . , the lower punch 83 . . . , and the dies 85 . . . is controlled to be constant so that the transferred amount of lubricant from those surfaces is reduced. Furthermore, the elastic membrane Et may be exchanged for the one with smaller number of plural penetrating apertures (slit) hs . . . or with smaller penetrating apertures.

The lubricant (powder) dispersed on each surface of the tablets t . . . affects its disintegrability in case of external lubrication tablets.

External lubrication tablets have an advantage that the disintegration velocity of the tablets can be increased comparing with inner lubrication tablets (tablets produced by the molding material combined and dispersed with a lubricant (powder) in advance in order to prevent tabletting problems such as sticking, capping and laminating in case of tabletting procedure). However, if a large amount of lubricant (powder) is attached on the surface of the external lubrication tablet, the disintegration velocity of the tablets t . . . tends to be slow on account of the water repellency of the lubricant. According to the external lubrication type tabletting machine A, since the concentration of the lubricant (powder) in the lubricant spraying chamber 91 can be easily controlled at a desired degree, a large amount of external lubrication tablets with a superior disintegration property can be produced constantly at an industrial production basis while preventing tabletting problems such as sticking, capping and laminating.

Finishing such control operations, the above-mentioned production conditions are stored in a memory of the processing unit 111 of the external lubrication type tabletting machine A.

According to the external lubrication type tabletting machine A, the elastic membrane Et doesn't go slack when the powder material spray apparatus 11A is operated for a long time because the elastic membrane installation means 51 is used for attaching the elastic membrane Et to the spray apparatus 11A.

Therefore, if the production conditions of the tablets are stored in the memory of the processing unit 111 of the external lubrication type tabletting machine A, desired external lubrication tablets can be constantly produced for a long time according to the stored production conditions.

In the external lubrication type tabletting machine A, the concentration of the lubricants (powder) in the lubricant spraying chamber 91 can be controlled by monitoring the lubricant passing through the conduit T7*a* by means of the light permeable type powder concentration measuring means 103 while producing tablets t. Further according to the external lubrication type tabletting machine A, the pulsating vibration air generation means 71, the powder material spraying apparatus 11A, the rotary type tabletting machine 81 and the suction means 102 aren't required to be stopped when the affection (noise) of the lubricant adhered on the measurement cell 104 is measured, so that there is an effect that tablets are produced at high productivity.

Further according to the above-mentioned embodiments, the pulsating vibration air generation means 71 is explained such that the valve plug 74 is moved up and down by rotating the cam 75 according to the concavo-convex pattern provided thereon and a desired positive pulsating vibration air is supplied in the conduit T5*b* by opening and closing the valve seat 73 by the valve plug 74. It is only a preferable example for accurately supplying a desired positive pulsating vibration air in the conduit T5*b*. For example the rotary type pulsating vibration air conversion means 71A as shown in FIG. 32 and the rotary type pulsating vibration air conversion means 71B as shown in FIG. 33 may be provided.

Figure 32:
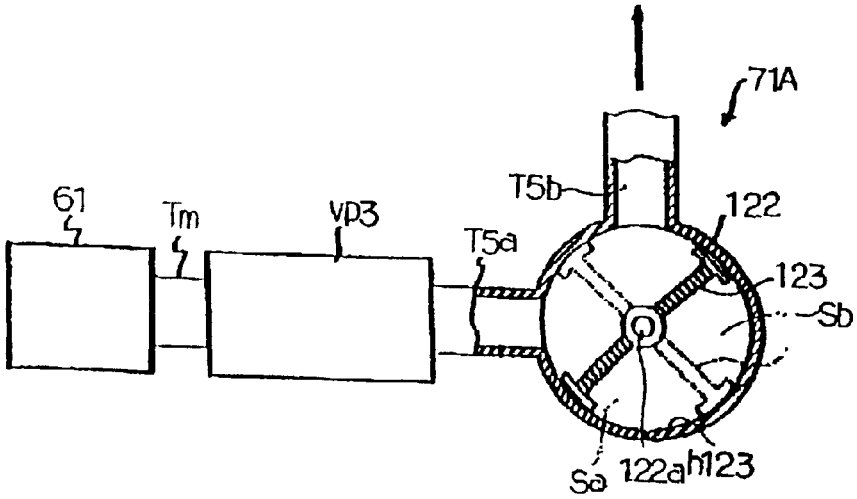
FIG. 32 is a sectional view diagrammatically showing a construction of other embodiment of a pulsating vibration air generation means.
Figure 33:
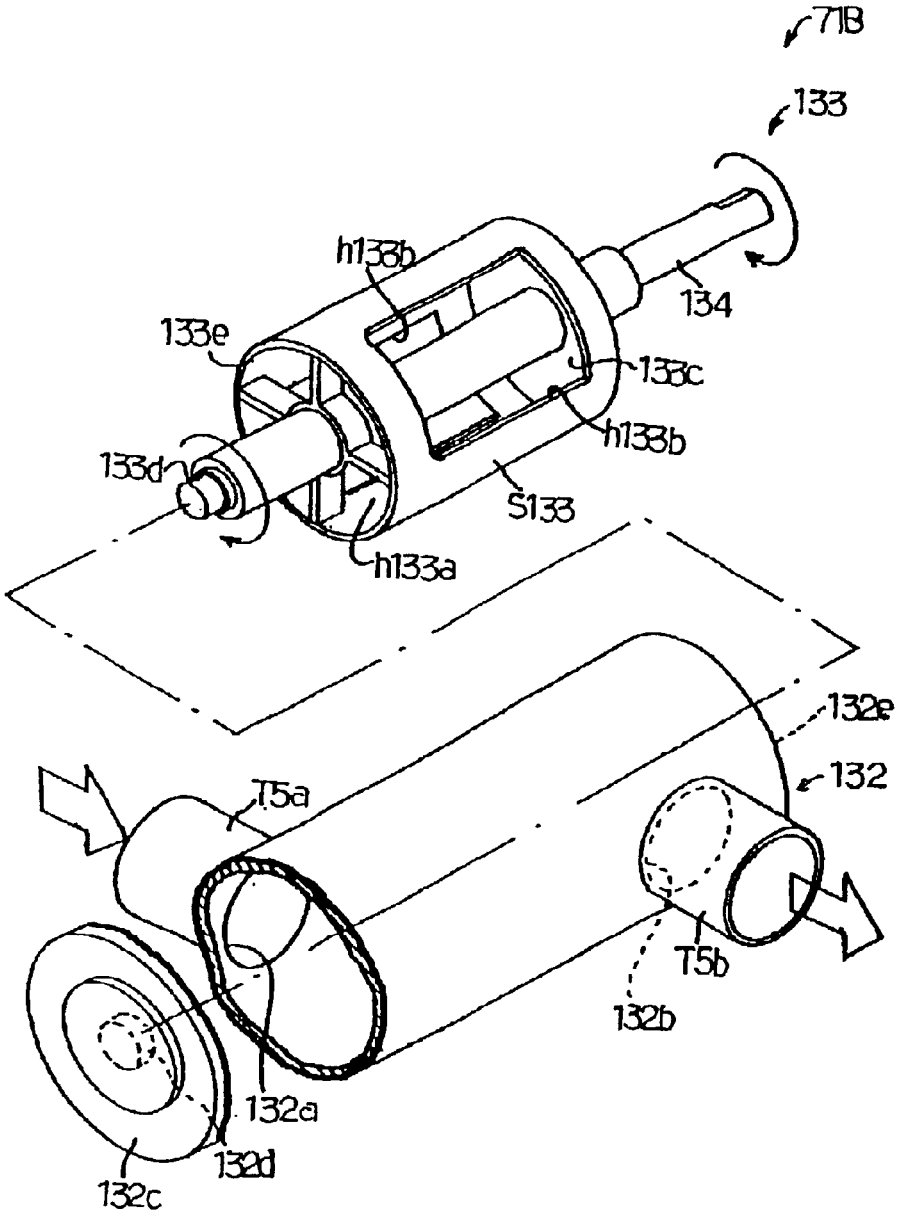
FIG. 33 is a sectional view diagrammatically showing a construction of other embodiment of a pulsating vibration air generation means.

The pulsating vibration air generation means 71A of FIG. 32 has the same construction as the pulsating vibration air generation means 71 of FIG. 31 other than the construction of the following constructions. Corresponding members have the corresponding reference numerals and their explanations are omitted here.

The pulsating vibration air generation means 71A has a cylindrical body 122 and a rotary valve 123 attached to a rotary axis 122*a* consisting a center axis of the cylindrical body 122 so as to divide a hollow chamber h123 into two parts. The rotary axis 122*a* is designed to be rotated at a fixed rotational speed by a rotary drive means such as a motor (not shown).

Conduits T5*a* and T5*b* are connected to the external circumferential wall of the cylindrical body 122 with a fixed space.

An air source 61 is driven to supply a fixed amount of compressed air in a conduit T5*a* for supplying a desired positive pulsating vibration air in the conduit T5*b* by means of the pulsating vibration air generation means 71A. If a flow rate control valve vp3 is provided, the flow rate of the compressed air fed in the conduit Tm is controlled by adjusting the flow rate control valve vp3.

The rotary axis 122*a* is rotated at a fixed rotational speed by a rotary driving means such as an electric motor (not shown) so that the rotary valve 123 attached to the axis 122*a* is rotated at a fixed speed.

Then the compressed air generated from the air source 61 is fed to the conduit T5*b* from the conduit T5*a* because the conduits T5*a* and T5*b* are communicated when the rotary valve 123 is at a position shown with solid lines in the figure.

When the rotary valve 123 is positioned as shown in imaginary lines, the conduits T5*a* and T5*b* are shut off by the rotary valve 123.

In such a case the compressed air is fed from the conduit T5*a* to one space Sa divided by the rotary valve 123 and air is compressed in the space Sa.

On the other hand, the compressed air stored in another space Sb formed by the rotary valve 123 is fed to the conduit T5*b*.

Repeating such operations by the rotation of the rotary valve 123, a positive pulsating vibration air is transmitted to the conduit T5*b*.

FIG. 33 is an exploded perspective view diagrammatical showing the pulsating vibration air generation means 71B.

The pulsating vibration air generation means 71B has a cylindrical body 132 and a rotary valve 133 rotatably provided therein.

The cylindrical body 132 is constructed such that one end 132*e* is opened and the other end is closed by a cover 132*c* and a suction port 132*a* and a transmission port 132*b* are provided for its circumferential side wall.

A conduit T5*a* which is connected to the air source 61 is connected to the suction port 132*a* and a conduit T5*b* which is connected to the powdered material spray apparatus 11A is connected to the transmission port 132*b*.

The member shown as 132*d* in FIG. 33 is a bearing hole for pivoting the rotary valve 133.

The rotary valve 133 is cylindrical with a hollow h133*a* and an opening h133*b* is provided on its circumferential wall S133. One end 133*e* of the rotary valve 133 is opened and the other end is closed by a cover 133*c*.

A rotary axis 134 is extended at the rotary center of the rotary valve 133.

Rotary drive means such as an electric motor (not shown) is connected to the rotary axis 134 and the rotary valve 133 is rotated around the rotary axis 134 when the rotary drive means (not shown) is driven.

The outer diameter of the circumferential wall S133 of the rotary valve 133 is almost the same as the inner diameter of the cylindrical body 132 in such a manner that the rotary valve 133 is contained in the cylindrical body 132 so that the circumferential wall S133 rubs against the inner circumference of the body 132 when the rotary valve 133 is rotated.

The member shown as 133*d* in FIG. 33 is a rotary axis rotatably contained in the rotary bearing hole 132*d* provided for the cover 132*c* of the cylindrical body 132.

The rotary valve 133 is rotatably provided in the cylindrical body 132 such that the rotary axis 133*d* is attached to the rotary bearing hole 132*d*.

For supplying a desired positive pulsating vibration air in the conduit T5*b* by supplying the pulsating vibration air generation means 71B, a compressed air is supplied in the conduit T5*b* by driving the air source 61.

The rotary valve 133 is rotated at a fixed rotational speed by rotating the rotary axis 134 at a fixed rotational speed by the rotary drive means such as an electric motor (not shown).

When the opening h133*b* of the rotary valve 133 is positioned at the transmission port 132*b*, the conduits T5*a* and T5*b* are communicated so that a compressed air is fed to the conduit T5*b*.

When the circumferential wall S133 of the rotary valve 133 is positioned at the transmission port 132*b*, the conduits T5*a* and T5*b* are closed by the wall S133 so that a compressed air isn't fed to the conduit T5*b*.

Repeating such operations by the rotation of the rotary valve 133, a positive pulsating vibration air is fed in the conduit T5*b*.

Any one of the pulsating vibration air generation means 71 shown in FIG. 31, the pulsating vibration air generation means 71A and 71B shown in FIG. 32 and FIG. 33 may be used as the pulsating vibration air generation means of the powder material spray apparatus 11A. However, considering the decrescence property of a positive pulsating vibration air, it is preferable to produce a positive pulsating vibration air with clear on and off conditions from the pulsating vibration air generation means. In order to generate such a clear positive pulsating vibration air, it is preferable to use the rotary cam type pulsating vibration air conversion means 71 in FIG. 31 rather than the rotary type pulsating vibration air conversion means 71A and 71B shown in FIG. 32 and FIG. 33.

(Preferred Embodiment of the Invention 2)

In a preferred embodiment of the invention 2, a quantitative discharge apparatus in which a positive pulsating vibration air is supplied under the elastic membrane will be explained.

Figure 34A:
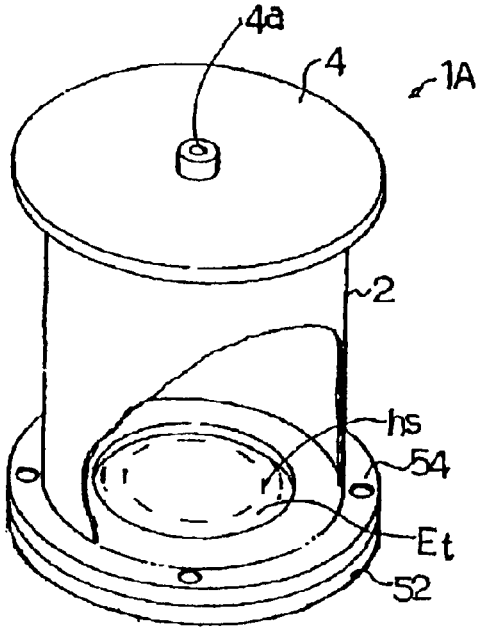
FIG. 34*a* is an external perspective view diagrammatically showing a quantitative discharge apparatus of the present invention and FIG. 34*b* is a sectional view of the quantitative discharge apparatus shown in FIG. 34*a*.
Figure 34B:
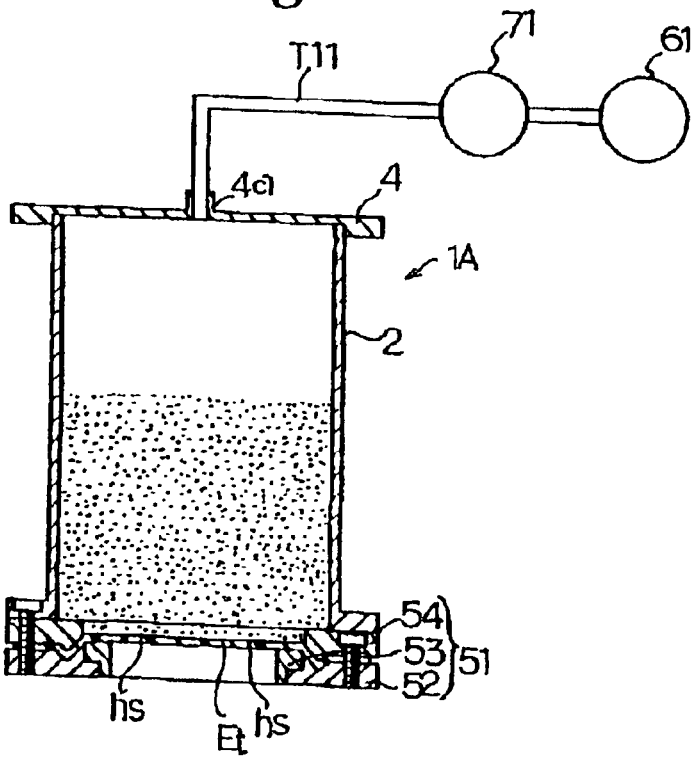

FIG. 34 diagrammatically shows other example of the quantitative discharge apparatus of the present invention. FIG. 34*a* is an external perspective view of the quantitative discharge apparatus of the present invention and FIG. 34*b* is a diagrammatic sectional view of the quantitative discharge apparatus shown in FIG. 34*a*.

The quantitative discharge apparatus 1A has a tubular hopper body 2, an elastic membrane Et, and a cover 4 detachably provided for an upper opening (material feed port) 2*b* of the hopper body 2.

The cover 4 is detachably and airtightly provided for the upper opening (material feed port) 2*b* of the hopper body 2.

An air supply port 4*a* is provided for the cover 4.

A pulsating vibration air generation means 71 is connected to the air supply port 4*a* via a conduit T11.

The pulsating vibration air generation means 71 is connected to the air source 61 such as a blower via the conduit T11 so that a compressed air generated by driving the air source 61 is converted into a positive pulsating vibration air to supply into the conduit T11.

The elastic membrane Et is provided so as to form a bottom of the hopper body 2 by means of an elastic membrane installation means 51.

The elastic membrane installation means 51 is constructed in the same manner as shown in FIG. 19, FIG. 20 and FIG. 21, therefore its explanation is omitted here.

Next, operations of the quantitative discharge apparatus 1A are explained.

FIG. 34 is an explanatory view diagrammatically showing the operations of the quantitative discharge apparatus 1A.

For using the quantitative discharge apparatus 1Powder material is stored in the hopper body 2.

Next, the cover 4 is airtightly attached on the hopper body 2 (see FIG. 34*a*).

Figure 35A:
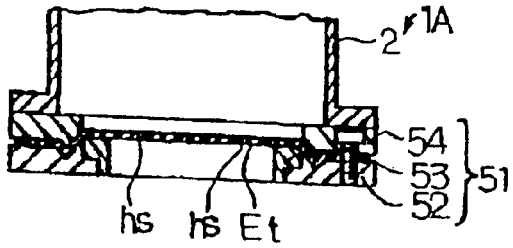
FIG. 35 is a diagrammatic explanatory view showing operations of an elastic membrane of the quantitative discharge apparatus shown in FIG. 34.

When the air source (air source 61 in FIG. 34*b*) and the pulsating vibration air generation means (pulsating vibration air generation means 71 in FIG. 34*b*) are stopped, the elastic membrane 3 is its initial position as shown in FIG. 35*a*. Because powder material isn't stored in the hopper body 2 in FIG. 35*a*, the elastic membrane Et is flat at its original position. Actually, a specific point (generally a dimensional center or a center of its gravity) of the elastic membrane Et is curved downward so as to form a cone part of a conventional hopper by the weight of the material.

Next, the air source (air source 61 in FIG. 34*b*) and the pulsating vibration air generation means (pulsating vibration air generation means 71 in FIG. 34*b*) are driven to supply a positive pulsating vibration air from the air supply port (air supply port 4*a* in FIG. 34) provided for the cover (cover 4 in FIG. 34).

Figure 35B:
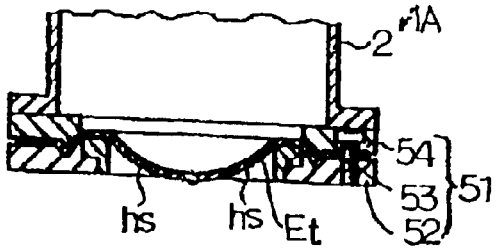

When the amount of positive pulsating vibration air supplied from the air supply port (air supply port 4*a* in FIG. 34) is small (when the positive pulsating vibration air is at its valley of amplitude), the elastic membrane Et is deformed to be curved from its initial position as shown in FIG. 35*a* in such a manner that a specific point (generally a dimensional center or a center of gravity of the elastic membrane) goes down as shown in FIG. 35*b*.

Figure 35C:
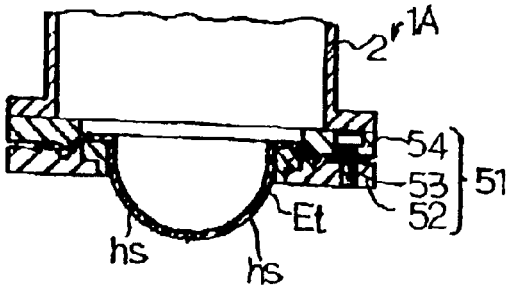

When the amount of positive pulsating vibration air supplied from the air supply port (air supply port 4*a* in FIG. 34) gradually becomes large (when the positive pulsating vibration air comes to its peak of amplitude from its valley), the elastic membrane Et is deformed to be curved from the position as shown in FIG. 35*b* in such a manner that a specific point (generally a dimensional center or a center of gravity of the elastic membrane) further goes down as shown in FIG. 35*c*.

Figure 35D:
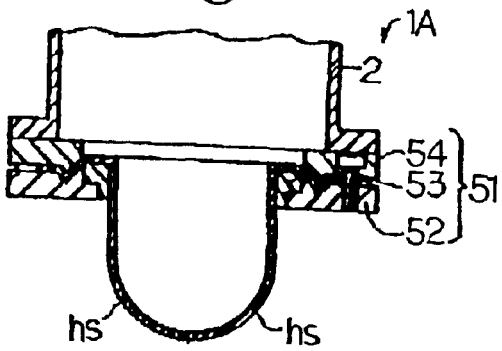

When the amount of positive pulsating vibration air supplied from the air supply port (air supply port 4*a* in FIG. 34) is larger (when the positive pulsating vibration air is its peak of amplitude), the elastic membrane Et is deformed to be curved from the position as shown in FIG. 35*c* in such a manner that a specific point (generally a dimensional center or a center of gravity of the elastic membrane) still further goes down as shown in FIG. 35*d*.

Thereafter, when the amount of positive pulsating vibration air supplied from the air supply port (air supply port 4*a* in FIG. 34) becomes small (when the positive pulsating vibration air goes its valley of amplitude from its peak), the elastic membrane Et is deformed as shown in FIG. 35*c*.

Further, when the amount of positive pulsating vibration air supplied from the air supply port (air supply port 4*a* in FIG. 34) becomes smaller (when the positive pulsating vibration air almost becomes its valley of amplitude), the elastic membrane Et is deformed as shown in FIG. 35*b*.

Then, when the amount of positive pulsating vibration air supplied from the air supply port (air supply port 4*a* in FIG. 34) becomes still smaller (when the positive pulsating vibration air is its valley of amplitude), the elastic membrane Et is deformed as shown in FIG. 35*a*.

The elastic membrane Et repeats vibration wherein a specific point (dimensional center or center of gravity of the elastic membrane) works as an antinode and the periphery works as a node of amplitude while a positive pulsating vibration air is supplied from the air supply port (air supply port 4*a* in FIG. 34) such that the elastic membrane Et is curved downward like FIG. 35*d* from its initial position shown in FIG. 35*a* and is returned to its initial position like FIG. 34*a* from the curved condition like FIG. 35*d*.

Because of such vibration of the elastic membrane Et, powder material stored in the hopper body 2 is discharged via the penetrating apertures hs . . . formed on the elastic membrane Et.

On the other hand, the elastic membrane Et constantly vibrates as long as the amplitude, wave length and frequency of the positive pulsating vibration air are constant.

Namely, the discharge amount of powder material from the penetrating aperture 3*a* of the elastic membrane Et depends on the positive pulsating vibration air supplied from the air supply port (air supply port 4*a* in FIG. 34).

Therefore, if the positive pulsating vibration air supplied from the air supply port (air supply port 4*a* in FIG. 34) is kept constant, a fixed amount of powder material can be always discharged from the penetrating apertures hs . . . .

According to this quantitative discharge apparatus 1Powder material can be constantly and stably discharged from the penetrating apertures hs . . . of the elastic membrane Et at a fixed rate for a long time if a positive pulsating vibration air is kept constant.

Further, as shown in FIG. 35*a*–FIG. 35*d*, in this quantitative discharge apparatus 1A, the elastic membrane Et becomes like a cone part of the hopper body 2 so that all the powder material stored in the hopper body 2 can be discharged from the penetrating apertures hs . . . of the elastic membrane Et.

If caking or bridging is caused in the powder material stored in the hopper body 2, it can be destroyed by the vibration of the elastic membrane 3 so that such phenomenon isn't appeared in the powder material stored in the body 2.

That is to say, caking or bridging isn't caused in the powder material stored in the hopper body 2 of the quantitative discharge apparatus 1A, thereby the amount of material discharged from the port isn't changed because of caking or bridging which has been seen in prior hoppers.

According to this quantitative discharge apparatus 1A, as mentioned above, the discharge amount from the penetrating apertures hs . . . of the elastic membrane Et depends on the positive pulsating vibration air so that the apparatus has an advantage such that the amount of discharged material from the penetrating apertures hs . . . of the elastic membrane Et can be varied only by changing the conditions (amplitude, wavelength, wave shape, frequency and so on) of the positive pulsating vibration air.

Further, the quantitativeness of powder material discharged from the penetrating apertures hs . . . of the elastic membrane Et is superior in this quantitative discharge apparatus 1A. When the side of the apparatus 1A where the penetrating apertures hs . . . of the elastic membrane Et are provided is connected to a conduit (not shown), a steady pressure air or a positive pulsating vibration air for pneumatic transportation is supplied from one end of the conduit (not shown), and powder material is sprayed from the other end of the conduit, powder material with a constant concentration can be constantly and stably sprayed from the other end of the conduit (not shown).

While the powder material spray apparatus 1A is operated, it is preferable that the energy applied on the elastic membrane Et which is the sum of the weight ($W/cm^2$) of powder material stored on the elastic membrane Et and the pressure Pr2 in the tubular body 2 becomes larger than the pressure Pt in the conduit (not shown) ($W/cm^2$+Pr2>Pt) in order that the elastic membrane Et always vibrates while a specific point (for example a dimensional center or a center of gravity of the elastic membrane Et) is curved downward from its initial position or it is returned to its initial position from the curved position.

Figure 36:
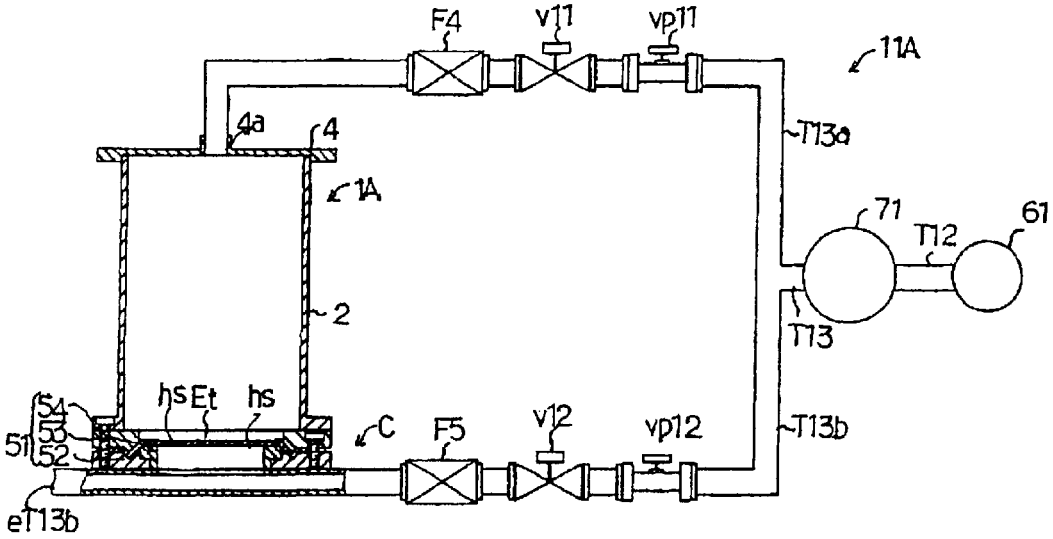
FIG. 36 is a constructional view showing one embodiment of a powder material spray apparatus using a quantitative discharge apparatus of the present invention.

FIG. 36 is a constructional view showing one embodiment of the powder material spray apparatus 11A using the quantitative discharge apparatus 1A of the present invention.

The powder material spray apparatus 11A is comprised of a quantitative discharge apparatus 1A, an air source 61 and a pulsating vibration air generation means 71.

The air source 61 and the pulsating vibration air generation means 71 are connected with a conduit T12 to supply a compressed air with steady pressure to the pulsating vibration generation means 71 via the conduit T12 when the air source 61 is driven.

When the air source 61 and the pulsating vibration generation means 71 are driven, the compressed air with steady pressure supplied in the pulsating vibration generation means 71 via the conduit T12 is designed to be converted and supplied to a conduit T13.

One end of the conduit T13 is connected to the pulsating vibration generation means 71.

The conduit T13 is divided into two conduits (branch pipes) T13*a* and T13*b*.

A switch valve v11 and a pressure regulating valve vp11 are provided in the midstream of one conduit (branch pipe) T13*a*.

The member indicated by the reference numeral F4 and provided in the midstream of the conduit T13*a* is a filter for removing dust contained in the positive pulsating vibration air generated by driving the air source 61 and the pulsating vibration generation means 71.

The quantitative discharge apparatus 1A is provided in the midstream of the other conduit (branch pipe) T13*b*.

More specifically, the elastic membrane Et side of the quantitative discharge apparatus 1A is connected at the midstream of the other conduit (branch pipe).

A switch valve V2 and a pressure regulating valve Vp2 are provided for the other conduit (branch pipe) T13*b*, the position being nearer to the pulsating vibration generation means 5 from a connection C of the conduit (branch pipe) T13*b* and the quantitative discharge apparatus 1A.

The member indicated by the reference numeral F5 and provided in the midstream of the conduit T13*b* is a filter for removing dust contained in the positive pulsating vibration air generated by driving the air source 6 and the pulsating vibration generation means 5.

Next, operations of the powder material spray apparatus 11A will be explained.

For quantitatively spraying powder material with constant concentration from an end eT13*b* of the other conduit (branch pipe) T13*b* of the powder material spray apparatus 11A, at first powder material is stored in the tubular body 2.

The cover 4 is airtightly attached to the material feed port 2*b* of the tubular body 2.

Then, the pressure regulating valves vp11 and vp12 are controlled with the switch valves v11 and v12 opened.

During quantitatively spraying powder material with constant concentration from the end eT13*b* of the other conduit (branch pipe) T13*b* of the powder material spray apparatus 11A, it is controlled such that the energy applied on the elastic membrane which is the sum of the weight per unit $W/cm^2$ of powder material stored on the elastic membrane Et and the pressure Pr2 in the tubular body 2 becomes larger than the pressure Pt13*b* in the conduit T13*b* ($W/cm^2$+Pr2>Pt13*b*) in order that the elastic membrane Et vibrates from the condition in FIG. 29*a* to the condition in FIG. 35*d* and reverse thereof.

Next, the air source 61 and the pulsating vibration generation means 71 are respectively driven at a fixed driving amount to supply a positive pulsating vibration air in the conduit T13.

The positive pulsating vibration air supplied in the conduit T13 is controlled to be a predetermined pressure by the pressure regulating valve vp11, then supplied into the hopper body 2 from the air supply port 4*a* via the conduit (branch pipe) T13*a*.

The positive pulsating vibration air supplied in the conduit T13 is controlled to be a predetermined pressure by the pressure regulating valve vp12, then supplied into the conduit (branch pipe) T13*b*.

The elastic membrane is constantly vibrated by the positive pulsating vibration air supplied in the tubular body 2 and the positive pulsating vibration air supplied in the conduit (branch pipe) T13*b*.

The constant vibration is controlled such that the energy applied on the elastic membrane Et which is the sum of the weight per unit $W/cm^2$ of powder material stored on the elastic membrane Et and the pressure Pr2 in the tubular body 2 becomes larger than the pressure Pt13*b* in the conduit T13*b* ($W/cm^2$+Pr2>Pt13*b*), thereby the elastic membrane Et vibrates from FIG. 35*a* to FIG. 35*d* or from FIG. 35*d* to FIG. 35*a*.

According to this constant vibration of the elastic membrane Et, a fixed amount of powder material is discharged form the penetrating apertures hs . . . of the elastic membrane Et.

The powder material discharged from the penetrating apertures hs . . . of the elastic membrane Et into the conduit (branch pipe) T13*b* is mixed with and dispersed in the positive pulsating vibration air supplied in the conduit (branch pipe) T13*b* and is pneumatically transported into the other end eT13*b* thereof to be sprayed together with air therefrom.

According to the powder material spray apparatus 11A, a positive pulsating vibration air is supplied in the conduit (branch pipe) T13*b* so that attachment, accumulation or pinhole phenomena of powder material in the conduit (branch pipe) T13*b* isn't caused which has been often seen when a steady pressure air is supplied in the conduit T13*b*.

Therefore, powder material can be sprayed from the other end eT13*b* of the conduit (branch pipe) T13*b* while keeping the concentration when it is discharged from the penetrating apertures hs . . . of the elastic membrane Et, so that the apparatus 11A is superior in quantitativeness of powder material sprayed from the other end eT13*b* of the conduit (branch pipe) T13*b*.

Further, an air source and a pulsating vibration air generation means are provided respectively, thereby facilitating the construction of the apparatus.

In addition, when only a pulsating vibration air generation means is provided, the phase of the positive pulsating vibration air supplied in the tubular body 2 and the pulsating vibration air supplied in the connection C between the conduit (branch pipe) T13*b* and the quantitative discharge apparatus 1A can be easily changed by controlling the length of the conduit (branch pipe) T13*a* and the conduit (branch pipe) T13*b*, so that the amplitude of the elastic membrane 3 can be changed randomly.

For example, if the length of the conduit (branch pipe) T13*a* and the conduit (branch pipe) T13*b* is controlled, the positive pulsating vibration air supplied in the connection C between the conduit T13*b* and the quantitative discharge apparatus 1A is made its peak amplitude when the positive pulsating vibration air supplied in the tubular body 2 is its peak amplitude. In this case the amplitude of the elastic membrane Et can be reduced.

On the other hand, for example, if the length of the conduit (branch pipe) T13*a* and the conduit (branch pipe) T13*b* is controlled, the positive pulsating vibration air supplied in the connection C between the conduit T13*b* and the quantitative discharge apparatus 1A is made its valley amplitude when the positive pulsating vibration air supplied in the tubular body 2 is its valley amplitude. In this case the amplitude of the elastic membrane Et can be increased.

Thus, the powder material spray apparatus 11A has an advantage such that when the amplitude of the elastic membrane Et is changed at random by controlling the length of the conduit (branch pipe) T13*a* and the conduit (branch pipe) T13*b*, the discharge amount of powder material from the penetrating apertures hs . . . of the elastic membrane Et is changed so that powder material can be sprayed from the other end eT13*b* of the conduit (branch pipe) T13*b* quantitatively and stably.

The concentration of the powder material sprayed from the other end of eT13*b* of the conduit (branch pipe) T13*b* can be changed by varying the size and shape of each penetrating apertures hs . . . .

Several kinds or shapes of nozzle heads are connected to the other end eT13*b* of the conduit (branch pipe) T13*b* depending on the kinds of powder material to be used and the kinds of object to be sprayed with powder material.

Figure 37:
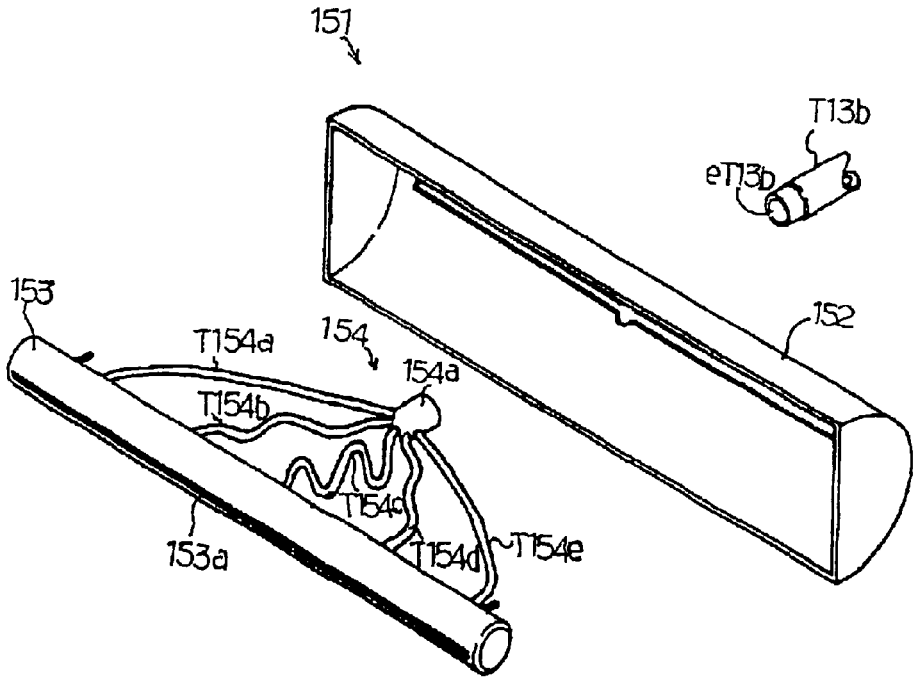
FIG. 37 is an exploded perspective view exemplifying a nozzle head suitable for uniformly spraying powder material in a relatively large area.

FIG. 37 is an exploded perspective view exemplifying a nozzle head suitable for uniformly spraying powder material in a relatively large area.

The nozzle head 151 has a shade 152 which is formed to be obtained by cutting the tubular body along the axial direction and a tubular spray head 153 provided therein.

A slit opening 153*a* is provided for the spray head 153.

Further, a connection member 154 is provided for the spray head 153 opposite to the slit opening 153*a*.

The connection member 154 has a connection pipe 154*a*, conduits (branch pipe) T154*a*, T154*b*, T154*c*, T154*d* and T154*e* which are branched from the connection pipe 154*a*.

The conduits (branch pipe) T154*a*, T154*b*, T154*c*, T154*d* and T154*e* have almost the same length.

Each one of the conduits (branch pipe) T154*a*, T154*b*, T154*c*, T154*d* and T154*e* is connected to the spray head 154 at even intervals.

The connection pipe 154*a* is connected to the other end eT13*b* of the conduit (branch pipe) T13*b*.

The nozzle head 151 is constructed such that the conduits (branch pipe) T154*a*, T154*b*, T154*c*, T154*d* and T154*e* with the same length are connected at even intervals each other to the spray head 153 opposite to the slit opening 153*a*.

Thereby, when the connection pipe 154*a* is connected to the other end eT13*b* of the conduit (branch pipe) T13*b*, powder material pneumatically transported to the end eT13*b* of the conduit (branch pipe) T13*b* is further pneumatically transported in each conduit (branch pipe) T154*a*, T154*b*, T154*c*, T154*d* and T154*e* while being applied with the same load, thereby powder material with the same concentration is supplied in each conduit (branch pipe) and the connection of the spray head 153.

As mentioned above, the conduits (branch pipes) T154*a*, T154*b*, T154*c*, T154*d* and T154*e* are connected to the spray head 153 at even intervals.

Therefore, powder material are supplied from one end to the other end of the spray head 153 keeping almost the same concentration. Further, after being supplied in the spray head 153 and dispersed in an opening therein, powder material is sprayed from the slit opening 153*a* at substantially the same concentration from one end to the other end of the slit opening 153.

The spray head 153 is contained in the shade 152 so that powder material doesn't scatter into directions other than the opening of the shade 152.

That is to say, the nozzle head 151 is suitable for uniformly spraying powder material at relatively wide area.

More specifically, the nozzle head 151 is designed to store a molding lubricant powder in the tubular body 2 and is suitable as a nozzle head for uniformly spraying a molding lubricant powder on a wide area such as a molding surface of a mold of an injection molding machine.

Next, the present invention is explained based on a specific experimental data.

Magnesium Stearate (average particle diameter: 10 $\mu$m) was prepared as powder material.

Plural elastic membranes with 62 mm diameter and 1.0 mm thickness were prepared.

Elastic membranes with one, three, five, seven or ten cut apertures (slit) were prepared.

The length of the cut aperture (slit) was 1.0 mm.

A virtual circle (diameter: 50 mm) was drawn around a specific point (a dimensional center of the elastic membrane in this embodiment) on each elastic membrane Et and the cut apertures (slit) were formed on the circumference of the circle at even intervals.

Cutting direction of each cut aperture (slit) was formed in a tangential direction of the virtual circle (diameter 50 mm).

Each one of plural elastic membrane with different numbers of cut apertures (slit), prepared as mentioned above, was attached on the tubular body 2 by means of the elastic membrane installation means 51 having the same standard and the powder material spray apparatus 11A as shown in FIG. 17 was constructed.

Next, a fixed amount of magnesium stearate (average particle diameter: 10 $\mu$m) was contained in the tubular body 2 of the powder material spray apparatus 11A and a positive pulsating vibration air of which the frequency was 20 Hz and the average air pressure was 0.2 Mpa was supplied in the conduit T5*b* by means of the air source 61 and the pulsating vibration air generation means 71. Then the concentration (spray amount) of the magnesium stearate from the discharge port 41*b* was measured.

Figure 38:
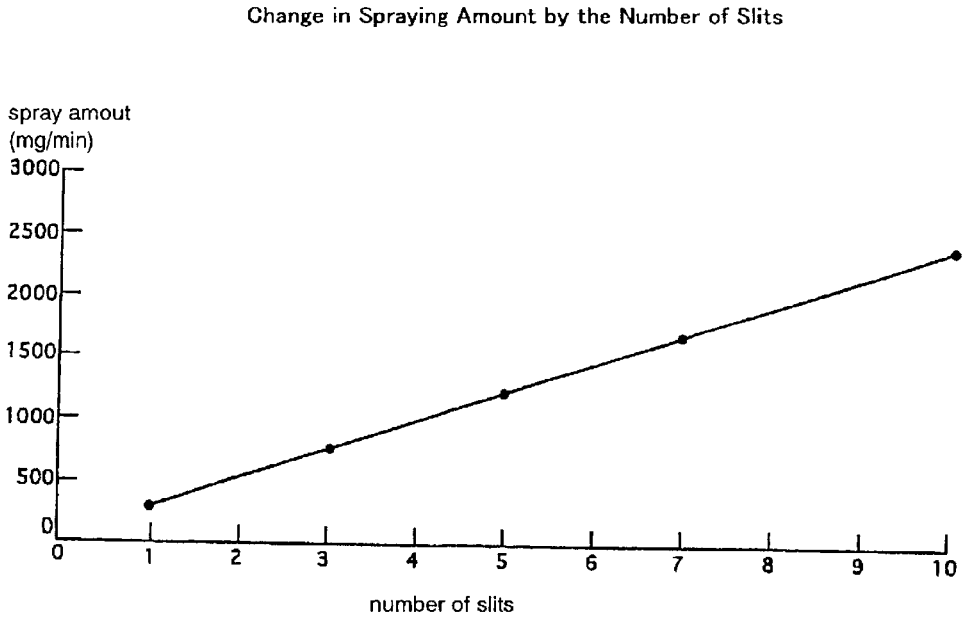
FIG. 38 is experimental data showing correlation of the number of cut apertures (slit) and spray amount.

The result is shown in FIG. 38.

According to the result shown in FIG. 38, it was found that if cut apertures (slit) were provided according to the present invention, the concentration (spray amount) of the magnesium stearate was quantitatively changed while keeping a positive relation depending on the numbers of the cut apertures (slit).

Further, the same experiments mentioned above was executed as a comparison example using the elastic membrane with three, five, seven or ten cut apertures (slit) at random. In this comparison example, the concentration (spray amount) of the magnesium stearate wasn't quantitatively changed while keeping a positive relation depending on the numbers of the cut apertures (slit).

Industrial Applicability

As mentioned above, in this quantitative discharge apparatus of the present invention, plural penetrating apertures are formed on the elastic membrane so that the discharge amount of powder material from the quantitative discharge apparatus can be increased at the ratio of the increased number of the apertures comparing with the elastic membrane with one penetrating aperture even if the conditions of the positive pulsating vibration air supplied into the elastic membrane aren't changed.

According to this quantitative discharge apparatus of the present invention, the elastic membrane having plural penetrating apertures arranged in a point symmetrical manner with respect to a specific point is used. When a positive pulsating vibration air is supplied to vibrate the elastic membrane with the periphery being a node of vibration, the discharge amount of powder material from the quantitative discharge apparatus can be increased comparing with the case when the elastic membrane having plural penetrating apertures with the same number and the same shape at random under the same condition of the positive pulsating vibration air.

According to this quantitative discharge apparatus of the present invention, the elastic membrane with plural penetrating apertures arranged in symmetric with respect to a line passing on the specific point is used. When a positive pulsating vibration air is supplied into the elastic membrane to be vibrated with its periphery being a node of vibration, the discharge amount of powder material from the quantitative discharge apparatus can be increased comparing with the case when the elastic membrane having plural penetrating apertures with the same number and the same shape at random under the same condition of the positive pulsating vibration air.

According to this quantitative discharge apparatus of the present invention, a virtual circle is drawn around a specific point on the elastic membrane and plural penetrating apertures are formed on its circumference. When each one of the plural penetrating apertures has the same size and shape, it shows the same behavior (the same deformation (expansion and contraction)) in case that a pulsating vibration air is supplied into the elastic membrane to be vibrated with its periphery being vibration node.

As a result, if the positive pulsating vibration air supplied into the elastic membrane is constant and the penetrating apertures with the same size and shape are formed on the elastic membrane, the discharge amount of powder material from the quantitative discharge apparatus can be increased in a positive correlation to the number of the penetrating apertures on the elastic membrane.

According to this quantitative discharge apparatus of the present invention, a virtual circle is drawn around a specific point on the elastic membrane and plural penetrating apertures are formed on the circumference of the virtual circle at even intervals. If each one of plural penetrating apertures has the same size and shape, the elastic membrane can execute vibration with high reproducibility with its center being a vibration antinode and its periphery being a vibration node when the positive pulsating vibration air is supplied on the elastic membrane.

Thereby, comparing with the quantitative discharge apparatus using the elastic membrane on which plural penetrating apertures are partialized on an area, the discharge amount of powder material is quantitatively changed keeping a positive relation to the number of the penetrating apertures on the elastic membrane.

Namely, according to this quantitative discharge apparatus the number of penetrating apertures are increased in such a manner that a virtual circle is drawn around a specific point on the elastic membrane and plural numbers of the apertures are formed at even intervals on the circumference of the virtual circle, thereby the discharge amount of powder material is quantitatively changed keeping a positive relation to the number of the penetrating apertures on the elastic membrane.

According to the quantitative discharge apparatus of the present invention, as long as each one of the plural penetrating apertures formed on the elastic membrane of the quantitative discharge apparatus is a cut aperture (slit) and the positive pulsating vibration air supplied onto the elastic membrane is constant, the discharge amount of powder material from the cut apertures (slit) formed on the membrane is designed to be constant, thereby achieving high quantitativeness of the discharge amount of powder material.

According to the quantitative discharge apparatus of the present invention, the cutting direction of the cut apertures (slit) is a tangential direction of the circle on which plural apertures are formed and the elastic membrane repeats the cycle at high reproducibility wherein each one of plural apertures is opened like a letter V and the is closed like a reverse letter V when the elastic membrane is vibrated by a positive pulsating vibration air supplied thereto. Therefore, a large amount of powder material can be quantitatively discharged through the cut apertures (slit) comparing with the quantitative discharge apparatus using the elastic membrane on which penetrating apertures with the same shape, the same size and the same number are formed in radial direction from a specific point on the elastic membrane to its periphery.

According to the quantitative discharge apparatus of the present invention, a penetrating aperture is also provided at the specific point which is a center of a virtual circle on the elastic membrane, thereby further enabling to increase the discharge amount of powder while keeping a positive relation.

According to the quantitative discharge apparatus of the present invention, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) being formed on the tangent of a virtual circle drawn around a specific point. Thereafter, penetrating apertures (cut aperture (slit)) are further formed on the circumference of the virtual circle drawn around a specific point so as to have an angle against the tangent so that the discharge amount of powder material is controlled to be an objective amount. As a result, the amount of powder material discharged from the quantitative discharge apparatus can be accurately controlled to be an objective amount.

According to the quantitative discharge apparatus of the present invention, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) being formed on the tangent of a virtual circle drawn around a specific point. Thereafter, penetrating apertures (cut aperture (slit)) are further formed on the circumference of the virtual circle drawn around a specific point so as to have an angle against the tangent so that the discharge amount of powder material is controlled to be an objective amount. Further, cut apertures (slit) are formed on the circumference of the virtual circle in radial from the center of the virtual circle on the elastic membrane, thereby the discharge amount of powder material is minutely controlled to be the objective amount. As a result, the amount of powder material discharged from the quantitative discharge apparatus can be more accurately controlled to be an objective amount.

According to the quantitative discharge apparatus of the present invention, the center of the virtual circle drawn on the elastic membrane agrees with the center of the antinode of vibration on the elastic membrane when the membrane is vibrated by a positive pulsating vibration air and plural penetrating apertures are formed on thus drawn virtual circumference, thereby the apertures represent substantially the same behavior. As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, the center of the virtual circle drawn on the elastic membrane agrees with the center of gravity of the elastic membrane which is the center of the antinode of vibration when the membrane is vibrated by a positive pulsating vibration air and plural penetrating apertures are formed on thus drawn virtual circumference, thereby the apertures represent substantially the same behavior. As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, the center of the virtual circle agrees with the center of antinode of vibration on the elastic membrane, the antinode being made by the positive pulsating vibration air supplied on the elastic membrane, and plural penetrating apertures are formed on thus drawn virtual circumference, thereby the apertures represent substantially the same behavior. As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the quantitative discharge apparatus of the present invention, this quantitative discharge apparatus is constructed in a manner that a positive pulsating vibration air is supplied under the elastic membrane so that a powder material spray apparatus with high quantitativeness which accurately sprays powder material with a desirable concentration at a desired place can be easily composed by utilizing a positive pulsating vibration air supplied for vibrating the elastic membrane as a pneumatic transport means of the powder material discharged from the plural penetrating apertures of the elastic membrane.

According to the quantitative discharge apparatus of the present invention, the quantitative discharge apparatus is constructed such that a positive pulsating vibration air is supplied from above the powder material stored in the tubular body so that caking of powder material doesn't occur on a cone part like a conventional hopper. Therefore such a quantitative discharge means is superior in quantitativeness of the discharge material from the plural penetrating apertures.

According to the quantitative discharge apparatus of the present invention, the elastic membrane with plural penetrating apertures is attached to the lower part of the tubular body by means of the elastic membrane installation means. The elastic membrane is placed on the push-up member placed on the pedestal and the presser member is tightened to the pedestal, thereby the membrane is pushed into the presser member by the push-up member. As a result, the elastic membrane is expanded from its center to its periphery when being pushed into the direction of the presser member.

At first, the elastic membrane expanded by the push-up member is gradually inserted between the V-groove formed on the pedestal and the V-shaped projection formed on the surface of the presser member facing the pedestal via the space between the periphery of the push-up member and the surface (inner surface) forming the opening of the presser member.

Furthermore, as the presser member is fastened to the pedestal, the elastic membrane comes to be held between the periphery of the push-up member and the inner surface of the opening of the presser member while being pushed up into the presser member by the push-up member. When the elastic membrane is further pushed up into the presser member by the push-up member, the expanded part of the elastic membrane from inside to outside inserted between the V-groove of the pedestal and the V-shaped projection on the surface of the presser member facing the pedestal is held therebetween.

As mentioned above, according to this quantitative discharge apparatus, the elastic membrane can be uniformly stretched by a simple operation such that the elastic membrane is placed on the push-up member on the pedestal and the presser member is tightened to the pedestal.

According to the quantitative discharge apparatus of the present invention, the quantitative discharge apparatus is constructed such that the inclined plane having a bottom part broader than its top part when seen in section is formed on the periphery of the push-up member. For attaching the elastic membrane on the elastic membrane installation means, the elastic membrane can be kept evenly and uniformly expanded by a simple operation such that the elastic membrane is placed on the push-up member on the pedestal and the presser member is tightened to the pedestal. Further, the elastic membrane of the quantitative discharge apparatus doesn't get slack during operation, thereby the quantitative discharge apparatus capable of keeping accurate operation can be achieved.

According to the method for discharging powder material of the present invention, the elastic membrane is vibrated by the positive pulsating vibration air being its periphery as a node of vibration. Because the vibration of the elastic membrane depends on the positive pulsating vibration air, the elastic membrane repeats a constant vibration depending on the positive pulsating vibration air if a constant positive pulsating vibration air is supplied.

The discharge amount of powder material per time from the plural penetrating apertures on the elastic membrane also depends on vibration of the elastic membrane. If the vibration pattern of the elastic membrane is the same, constant amount of material can be always discharged.

Therefore, applying this method for discharging powder material, when a constant positive pulsating vibration air is used, the discharge amount of powder material per time from the plural penetrating apertures of the elastic membrane can be always constant. Thereby, quantitative discharge of a minute amount of powder material which has been considered to be difficult in a prior art can be accomplished.

In this discharge method of powder material, because the plural penetrating apertures are formed on the elastic membrane, the discharge amount of powder material from the quantitative discharge apparatus can be increased in a ratio of the increased number of the penetrating apertures comparing with the elastic membrane having one penetrating aperture even if the conditions of the positive pulsating vibration air aren't changed.

According to the method of discharging powder material of the present invention, the elastic membrane with plural penetrating apertures arranged in a point symmetrical manner with respect to a specific point is used. When a positive pulsating vibration air is supplied onto the elastic membrane to be vibrated with its periphery being a node of vibration, the discharge amount of powder material from the quantitative discharge apparatus can be increased comparing with the case when the elastic membrane on which plural penetrating apertures with the same number and the same shape are formed at random is formed under the same condition of the positive pulsating vibration air.

According to the method of discharging powder material of the present invention, the elastic membrane with plural penetrating apertures arranged in an axial symmetrical manner with respect to the line passing on the specific point is used. When a positive pulsating vibration air is supplied onto the elastic membrane to be vibrated with its periphery being a node of vibration, the discharge amount of powder material from the quantitative discharge apparatus can be increased comparing with the case when the elastic membrane on which plural penetrating apertures with the same number and the same shape are formed at random is used under the same condition of the positive pulsating vibration air.

According to this method of discharging powder material, a virtual circle is drawn around the specific point on the elastic membrane and plural penetrating apertures are formed on its circumference. When each one of the plural penetrating apertures has the same size and shape, it shows the same behavior (the same deformation (expansion and contraction)) in case that a pulsating vibration air is supplied to vibrate the elastic membrane with its periphery being a vibration node.

As a result, if the positive pulsating vibration air supplied into the elastic membrane is constant and the penetrating apertures with the same size and shape are formed on the elastic membrane, the discharge amount of powder material from the quantitative discharge apparatus can be increased in a positive correlation to the number of the penetrating apertures on the elastic membrane.

In this quantitative discharge apparatus, a virtual circle is drawn around a specific point on the elastic membrane and plural penetrating apertures are formed on the circumference of a specific virtual circle at even intervals. If each one of plural penetrating apertures has the same size and shape, the elastic membrane can execute vibration with high reproducibility with its center being a vibration antinode and its periphery being a vibration node when the positive pulsating vibration air is supplied on the elastic membrane.

According to this discharge method for powder material, comparing with the discharge method using the elastic membrane on which plural penetrating apertures are partialized on an area, the discharge amount of powder material is quantitatively changed keeping a positive relation to the number of the penetrating apertures on the elastic membrane.

Namely, according to this discharge method for powder material, the number of penetrating apertures are increased in such a manner that a virtual circle is drawn around a specific point on the elastic membrane and plural numbers of the apertures are formed at even intervals on the circumference of a specific virtual circle, thereby the discharge amount of powder material is quantitatively changed keeping a positive relation to the number of the penetrating apertures on the elastic membrane.

According to the method of discharging powder material of the present invention, because the plural penetrating apertures formed on the elastic membrane are cut aperture (slit), as long as the positive pulsating vibration air supplied into the elastic membrane is constant, the discharge amount of powder material from the apertures (slit) formed on the membrane is designed to be constant, thereby quantitative discharge of powder material can be achieved.

According to the method of discharging powder material of the present invention, the cutting direction of the cut apertures (slit) is a tangential direction of the circumference on which plural apertures are formed and the elastic membrane repeats the cycle at high reproducibility wherein each plural aperture is opened like a letter V, then is closed, and again is opened like a reverse V-shape when the elastic membrane is vibrated by the positive pulsating vibration air supplied thereto.

As a result, applying this discharge method for powder material, a large amount of powder material on the elastic membrane can be quantitatively discharged through the cut apertures (slit) comparing with the discharge method wherein the elastic membrane is formed with plural cut apertures (slit) which are the same shape, size and number and of which cutting direction is in a radial direction from the virtual circle to its periphery and wherein the positive pulsating vibration air having the same conditions as the present invention is used.

According to the method of discharging powder material of the present invention, the discharge amount of powder material is increased keeping a positive relation at a ratio of being providing a further penetrating aperture at the center of the virtual circle on the elastic membrane.

According to the method of discharging powder material of the present invention, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) being formed on the tangential direction to the circumference of a virtual circle drawn around a specific point. Thereafter, penetrating apertures (cut aperture (slit)) are further formed on the circumference of the virtual circle drawn around the specific point so as to have an angle against the tangent so that the discharge amount of powder material is controlled to be the objective amounts. As a result, the amount of powder material discharged from the quantitative discharge apparatus can be accurately controlled to be the objective amounts.

According to the method of discharging powder material of the present invention, for controlling the discharge amount of powder material from the quantitative discharge apparatus, when the discharge amount of powder material from the apparatus is remarkably small comparing with the objective amount, the discharge amount of powder material from the apparatus is subject to be approached to the objective discharge amount with a small number of penetrating apertures (cut aperture (slit)) being formed on the tangent of a circumference of a specific drawn around a specific point. Thereafter, penetrating apertures (cut aperture (slit)) are further formed on the circumference of the virtual circle drawn around the specific point so as to have an angle against the tangent so that the discharge amount of powder material is controlled to be the objective amount. Further, cut apertures (slit) are formed on the circumference of the virtual circle in radial from the center of the virtual circle on the elastic membrane, thereby the discharge amount of powder material is minutely controlled to be the objective amount. As a result, the amount of powder material discharged from the quantitative discharge apparatus can be more accurately controlled to be an objective amount.

According to the method of discharging powder material of the present invention, the center of the virtual circle drawn on the elastic membrane agrees with the outline center of the elastic membrane which is the center of the antinode of vibration when the membrane is vibrated by the positive pulsating vibration air and plural penetrating apertures are formed on thus drawn virtual circumference, thereby the apertures represent substantially the same behavior.

As the result, applying this discharge method for powder material, when the positive pulsating vibration air supplied to the elastic membrane is constant, the discharge amount of powder material can be quantitatively varied while the discharge amount keeps an almost positive relation to the number of the penetrating apertures formed on the membrane.

According to the method of discharging powder material in the present invention, the center of the virtual circle drawn on the elastic membrane agrees with the center of gravity of the elastic membrane which is the center of the antinode of vibration when the membrane is vibrated by the positive pulsating vibration air and plural penetrating apertures are formed on thus drawn virtual circumference, thereby the apertures represent substantially the same behavior.

As the result, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the method of discharging powder material of the present invention, the center of the virtual circle is drawn around the center of antinode of vibration on the elastic membrane, the antinode being made by the positive pulsating vibration air supplied on the elastic membrane, and plural penetrating apertures are formed on thus drawn virtual circumference, thereby the apertures represent substantially the same behavior.

As the result, applying this discharge method, when the positive pulsating vibration air supplied to the elastic membrane is constant, the quantitative discharge apparatus can quantitatively vary the discharge amount of powder material while the discharge amount keeps an almost positive relation to the number of the penetrating apertures formed on the membrane.

According to the method of discharging powder material of the present invention, this discharge method applies the construction such that a positive pulsating vibration air is supplied under the elastic membrane so that a powder material spray apparatus with high quantitativeness which accurately sprays powder material with a desirable concentration at a desired place can be easily composed by utilizing a positive pulsating vibration air supplied for vibrating the elastic membrane as a pneumatic transport means of the powder material discharged from the plural penetrating apertures of the elastic membrane.

According to the method of discharging powder material of the present invention, this discharge apparatus is constructed such that a positive pulsating vibration air is supplied from above the powder material stored in the tubular body so that caking of powder material doesn't occur on the cone part like a conventional hopper.

As a result, such a discharge method is superior in quantitativeness of discharge material from the plural penetrating apertures.

According to the method of discharging powder material of the present invention, the elastic membrane with plural penetrating apertures is attached to the lower part of the tubular body by means of the elastic membrane installation means. The elastic membrane is placed on the push-up member placed on the pedestal and the presser member is tightened to the pedestal, thereby the membrane is pushed into the presser member by the push-up member. As a result, the elastic membrane is expanded from its center to its periphery when being pushed into the direction of the presser member.

At first, the elastic membrane expanded by the push-up member is gradually inserted between the V-groove formed on the pedestal and the V-shaped projection formed on the surface of the presser member facing the pedestal via the space between the periphery of the push-up member and the surface (inner surface) forming the opening of the presser member.

Furthermore, as the presser member is fastened to the pedestal, the elastic membrane comes to be held between the periphery of the push-up member and the inner surface of the opening of the presser member while being pushed up into the presser member by the push-up member. When the elastic membrane is further pushed up into the presser member by the push-up member, the expanded part of the elastic membrane from inside to outside inserted between the V-groove of the pedestal and the V-shaped projection on the surface of the presser member facing the pedestal is held therebetween.

As mentioned above, according to this discharge method, the elastic membrane can be uniformly stretched by a simple operation such that the elastic membrane is placed on the push-up member on the pedestal and the presser member is tightened to the pedestal.

According to the method of discharging powder material of the present invention, the elastic membrane installation means used for this discharge method has the inclined plane having a bottom part broader than its top part when seen in section at the periphery of the push-up member of the elastic membrane installation means of the quantitative discharge apparatus. Therefore, the expanded part of the elastic membrane from inside to outside by being pushed up into the presser member is easily moved between the V-groove annularly formed on the pedestal and the V-shaped projection annularly formed on the surface of the presser member facing the pedestal.

When the presser member is fastened to the pedestal, the distance between the inclined plane of the periphery of the push-up member and the inner circumference of the opening of the presser member becomes small, and the elastic membrane is tightly held between the inclined plane of the push-up member and the inner circumference of opening of the presser member, preventing the elastic membrane from being slack.

Thus, applying this method for discharging powder material, the elastic membrane doesn't get slack during usage so that the quantitative discharge apparatus can keep its accurate operation for a long time.

This discharge method applies the construction such that the inclined plane from top to bottom is formed on the periphery of the push-up member when seen sectionally. For attaching the elastic membrane on the elastic membrane installation means, the elastic membrane can be kept evenly and uniformly expanded by a simple operation such that the elastic membrane is placed on the push-up member on the pedestal and the presser member is tightened to the pedestal. Further, the elastic membrane of the quantitative discharge apparatus doesn't get slack during operation, thereby the quantitative discharge apparatus capable of keeping accurate operation for a long time can be achieved.

What is claimed is:

1. A discharge apparatus for powder material, comprising:

a tubular body for storing powder material; and an elastic membrane having plural penetrating apertures, said membrane constituting a bottom of said tubular body;

wherein said elastic membrane is vibrated by applying a positive pulsating vibration air thereto in a manner that the vibration node appears at the periphery of the elastic membrane, and thereby discharging powder material stored in said tubular body from said plural penetrating apertures of said elastic membrane, said plural penetrating apertures of said elastic membrane being formed of a cut aperture, at even intervals and in a tangential direction to the circumference of a specific virtual circle, the center of which is a specific point on said elastic membrane.

2. A discharge apparatus for powder material, comprising:

a tubular body for storing powder material; and an elastic membrane having plural penetrating apertures, said membrane constituting a bottom of said tubular body;

wherein said elastic membrane is vibrated by applying a positive pulsating vibration air thereto in a manner that the vibration node appears at the periphery of the elastic membrane, and thereby discharging powder material stored in said tubular body from said plural penetrating apertures of said elastic membrane, wherein said plural penetrating apertures of said elastic membrane are formed in a point symmetrical manner with respect to a specific point on said elastic membrane, said plural penetrating apertures of said elastic membrane being formed of a cut aperture, at even intervals and in a tangential direction to the circumference of a specific virtual circle, the center of which is said specific point on said elastic membrane.

3. A discharge apparatus for powder material, comprising: a tubular body for storing powder material; and an elastic membrane having plural penetrating apertures, said membrane constituting a bottom of said tubular body;

wherein said elastic membrane is vibrated by applying a positive pulsating vibration air thereto in a manner that the vibration node appears at the periphery of the elastic membrane, and thereby discharging powder material stored in said tubular body from said plural penetrating apertures of said elastic membrane, wherein said plural penetrating apertures of said elastic membrane are formed in an axial symmetrical manner with respect to a specific line passing on a specific point on said elastic membrane, said plural penetrating apertures of said elastic membrane being formed of a cut aperture, at even intervals and in a tangential direction to the circumference of a specific virtual circle, the center of which is said specific point on said elastic membrane.

4. The quantitative discharge apparatus as set forth in in any of claims 1–3, wherein a penetrating aperture is further formed on a specific point on said elastic membrane.

5. The quantitative discharge apparatus as set forth in any of claims 1–3, wherein the discharge amount of powder material in said quantitative discharge apparatus is adjustable at a desired value depending on the number of said plural penetrating apertures formed on said elastic membrane, wherein a predetermined number of penetrating apertures are at first formed on a tangent of said circumference of a specific virtual circle on said elastic membrane, said tangent including the contact point with said circumference, and wherein a predetermined number of penetrating apertures are next formed on a line with a specific angle across said tangent of said circumference of a specific virtual circle on said elastic membrane, said line including the contact point with said circumference.

6. The quantitative discharge apparatus as set forth in claim 5, wherein a predetermined number of penetrating apertures on said elastic membrane are formed on the circumference of the specific virtual circle around the specific point on said elastic membrane in a radial direction extending from said specific point of said virtual circle.

7. The quantitative discharge apparatus as set forth in claim 6, wherein said specific point on said elastic membrane accords with the center of the outline shape of said elastic membrane.

8. The quantitative discharge apparatus as set forth in claim 7, wherein said specific point on said elastic membrane accords with the center of gravity of said elastic membrane.

9. The quantitative discharge apparatus as set forth in claim 8, wherein said specific point on said elastic membrane accords with the center of said vibration node which appears on said elastic membrane when said positive pulsating vibration air is supplied into said elastic membrane.

10. The quantitative discharge apparatus as set forth in claim 9, wherein said positive pulsating vibration air is supplied from below said elastic membrane.

11. The quantitative discharge apparatus as set forth in claim 9, wherein said positive pulsating vibration air is supplied from above the powder material stored in said tubular body.

12. The quantitative discharge apparatus as set forth in claim 11, in which said elastic membrane is attached to the lower portion of said tubular body by means of an elastic membrane installation means, wherein said elastic membrane installation means comprises:

a pedestal with an opening at its center;

a push-up member with an opening at its center, which is disposed in the standing status on said pedestal; and a presser member with an opening at its center, said opening being a little larger than the periphery size of said push-up member, wherein said pedestal has on its surface an annular V-groove so formed as to surround said opening of said pedestal outside of the periphery of said push-up member and outside of said opening of said pedestal, whereas said presser member has on its surface facing said pedestal an annular V-shape projection portion so formed as to engage into said annular V-groove on the surface of said pedestal, wherein said push-up member is disposed on the surface of said pedestal, on which said elastic membrane is disposed, and further said presser member is so tightly secured as to cover said push-up member together with said elastic membrane to said pedestal, whereby said elastic membrane is expanded from its inner side to its outer side by being pushed up toward said presser member by means of said push-up member, while the periphery part of said elastic membrane is held between the periphery part of said push-up member and the surface forming an opening of said presser member and further expanded to be held between said annular V-groove formed on the surface of said pedestal and said annular V-shape projection portion formed on the surface facing said pedestal, and wherein said presser member is secured to the lower portion of said tubular body.

13. The quantitative discharge apparatus as set forth in claim 12, wherein an inclined plane is formed on the periphery of said push-up member, said inclined plane having a bottom part broader than its top part when seen in its section.

14. A method of discharging powder material comprising the steps of:

storing powder material in a tubular body to which an elastic membrane with plural penetrating apertures is attached so that it constitutes a bottom of said tubular body;

vibrating said elastic membrane by applying positive pulsating vibration air thereto so as to make said elastic membrane vibrate in a manner that the vibration node appears at its periphery, and thereby discharging said powder material stored in said tubular body from said plural apertures, said plural penetrating apertures of said elastic membrane being formed of a cut aperture, at even intervals and in a tangential direction to the circumference of a specific virtual circle, the center of which is a specific point on said elastic membrane.

15. A method of discharging powder material, comprising the steps of:

storing powder material in a tubular body to which an elastic membrane with plural penetrating apertures is attached so that it constitutes a bottom of said tubular body;

vibrating said elastic membrane by applying positive pulsating vibration air thereto so as to make said elastic membrane vibrate in a manner that the vibration node appears at its periphery, and thereby discharging said powder material stored in said tubular body from said plural apertures, wherein said plural penetrating apertures of said elastic membrane are formed in a point symmetrical manner with respect to a specific point on said elastic membrane, said plural penetrating apertures of said elastic membrane being formed of a cut aperture, at even intervals and in a tangential direction to the circumference of a specific virtual circle, the center of which is said specific point on said elastic membrane.

16. A method of discharging powder material comprising the steps of:

storing powder material in a tubular body to which an elastic membrane with plural penetrating apertures is attached so that it constitutes a bottom of said tubular body;

vibrating said elastic membrane by applying positive pulsating vibration air thereto so as to make said elastic membrane vibrate in a manner that the vibration node appears at its periphery, and thereby discharging said powder material stored in said tubular body from said plural apertures, wherein said plural penetrating apertures of said elastic membrane are formed in an axial symmetrical manner with respect to a specific line passing on a specific point on said elastic membrane, said plural penetrating apertures of said elastic membrane being formed of a cut aperture, at even intervals and in a tangential direction to the circumference of a specific virtual circle, the center of which is said specific point on said elastic membrane.

17. The method of discharging powder material as set forth in any of claims 14–16, wherein a penetrating aperture is further formed on a specific point on said elastic membrane.

18. The method of discharging powder material as set forth in any of claims 14–16, wherein the discharge amount of powder material is adjustable at a desired value depending on the number of said plural penetrating apertures formed on said elastic membrane, wherein a predetermined number of penetrating apertures are at first formed on a tangent of said circumference of a specific virtual circle on said elastic membrane, said tangent including the contact point with said circumference, and wherein a predetermined number of penetrating apertures are next formed on a line with a specific angle across said tangent of said circumference of a specific virtual circle on said elastic membrane, said line including the contact point with said circumference.

19. The method of discharging powder material as set forth in claim 18, wherein a predetermined number of penetrating apertures on said elastic membrane are formed on the circumference of a specific virtual circle around the specific point on said elastic membrane in a radial direction extending from said specific point of said virtual circle.

20. The method of discharging powder material as set forth in claim 19, wherein said specific point on said elastic membrane accords with the center of the outline shape of said elastic membrane.

21. The method of discharging powder material as set forth in claim 20, wherein said specific point on said elastic membrane accords with the center of gravity of said elastic membrane.

22. The method of discharging powder material as set forth in claim 21, wherein said specific point on said elastic membrane accords with the center of said vibration node which appears on said elastic membrane when said positive pulsating vibration air is supplied into said elastic membrane.

23. The method of discharging powder material as set forth in claim 22, wherein said positive pulsating vibration air is supplied from below said elastic membrane.

24. The method of discharging powder material as set forth in claim 22, wherein said positive pulsating vibration air is supplied from above the powder material stored in said tubular body.

25. The method of discharging powder material as set forth in claim 24, in which said elastic membrane is attached to the lower portion of said tubular body with by means of an elastic membrane installation means, wherein said elastic membrane installation means comprises:

a pedestal with an opening at its center;

a push-up member with an opening at its center, which is disposed in the standing status on said pedestal; and a presser member with an opening at its center, said opening being a little larger than the periphery size of said push-up member, wherein said pedestal has on its surface an annular V-groove so formed as to surround said opening of said pedestal outside of the periphery of said push-up member and outside of said opening of said pedestal, whereas said presser member has on its surface facing said pedestal an annular V-shape projection portion so formed as to engage into said annular V-groove on the surface of said pedestal, wherein said push-up member is disposed on the surface of said pedestal, on which said elastic membrane is disposed, and further said presser member is so tightly secured as to cover said push-up member together with said elastic membrane to said pedestal, whereby said elastic membrane is expanded from its inner side to its outer side by being pushed up toward said presser member by means of said push-up member, while the periphery part of said elastic membrane is held between the periphery part of said push-up member and the surface forming an opening of said presser member and further expanded to be held between said annular V-groove formed on the surface of said pedestal and said annular V-shape projection portion formed on the surface facing said pedestal, and wherein said presser member is secured to the lower portion of said tubular body.

26. The method of discharging powder material as set forth in claim 25, wherein an inclined plane is formed on the periphery of said push-up member, said inclined plane having a bottom part broader than its top part when seen in its section.

* * * * *

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 2,
Line 43, "discharge" should read -- discharged --.

Column 3,
Line 28, "Etca" should read -- EtcA --.

Column 4,
Line 29, "being" should read -- around --; and
Line 35, "comparing" should read -- compared --.

Column 5,
Line 27, "comparing" should read -- compared --; and
Line 40, "cocentric" should -read -- concentric --.

Column 6,
Line 14, "paring" should read -- pared --.

Column 8,
Lines 43 and 44, "cocentric" should read -- concentric --; and
Line 64, "comparing" should read -- compared --.

Column 9,
Line 25, "cocentric" should read -- concentric --; and
Line 53, "membrane, thereby" should read -- membrane. Thereby --.

Column 10,
Line 16, "air, thereby" should read -- air. Thereby --;
Line 24, "circle, thereby" should read -- circle. Thereby --;
Line 41, "accords" should read -- coincide --;
Line 60, "air, thereby" should read -- air. Thereby --; and
Line 61, "aperture." should read -- apertures. --.

Column 11,
Line 2, "circle, thereby" should read -- circle. Thereby --;
Line 24, "apertures" should read -- aperture --;
Line 43, "circle, thereby" should read -- circle. Thereby --;
Line 59, "pipe, therefore," should read -- pipe. Therefore --; and
Lines 61-62, "constructing such that" should read -- So constructed --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 12,
Line 5, "flow" should read -- flow of --;
Line 35, "air, thereby" should read -- air. Thereby --;
Line 36, "hopper" should read -- the hopper --;
Line 49, "air, therefore" should read -- air. Therefore --; and
Line 62, "with by" should read -- by --.

Column 13,
Line 28, "thereby" should read -- whereby --.

Column 14,
Line 63, "comparing" should read -- compared --.

Column 15,
Lines 10 and 27, "comparing" should read -- compared --; and
Line 27, "comparing" should read -- compared --.

Column 16,
Line 10, "circle, thereby" should read -- circle. Thereby --;
Line 23, "constant," should read -- constant. --;
Line 24, "thereby" should read -- Thereby --;
Line 40, "comparing" should read -- compared --; and
Line 43, "in radial" should read -- radial --.

Column 17,
Lines 4 and 27, "comparing" should read -- compared --;
Line 39, "in radial" should read -- radial --;
Line 40, "thereby" should read -- whereby --;
Line 50, "of the" should be deleted; and
Line 54, "circle, thereby" should read -- circle. Thereby --.

Column 18,
Lines 6 and 25, "circle, thereby" should read -- circle. Thereby --; and
Line 62, "with by" should read -- by --.

Column 19,
Line 28, "thereby" should read -- whereby --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 20,
Line 24, "thereby" should read -- whereby --;
Line 26, "timecan" should read -- time can --;
Line 40, "fig. 3" should read -- fig. 3, consisting of figs. 3a, 3b and 3c, --; and
Lines 43, 50, 58 and 65, "other" should read -- another --.

Column 21,
Lines 5, 12, 19, 27, 35, 43, 51 and 60, "other" should read -- another --.

Figure 24C:
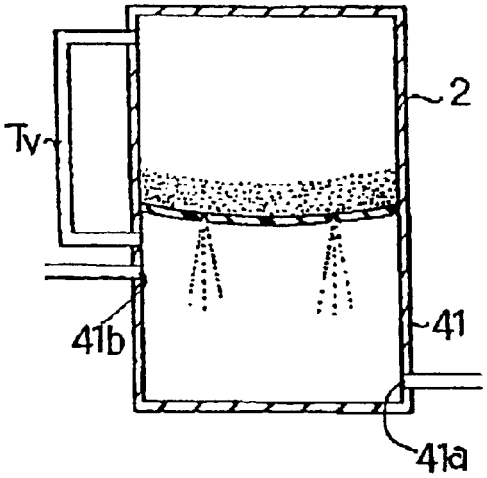

Column 22,
Line 1, "other" should read -- another --; and
Line 48, "fig. 24" should read -- fig. 24, consisting of figs. 24a, 24b and 24c, --.

Figure 42A:
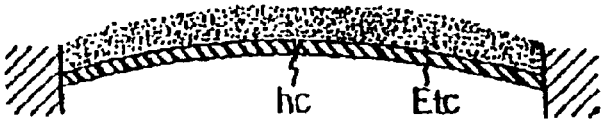
FIG. 42 is an explanatory view diagrammatically showing operations of an elastic membrane of a conventional discharge apparatus for a minute amount of powder.
Figure 42B:
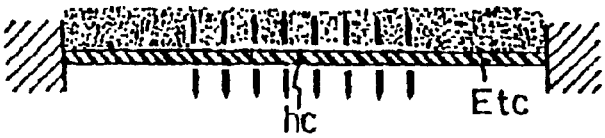
Figure 42C:
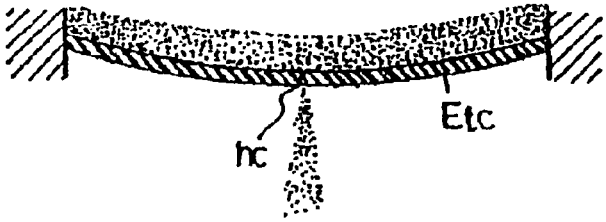
Figure 43:
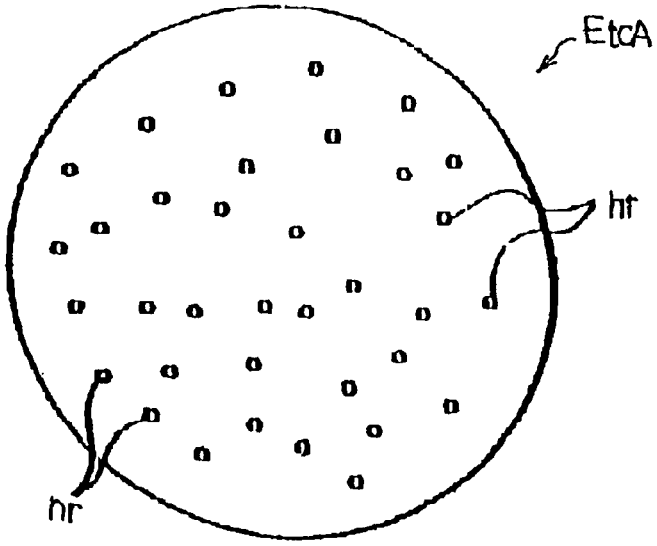
FIG. 43 is a plan view diagrammatically showing an elastic membrane with plural penetrating aperture.

Column 23,
Line 12, "other" should read -- another --;
Line 18, "fig. 35" should read -- fig. 35, consisting of figs. 35a, 35b, 35c and 35d, --;
Line 38, "fig. 42" should read -- fig. 42, consisting of fibs. 42a, 42b and 42c, --; and
Line 51, "apparatus" should read -- apparatus is provided --.

Column 24,
Lines 12, 15 and 19, "are" should read -- is --.

Column 25,
Line 24, "becomes" should read -- reaches --;
Line 52, "their" should read -- to their --; and
Line 55, "in" should be deleted.

Column 26,
Line 6, "apertures" should read -- aperture --;
Line 13, "its" should read -- to its --;
Line 49, "symmetric" should read -- symmetry --; and
Line 53, "aperture" should --apertures --.

Column 27,
Line 55, "defined" should read -- is defined --; and
Line 58, "hs" should read -- hs ... --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 28,
Line 7, "in symmetric" should read -- symmetrically --;
Line 14, "far" should read -- long --;
Line 50, "a" should be deleted; and
Line 56, "apertures" should read -- aperture --.

Column 29,
Line 1, "a" should read -- an --;
Lines 19 and 43, "apertures" should read -- aperture --; and
Line 66, "hs .... should read -- hv ... --.

Column 30,
Line 5, "hs . . ." should read -- hv ... --;
Line 8, "its" should read -- the-- and "apertures" should read -- aperture --;
Line 19, "from" should read -- to --;
Line 33, "against" should read -- to --;
Lines 34 and 35, "in symmetric" should read -- symmetrically --; and
Line 57, "and," should read -- and --.

Column 31,
Line 34, "apertures" should read -- aperture --; and
Lines 52 and 57, "symmetric" should read -- symmetry --.

Column 32,
Line 2, "in symmetric" should read -- symmetrically --; and
Lines 12, 16, 21, 27, 31, 36, 44 and 49, "symmetric" should read -- symmetry --.

Column 33,
Line 1, "symmetric" should read -- symmetry --;
Line 40, "each" should read -- all of the --.

Column 36,
Line 18, "in symmetric" should read -- symmetrically --;
Line 21, "in sym-" should read -- symmetrically --; and
Line 22, "metric" should be deleted.

Column 37,
Lines 31 and 34, "in symmetric" should read -- symmetrically --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 39,
Line 12, "in symmetric" should read -- symmetrically --;
Line 15, "in sym-" should read -- symmetrically --; and
Line 16, "metric" should be deleted.

Column 40,
Line 66, "in symmetric" should read -- symmetrically --.

Column 41,
Line 2, "in symmetric" should read -- symmetrically --.

Column 43,
Line 8, "anew" should read -- a new --.

Column 44,
Line 8, "in symmetric" should read -- symmetrically --;
Line 11, "in sym-" should read -- symmetrically --; and
Line 12, "metric" should be deleted.

Column 45,
Lines 60 and 63, "in symmetric" should read -- symmetrically --.

Column 51,
Lines 24, 28 and 49, "consisting" should read -containing --.

Column 55,
Line 20, "aperture" should read -- apertures --; and
Line 52, "responsibility" should read -- responsiveness --.

Column 56,
Line 8, "far" should read -- long --.

Column 57,
Line 14, "cleaning" should read -- cleanings --; and
Line 18, "isn't almost" should read -- is almost not --.

Column 58,
Line 6, "far" should read -- long --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 59,
Line 13, "cleaning" should read -- cleanings --.

Column 63,
Line 9, "is" should read -- are --.

Column 64,
Line 5, "suck" should read -- suctioned --.

Column 65,
Lines 29, 35, 42, 45 and 54, "affection" should read -- defection --.

Column 69,
Line 15, "is appeared" should read -- appears --.

Column 70,
Line 27, "affection" should read -- defection --.

Column 71,
Line 18, "diagrammatical" should read -- diagrammatically --.

Column 72,
Line 54, "1Powder" should read -- I, powder --.

Column 73,
Line 34, "goes" should read -- goes to --;
Line 39, "becomes" should read -- reaches --; and
Line 44, "its" should read -- at its --.

Column 74,
Line 3, "IPow-" should read -- 1, pow- --; and
Line 16, "isn't appeared" should read -- does not appear --.

Column 78,
Line 33, "experiments" should read -- experiment --; and
Line 64, "in symmetric" should read -- symmetrically --.

UNITED STATES PATENT AND TRADEMARK OFFICE

CERTIFICATE OF CORRECTION

PATENT NO. : 6,814,317 B2
DATED : November 9, 2004
INVENTOR(S) : Yasushi Watanabe et al.

It is certified that error appears in the above-identified patent and that said Letters Patent is hereby corrected as shown below:

Column 79,
Line 13, "case that" should read -- the case in which --; and
Line 63, "the" should be deleted.

Column 80,
Line 44, "in radial" should read -- radially --.

Column 83;
Line 16, "case that" should read -- the case in which --.

Column 84,
Lines 13-14, "of being" should be deleted;
Line 43, "specific" should read -- virtual circle --; and
Line 50, "in radial" should read -- radially --.

Column 87,
Line 46, "in in" should read -- in --.

Column 90,
Line 44, "with by" should read -- by --.

Signed and Sealed this

Twenty-fourth Day of May, 2005

JON W. DUDAS
*Director of the United States Patent and Trademark Office*